US009112284B2

(12) United States Patent
Andujar Linares et al.

(10) Patent No.: US 9,112,284 B2
(45) Date of Patent: Aug. 18, 2015

(54) WIRELESS DEVICE CAPABLE OF MULTIBAND MIMO OPERATION

(71) Applicant: Fractus, S.A., Barcelona (ES)

(72) Inventors: Aurora Andujar Linares, Barcelona (ES); Jaume Anguera Pros, Vinaros (ES); Carles Puente Baliarda, Barcelona (ES); Cristina Picher Planellas, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 14/581,044

(22) Filed: Dec. 23, 2014

(65) Prior Publication Data

US 2015/0162667 A1 Jun. 11, 2015

Related U.S. Application Data

(63) Continuation of application No. 13/755,189, filed on Jan. 31, 2013, now Pat. No. 8,952,855, which is a continuation of application No. PCT/EP2011/063377, filed on Aug. 3, 2011.

(60) Provisional application No. 61/370,368, filed on Aug. 3, 2010.

(30) Foreign Application Priority Data

Aug. 3, 2010 (EP) ..... 10171703
Feb. 15, 2011 (ES) ..... 201130202

(51) Int. Cl.
*H01Q 21/00* (2006.01)
*H01Q 21/30* (2006.01)
(Continued)

(52) U.S. Cl.
CPC ..... *H01Q 21/0006* (2013.01); *H01Q 1/243* (2013.01); *H01Q 1/48* (2013.01); *H01Q 1/50* (2013.01); *H01Q 21/28* (2013.01); *H01Q 21/30* (2013.01)

(58) Field of Classification Search
CPC ..... H01Q 1/48; H01Q 1/50
See application file for complete search history.

(56) References Cited

U.S. PATENT DOCUMENTS 4,491,843 A 1/1985 Boubouleix
4,843,468 A 6/1989 Drewery
(Continued)

FOREIGN PATENT DOCUMENTS

CN 1649206 8/2005
CN 201069869 6/2008
(Continued)

OTHER PUBLICATIONS

Addison, P. S., "Fractals and Chaos: An Illustrated Course," Institute of Physics Publishing: Bristol and Philadelphia (1997).
(Continued)

*Primary Examiner* — Robert Karacsony
(74) *Attorney, Agent, or Firm* — Edell, Shapiro & Finnan, LLC

(57) ABSTRACT

A wireless handheld or portable device includes a communication module with a MIMO system that provides multiband MIMO operation in first and second frequency bands. The MIMO system includes first and second radiating systems, a ground plane common to the two radiating systems, first and second radio frequency systems, and a MIMO module. The first and second radiating systems both operate in the first and second frequency bands and respectively include first and second radiating structures coupled to the ground plane, which respectively have first and second radiation boosters that fit in an imaginary sphere having a diameter smaller than ¼ of a diameter of a radiansphere of a longest wavelength of the first frequency band. The first and second radiofrequency systems respectively modify impedance of the first and second radiating structures to provide impedance matching to the first and second radiating systems within the first and second frequency bands.

20 Claims, 21 Drawing Sheets

(51) Int. Cl.

| | |
|---|---|
| ***H01Q 1/50*** | (2006.01) |
| ***H01Q 1/48*** | (2006.01) |
| ***H01Q 21/28*** | (2006.01) |
| ***H01Q 1/24*** | (2006.01) |

(56) References Cited

U.S. PATENT DOCUMENTS

| | | | |
|---|---|---|---|
| 5,363,114 | A | 11/1994 | Shoemaker |
| 5,489,912 | A | 2/1996 | Holloway |
| 5,657,386 | A | 8/1997 | Schwanke |
| 5,666,125 | A | 9/1997 | Luxon |
| 5,784,032 | A | 7/1998 | Johnston |
| 5,826,201 | A | 10/1998 | Gratias |
| 5,903,822 | A | 5/1999 | Sekine |
| 6,011,518 | A | 1/2000 | Yamagishi |
| 6,087,990 | A | 7/2000 | Thill et al. |
| 6,133,883 | A | 10/2000 | Munson et al. |
| 6,211,826 | B1 | 4/2001 | Aoki |
| 6,218,989 | B1 | 4/2001 | Schneider et al. |
| 6,218,992 | B1 | 4/2001 | Sadler et al. |
| 6,373,439 | B1 | 4/2002 | Zürcher et al. |
| 6,388,631 | B1 | 5/2002 | Livingston |
| 6,674,411 | B2 | 1/2004 | Boyle |
| 6,791,498 | B2 | 9/2004 | Boyle |
| 6,873,299 | B2 | 3/2005 | Dakeya et al. |
| 7,069,043 | B2 | 6/2006 | Sawamura |
| 7,176,845 | B2 | 2/2007 | Fabrega-Sanchez |
| 7,215,284 | B2 | 5/2007 | Collinson |
| 7,274,340 | B2 | 9/2007 | Ozden |
| 7,511,675 | B2 | 3/2009 | Puente et al. |
| 7,688,276 | B2 | 3/2010 | Quintero |
| 7,764,232 | B2 | 7/2010 | Achour et al. |
| 7,768,462 | B2 | 8/2010 | Zhang et al. |
| 7,876,274 | B2 | 1/2011 | Hobson et al. |
| 2002/0149524 | A1 | 10/2002 | Boyle |
| 2003/0174092 | A1 | 9/2003 | Sullivan et al. |
| 2004/0058723 | A1 | 3/2004 | Mikkola et al. |
| 2004/0145527 | A1 | 7/2004 | Mikkola |
| 2004/0147297 | A1 | 7/2004 | Mikkola |
| 2004/0171404 | A1 | 9/2004 | Annamaa |
| 2004/0244187 | A1 | 12/2004 | Annamaa |
| 2005/0237243 | A1 | 10/2005 | Annamaa |
| 2006/0135090 | A1 | 6/2006 | Annamaa |
| 2006/0176225 | A1 | 8/2006 | Annamaa |
| 2007/0109196 | A1 | 5/2007 | Tang et al. |
| 2007/0109208 | A1 | 5/2007 | Turner |
| 2007/0139277 | A1 | 6/2007 | Nissinen |
| 2007/0146212 | A1 | 6/2007 | Ozden |
| 2007/0152885 | A1 | 7/2007 | Sorvala |
| 2007/0152886 | A1 | 7/2007 | Fractus |
| 2007/0171131 | A1 | 7/2007 | Sorvala |
| 2008/0018543 | A1 | 1/2008 | Baliarda et al. |
| 2008/0030410 | A1 | 2/2008 | Ying |
| 2008/0042909 | A1 | 2/2008 | Puente Baliarda et al. |
| 2008/0088511 | A1 | 4/2008 | Sorvala |
| 2008/0100514 | A1 | 5/2008 | Abdul-Gaffoor |
| 2008/0136716 | A1 | 6/2008 | Annamaa |
| 2008/0303729 | A1 | 12/2008 | Milosavljevic |
| 2009/0005110 | A1 | 1/2009 | Ozden |
| 2009/0128425 | A1 | 5/2009 | Kim et al. |
| 2009/0309797 | A1 | 12/2009 | Ozden |
| 2009/0322619 | A1 | 12/2009 | Ollikainen et al. |
| 2009/0322623 | A1 | 12/2009 | Xie et al. |
| 2010/0073253 | A1 | 3/2010 | Ollikainen |
| 2010/0176999 | A1 | 7/2010 | Anguera et al. |
| 2010/0188300 | A1 | 7/2010 | Anguera et al. |
| 2011/0115677 | A1 | 5/2011 | Rao et al. |

FOREIGN PATENT DOCUMENTS

| | | |
|---|---|---|
| EP | 0969375 | 1/2000 |
| EP | 1093098 | 4/2001 |
| EP | 1258054 | 11/2002 |
| EP | 1662604 | 5/2006 |
| ES | 2112163 | 3/1998 |
| FR | 2211766 | 7/1974 |
| GB | 2344969 | 6/2000 |
| KR | 10-0695813 | 3/2007 |
| KR | 10-2008-0080409 | 9/2008 |
| KR | 20090016494 | 2/2009 |
| WO | 94/26000 | 11/1994 |
| WO | 97/06578 | 2/1997 |
| WO | 97/47054 | 12/1997 |
| WO | 99/27608 | 6/1999 |
| WO | 01/54225 | 7/2001 |
| WO | 02/13306 | 2/2002 |
| WO | 02/063712 | 8/2002 |
| WO | 02/071541 | 9/2002 |
| WO | 00/76023 | 12/2002 |
| WO | 2006/020285 | 2/2006 |
| WO | 2006/097496 | 9/2006 |
| WO | 2006/097567 | 9/2006 |
| WO | 2007/039071 | 4/2007 |
| WO | 2007/039668 | 4/2007 |
| WO | 2007/128340 | 11/2007 |
| WO | 2007/138157 | 12/2007 |
| WO | 2007/141187 | 12/2007 |
| WO | 2008/009391 | 1/2008 |
| WO | 2008/045151 | 4/2008 |
| WO | 2008/119699 | 10/2008 |
| WO | 2010/010529 | 1/2010 |
| WO | 2010/015364 | 2/2010 |
| WO | 2010/015365 | 2/2010 |

OTHER PUBLICATIONS

Aguilar, D., et al., "Small Handset Antenna for FM Reception," Microwave and Optical Technology Letters, vol. 50, No. 10, pp. 2677-2683 (2008).

Balanis, C.A., "Antenna Theory: Analysis and Design,"—Chapter 4—Linear wire antennas, Hamilton Printing, pp. 133-194 (1982).

Bank, M., and Levin, B., "The Development of a Cellular Phone Antenna With Small Irradiation of Human-Organism Tissues," IEEE Antennas and Propagation Magazine,vol. 49, No. 4, pp. 65-73 (2007).

Bedair, A., et al., "Design and Development of High Gain Wideband Microstrip Antenna and DGS Filters Using Numerical Experimentation Approach," Fakultat Elektrotechnik und Informationstechnik der Otto-von-Guericke-Universitat Magdeburg (Jun. 2005).

Behdad, N., et al., "Slot Antenna Design for Wireless Communications Systems," The Second European Conference on Antennas and Propagation, 2007, pp. 1-9 (Nov. 2007).

Berizzi, F., and Dalle-Mese, E., "Fractal Analysis of the Signal Scattered From the Sea Surface," IEEE Transactions on Antennas and Propagation, vol. 47, No. 2, pp. 324-338 (1999).

Bialkowski, M., et al., "An Equivalent Circuit Model of a Radial Line Planar Antenna With Coupling Probes," 2002 IEEE Antennas and Propagation Society International Symposium, vol. 3, pp. 392-395 (Jun. 2002).

Blanch, S. et al., "Exact Representation of Antenna System Diversity Performance From Input Parameter Description," Electronics Letters, vol. 39, No. 9, pp. 705-707 (May 2003).

Boshoff, H., "A Fast Box Counting Algorithm for Determining the Fractal Dimension of Sampled Continuous Functions," Proceedings of the 1992 South African Symposium on Communications and Signal Processing, pp. 43-48 (Sep. 1992).

Byndas, A. et al., "Investigations into Operation of Single- and Multi-Layer Configurations of Planar Inverted-F Antenna," IEEE Antennas and Propagation Magazine, vol. 49, No. 4, pp. 22-33 (2007).

Cabedo-Fabrés, M., "Modal Analysis of o Radiating Slotted PCB for Mobile Handsets," Proc. 1st European Conference on Antennas and Propagation, Nice, France (Nov. 2006).

Cabedo-Fabrés, M., "Systematic Design of Antennas Using the Theory of Characteristic Modes," Universitat Politécnica de Valencia—PhD Dissertation (Feb. 2007).

Cabedo-Fabrés, M. et al., "Wideband Radiating Ground Plane With Notches," 2005 IEEE Antennas and Propagation Society International Symposium, vol. 2B, pp. 560-563 (Jul. 2005).

(56) References Cited

OTHER PUBLICATIONS

Cabedo-Fabrés, M. et al., "The Theory of Characteristics Modes Revisited: A Contribution to the Design of Antennas for Modern Applications," IEEE Antennas and Propagation Magazine, vol. 49, No. 5, pp. 52-68 (2007).
Carver, K. R. et al., "Microstrip Antenna Technology," IEEE Transactions on Antennas and Propagation, vol. AP-29, No. 1, pp. 2-24 (Jan. 1981).
Chen, S. et al., "On the Calculation of Fractal Features from Images," IEEE Transactions on Pattern Analysis and Machine Intelligence, vol. 15, No. 10, pp. 1087-1090 (1993).
Collins, B.S., "Improving the RF Performance of Clamshell Handsets," 2006 IEEE International Workshop on Antenna Technology Small Antennas and Novel Metamaterials, pp. 265-268 (Mar. 2006).
Falconer, K., "Fractal Geometry: Mathematical Foundations and Applications," John Wiley Sons—2nd ed., England (2003).
Fang, S., and Shieh, M., "Compact Monopole Antenna for GSM/DCS/PCS Mobile Phone," 2005 Asia-Pacific Conference Proceedings: Microwave Conference Proceedings, vol. 4 (2005).
Feng, J., "Fractional Box-Counting Approach to Fractal Dimension Estimation," 1996 Proceedings of the 13th International Conference on Pattern Recognition, vol. 2, pp. 854-858 (Aug. 1996).
Garg, R. et al., "Microstrip Antenna Design Handbook," Artech House:Boston 2001, p. 845.
Hall, P.S., et al., "Reconfigurable Antenna Challenges for Future Radio Systems," 3rd European Conference Antennas and Propagation, pp. 949-955 (Mar. 2009).
Hansen, R.C., "Fundamental Limitations in Antennas," Proceedings of the IEEE, vol. 69, No. 2, pp. 170-182 (Feb. 1981).
Hirose, K., et al., "Low-Profile Circularly Polarized Radiation Elements-Loops with Balanced and Unbalanced Feeds," IEEE Antennas and Propagation Society International Symposium, pp. 1-4 (Jul. 2008).
Hong, W. et al., "Low-Profile, Multi-Element, Miniaturized Monopole Antenna," IEEE Transactions on Antennas and Propagation, vol. 57, No. 1, pp. 72-80 (2009).
Hus, Ming-Ren, and Wong , K., "Ceramic Chio Antenna for WWAN Operation," 2008 Asia-Pacific Microwave Conference, pp. 1-4 (Dec. 2008).
Huynh, M.C., "A Numerical and Experimental Investigation of Planar Inverted-F Antennas for Wireless Communication Applications," Virginia Polytechnic Institute and State University—Thesis (Oct. 2000).
Ilvonen, J., "Isolated Antenna Structures of Mobile Terminals," Helsinki University of Technology—MSc Thesis, p. 98 (Aug. 2009).
Jung, C., et al., "Reconfigurable Scan-Beam Single-Arm Spiral Antenna Integrated With RF-MEMS Switches," IEEE Transactions on Antennas and Propagation, vol. 54, No. 2, pp. 455-463 (Feb. 2006).
Kabacik, P., "Potential Advantage of Using Non Rectangular Ground in Small Antennas Featuring Wideband Impedance Match," 2007 IEEE Antennas and Propagation Society International Symposium, pp. 1052-1055 (Jun. 2007).
Kabacik, P., et al., "Broadening the range of resonance tuning in multiband small antennas," 2003 IEEE Topical Conference on Wireless Communication Technology, pp. 279-281 (Oct. 2003).
Kabacik, P., et al., "Broadening the Bandwidth in Terminal Antennas by Tuning the Coupling Between the Element and Its Ground," 2005 IEEE Antennas and Propagation Society International Symposium, vol. 3A, pp. 557-560 (Jul. 2005).
Kabacik, P., et al., "An Application of a Narrow Slot Cut in the Ground to Improve Multi-Band Operation of a Small Antenna," 2003 IEEE Topical Conference on Wireless Communication Technology, pp. 18-19 (Oct. 2003).
Kabir, S., et al., "Multiple Antenna Concept Based on Characteristic Modes of Mobiles Phone Chassis," The second European Conference on Antennas and Propagation. EUCAP 2007, pp. 1-6 (Nov. 2007).
Kildal, P.S., et al., "Report on the State of the Art in Small Terminal Antennas: Technologies, Requirements and Standards," ACE, p. 120 (Dec. 2004).
Kim, Y.Y and Lee, S., "Design and Fabrication of a Planar Inverted-F Antenna for the Wireless Lan in the 5 Ghz Band," Microwave and Optical Technology Letters, vol. 34, No. 6, pp. 469-475 (Sep. 2002).
Kivekas, O., "Design of High-Efficiency Antennas for Mobile Communications Devices," University of Technology of Helsinki-Thesis, Espoo: Otamedia, p. 50 (Aug. 2005).
Kobayashi, K., et al., "Estimation of 3D Fractal Dimension of Real Electrical Tree Patterns," Proceedings of the 4th International Conference on Properties and Applications of Dielectric Materials, vol. 1, pp. 359-362 (Jul. 1994).
Kraus, J.D., "Antennas: Second Edition," McGraw-Hill Book Company: New York, (Jan. 1988).
Kyro, M., et al., "Dual-Element Antenna for DVB-H Terminal," 2008 Loughborough Antennas and Propagation Conference, pp. 265-268 (Mar. 2008).
Lin , CI et al., "Printed Monopole Slot Antenna for Multiband Operation in the Mobile Phone," 2007 IEEE Antennas and Propagation Society International Symposium, pp. 629-632 (Jun. 2006).
Lindberg, P., "Wideband Active and Passive Antenna Solutions for Handheld Terminals," Acta Universitatis Upsaliensis Uppsala—Dissertation (Jan. 2007).
Martinez, M., "A Review of ACE Small Terminal Antennas Activities," ACE , (Nov. 2004).
Meinke, H., Taschenbuch der hochfrequenztechnik—XP002560328, Springer-Verlag , Jan. 1, 1992, p. 14.
Meinke, H., Aktive Empfangsantennen—XP002462630 , Springer-Verlag , Jan. 1, 1992, p. 36.
Meinke, H., and Gundlach, F., "Taschenbuch der Hochfrequenztechnik: Paperback of High Frequency Engineering With the Collaboration of Several Experts," Springer-Verlag: Berlin (1968).
Meinke, H., and Gundlach, F., "Taschenbuch der hochfrequenztechnik—Handbook of High Frequency Technique," Springer-Verlag: Berlin (1968).
Mi, M., et al., "RF Energy Harvesting With Multiple Antennas in the Same Space," IEEE Antennas and Propagation Magazine, vol. 47, No. 5, pp. 100-106 (Oct. 2005).
Minard, P., et al., "On-Board Integration of Compact Printed Wifi Antennas With Existing DECT Antenna System," 2008 IEEE Antennas and Propagation Society International Symposium, pp. 1-4 (Jul. 2008).
Document 0190—Defendant HTC Corporation's First amended answer and counterclaim to plaintiff's amended complaint , Defendants , Oct. 2, 2009.
Expert report of Dwight L. Jaggard (redacted)—expert witness retained by Fractus , Fractus , Feb. 23, 2011.
Letter from Baker Botts to Kenyon & Kenyon LLP, Winstead PC and Howison & Arnott LLP including exhibits. , Defendants—Baker Botts , Oct. 28, 2009.
Rebuttal expert report of Dr. Dwight L. Jaggard (redacted version) , Fractus , Feb. 16, 2011.
Rebuttal expert report of Dr. Stuart A. Long (redacted version) , Fractus , Feb. 16, 2011.
EP00909089—Minutes from Oral Proceedings , EPO , Jan. 28, 2005.
EP00909089—Office Action dated on Feb. 7, 2003 , EPO.
EP00909089—Response to Office Action dated on Feb. 7, 2003 , Herrero & Asociados , Aug. 14, 2003.
EP00909089—Summons to attend oral proceedings , EPO , Oct. 28, 2004.
EP00909089—Written submissions , Herrero & Asociados , Dec. 15, 2004.
Morishita, H. et al., "Design Concept of Antennas for Small Mobile Terminals and the Future Perspective," IEEE Antennas and Propagation Magazine, vol. 44(5):30-43 (Oct. 2002).
Munson, R., "Antenna Engineering Handbook—Chapter 7: Microstrip Antennas," Richard C. Johnson, editor, McGraw-Hill—Third Edition (1993).
NA , Software—Box counting dimension [electronic] , http://www.sewanee.edu/Physics/PHYSICS123/Box%20COUNTING%20DIMENSION.html (Apr. 2002).
Neary, D., "Fractal Methods in Image Analysis and Coding," Dublin City University—MSc Thesis (2001).

(56) References Cited

OTHER PUBLICATIONS

Ng, V., "Diagnosis of Melanoma With Fractal Dimensions," 1993 IEEE Region 10 Conference on Computer, Communication, Control and Power Engineering, vol. 4, pp. 514-517 (Oct. 1993).
Ollikainen, J., "Design and Implementation Techniques of Wideband Mobile Communications Antennas," Helsinki University of Technology—Doctoral Thesis, pp. 16-20 (Nov. 2004).
Park, J., et al., "Performance Improvement Methodology of Isolation in a Dual-Standby Mobile Phone by Optimizing Antenna Topology and Position," 2008 IEEE Antennas and Propagation Society International Symposium, pp. 1-4 (Jul. 2008).
Peitgen, Heinz-Otto, et al., "Chaos and Fractals. New Frontiers of Science: Second Edition," Springer-Verlag: New York, pp. 212-216; and 387-388 (1993).
Penn, A., "Fractal Dimension of Low-Resolution Medical Images," Proceedings of the 18th Annual International Conference of the IEEE; Engineering in Medicine and Biology Society, vol. 3, pp. 1163-1165 (Oct. 1996).
Poutanen, J., "Interaction Between Mobile Terminal Antenna and User," Helsinki University of Technology—MSc Thesis (Sep. 2007).
Poutanen, J., et al., "Behavior of Mobile Terminal Antennas Near Human Tissue at a Wide Frequency Range," International Workshop on Antenna Technology: Small Antennas and Novel Metamaterials, Iwat2008, Chiba, Japan, pp. 219-222 (2008).
Pozar, D.M., "Microstrip Antennas: The Analysis and Design of Microstrip Antennas and Arrays," David M. Pozar, editor, IEEE Press: New York, p. 431 (1995).
Rahola, J., and Ollikainen, J., "Optimal Antenna Placement for Mobile Terminals Using Characteristic Mode Analysis," 2006 First European Conference on Antennas and Propagation (EUCAP), Nice, pp. 1-6 (Nov. 2006).
Rao, Q., and Wen, G, "Ultra-Small Cubic Folded Strip Antenna for Handset Devices," 2008 IEEE Antennas and Propagation Society International Symposium. AP-S 2008, pp. 1-4 (Jul. 2008).
Rouvier, R. et al., "Fractal Analysis of Bidimensional Profiles and Application to Electromagnetic Scattering From Soils," 1996 International Geoscience and Remote Sensing Symposium, vol. 4, pp. 2167-2169 (May 1996).
Russell, D.A., et al., "Dimension of Strange Attractors," Physical Review Letters, vol. 45, No. 14, pp. 1175-1178 (Oct. 1980).
Sarkar, N., and Chaudhuri, B.B., "An Efficient Differential Box-Counting Approach to Compute Fractal Dimension of Image," IEEE Transactions on Systems, Man and Cybernetics, vol. 24, No. 1, pp. 115-120 (Aug. 2002).
Schroeder, W. L., et al., "Miniaturization of Mobile Phone Antennas by Utilization of Chassis Mode Resonances," 2006 36th European Microwave Conference (Sep. 2006).
Serrano, R., et al., "Active Balanced Feeding for Compact Wideband Antennas," 2007 IEEE Antennas and Propagation Society International Symposium, p. 2829 (Jun. 2007).
Skrivervik, A. K., et al., "PCS Antenna Design—The Challenge of Miniaturization," IEEE Antennas and Propagation Magazine, vol. 43, No. 4, pp. 12-27 (Aug. 2001).
SO, P. et al., "Box-Counting Dimension Without Boxes: Computing D0 From Average Expansion Rates," Physical Review E, vol. 60, No. 1, pp. 378-385 (Jul. 1999).
Su, C., et al., "EMC Internal Patch Antenna for UMTS Operation in a Mobile Device," IEEE Transactions on Antennas and Propagation, vol. 53, No. 11, pp. 3836-3839 (Nov. 2005).
Su, C., et al., "Users Hand Effects on EMC Internal GSM/DCS Mobile Phone Antenna," 2006 IEEE Antennas and Propagation Society International Symposium, pp. 2097-2100 (Jul. 2006).
Talmola, P., "Finding the Right Frequency: Impact of Spectrum Availability Upon the Economics of Mobile Broadcasting," IET Seminar on RF for DVB-H/DMB Mobile Broadcast: Handset and Infrastructure Challenges, pp. 3-24 (Jun. 2006).
Tang, Y., "The Application of Fractal Analysis to Feature Extraction," 1999 International Conference on Image Processing, vol. 2, pp. 875-879 (Oct. 1999).
Vainikainen, P., et al., "Recent Development of MIMO Antennas and Their Evaluation for Small Mobile Terminals," 17th International Conference on Microwaves, Radar and Wireless Communications. MIKON 2008, pp. 1-10 (May 2008).
Vainikainen, P., "Design and Measurements of Small Antennas for Mobile Terminals: Part I," Helsinki University of Technology (Jun. 2006).
Vainikainen, P., "Design and Measurements of Small Antennas for Mobile Terminals: Part II," Helsinki University of Technology (Jun. 2006).
Villanen, J., et al., "Compact Antenna Structures for Mobile Handsets," 58th Vehicular Technology Conference, 2003. VTC 2003-Fall, vol. 1, pp. 40-44 (Oct. 2003).
Villanen, J., et al., "Coupling Element Based Mobile Terminal Antenna Structures," IEEE Transactions on Antennas and Propagation, vol. 54, No. 7, pp. 2142-2153 (Jul. 2006).
Villanen, J., "Miniaturization and Evaluation Methods of Mobile Terminal Antenna Structures," Helsinki University of Technology, Radio Laboratory Publications—Dissertation, Espoo: Finland, (Nov. 2007).
Villanen, J., et al., "Performance Analysis and Design Aspects of Mobile-Terminal Multiantenna Configurations," IEEE Transactions on Vehicular Technology, vol. 57, No. 3, pp. 1664-1674 (May 2008).
Wong, K., et al., "Printed Loop Antenna with a Perpendicular Feed for Penta-Band Mobile Phone Application," IEEE Transactions on Antennas and Propagation, vol. 56, No. 7, pp. 2138-2141 (Jul. 2008).
Wong, K., "Planar Antennas for Wireless Communications," Wiley Interscience: New Jersey (2003).
Wong, K., "Internal Shorted Patch Antenna for UMTS Folder-Type Mobile Phone," IEEE Transactions on Antennas and Propagation, vol. 53, No. 10, pp. 3391-3394 (Oct. 2005).
Wong, K., and Chang, C., "Surface-Mountable EMC Monopole Chip Antenna for WLAN Operation," IEEE Transactions on Antennas and Propagation, vol. 54, No. 4, pp. 1100-1104 (Apr. 2006).
Wong, K., and Lin, C., "Internal GSM/DCS Antenna Backed by a Step-Shaped Ground Plane for a PDA Phone," IEEE Transactions on Antennas and Propagation, vol. 54, No. 8, pp. 2408-2410 (Aug. 2006).
Wong, K. et al. "Wideband Internal Folded Planar Monopole Antenna for UMTS/Wimax Folder-Type Mobile Phone," Microwave and Optical Technology Letters, vol. 48, No. 2, pp. 324-327 (Feb. 2006).
Wong, K., and Tu, S., "Ultra-Wideband Loop Antenna Coupled-Fed by a Monopole Feed for Penta-Band Folder-Type Mobile Phone," Microwave and Optical Technology Letters, vol. 50, No. 10, pp. 2706-2712 (Oct. 2008).
PCT/EP00/00411—International preliminary examination report dated on Aug. 29, 2002—Notification concerning documents transmitted , EPO , Aug. 29, 2002.
PCT/EP2009/005578—International Search Report and Written Opinion of the International Searching Authority , WIPO , Feb. 17, 2011.
PCT/EP2009/005579—International Search Report and Written Opinion of the International Searching Authority , EPO , May 4, 2010.
U.S. Appl. No. 10/422,578—Office Action dated on Apr. 7, 2005 , USPTO.
U.S. Appl. No. 10/422,578—Office Action dated on Aug. 23, 2007 , USPTO.
U.S. Appl. No. 10/422,578—Office Action dated on Aug. 24, 2005 , USPTO.
U.S. Appl. No. 10/422,578—Office Action dated on Jan. 26, 2006 , USPTO.
U.S. Appl. No. 10/422,578—Office Action dated on Mar. 12, 2007 , USPTO.
U.S. Appl. No. 10/422,578—Office action dated on Mar. 26, 2008 , USPTO.
U.S. Appl. No. 10/422,578—Office Action dated on Oct. 4, 2004 , USPTO.
U.S. Appl. No. 12/669,928—Notice of allowance dated on Apr. 12, 2012 , USPTO.

WIRELESS DEVICE CAPABLE OF MULTIBAND MIMO OPERATION

CROSS REFERENCE TO RELATED APPLICATIONS

This application is a continuation of U.S. patent application Ser. No. 13/755,189 filed Jan. 31, 2013, entitled "Wireless Device Capable of Multiband MIMO Operation," which is a continuation of International Application No. PCT/EP2011/063377, filed on Aug. 3, 2011, which claims the benefit of U.S. Provisional Application No. 61/370,368, filed on Aug. 3, 2010, the entire contents of which are hereby incorporated by reference. In addition, International Application No. PCT/EP2011/063377 claims priority under 35 U.S.C. §119 to Application No. EP 10171703.1 filed on Aug. 3, 2010, and to Application No. ES P201130202 filed on Feb. 15, 2011, the entire contents of each of which are hereby incorporated by reference.

OBJECT AND FIELD OF THE INVENTION

The present invention relates to the field of wireless handheld devices, and generally to wireless portable devices which require the transmission and reception of electromagnetic wave signals.

It is an object of the present invention to provide a wireless handheld or portable device (such as for instance but not limited to a mobile phone, a smartphone, a PDA, an MP3 player, a headset, a USB dongle, a laptop computer, a gaming device, a digital camera, a tablet PC, a PCMCIA or Cardbus 32 card, or generally a multifunction wireless device) which does not require large or bulky antenna elements for the transmission and reception of electromagnetic wave signals in MIMO (Multiple Input Multiple Output) systems. Said wireless handheld or portable device (hereinafter also referred as antennaless wireless handheld or portable device) is yet capable of providing MIMO operation in two or more frequency bands of the electromagnetic spectrum with enhanced radioelectric performance, increased robustness to external effects and/or neighboring components of the wireless device, and/or a reduced interaction with the user.

Another object of the invention relates to a method to enable MIMO operation in a wireless handheld or portable device at two or more frequency bands of the electromagnetic spectrum without requiring the use of a large and/or bulky antenna element. The method provides enhanced radioelectric performance, increased robustness to external effects and/or neighboring components of the wireless device, and/or reduced interaction with the user.

BACKGROUND

Wireless handheld or portable devices typically transmit and/or receive electromagnetic wave signals for one or more cellular communication standards and/or wireless connectivity standards and/or broadcast standards, each standard being allocated in one or more frequency bands, and said frequency bands being contained within one or more regions of the electromagnetic spectrum. For the transmission and/or reception of electromagnetic wave signals, a typical wireless handheld or portable device must include a radiating system capable of operating in one or more frequency bands with an acceptable radioelectric performance (such as for example in terms of input impedance level, impedance bandwidth, gain, efficiency, or radiation pattern). Moreover, the integration of the radiating system within the wireless handheld or portable device must be effective to ensure that the wireless device itself attains a good radioelectric performance (such as for example in terms of radiated power, received power, or sensitivity).

For a good wireless connection, high efficiency is further required. Another common design specification for the radiating system is the voltage standing wave ratio (VSWR) with respect to a typical 50 ohm impedance, which in case of for instance mobile phones, is typically expected to be below VSWR≤4, or preferably below VSWR≤3, and generally as close to VSWR=1 as possible.

In this text, the expression impedance bandwidth is to be interpreted as referring to a frequency region over which a wireless handheld or portable device and a radiating system comply with certain specifications, depending on the service for which the wireless device is adapted. For example, for a device adapted to transmit and receive signals of cellular communication standards, a radiating system having a relative impedance bandwidth of at least 5% (and more preferably not less than 8%, 10%, 15%, 20% or 30%) together with an efficiency of not less than 30% (advantageously not less than 40%, more advantageously not less than 50%) can be preferred. Also, an input return loss of 3 dB or better within the corresponding frequency region can be preferred.

Other demands for radiating systems to be integrated in wireless handheld or portable devices are focused on minimizing the size and the manufacturing costs. Hence, the radiating system is expected to be small for occupying as little space as possible in order to favor the integration of other services and functionalities as well as the integration of other electronic components within the device. In addition, said radiating system must be cost effective.

Further requirements for radiating systems integrated in wireless handheld or portable devices are focused on minimizing the Specific Absorption Rate (SAR).

Of further importance, usually, is the robustness of the radiating system which means that the radiating system does not change its properties upon smaller shocks to the device.

Owing to the need for the transmission and/or reception of electromagnetic wave signals, a space within the wireless handheld or portable device is dedicated to the integration of a radiating system. The radiating system, and especially the antenna element integrated in the radiating system, is, however, expected to be small in order to occupy as little space as possible within the device, enabling both a size reduction of the wireless device and the integration of additional specific components and functionalities. For instance, it is sometimes particularly convenient to reduce the thickness of the antenna element integrated in the radiating system to enable slimmer devices and/or multiple body devices such as clamshell or slider ones which include two or more parts that can be shifted, folded or twisted against each other. Nevertheless, it is known that there is generally a physical trade-off between the size of a radiating system mainly determined by the size of the antenna element and its performance. That is, in general, a size reduction in for instance the area or thickness of the antenna element is turned into a degradation of its performance.

This is even more critical in the case in which the wireless handheld or portable device is a multifunctional wireless device. Commonly-owned patent applications Publication Nos. WO2008/009391 and US2008/0018543 describe a multifunctional wireless device. The entire disclosure of said applications, Publication Nos. WO2008/009391 and US2008/0018543 are hereby incorporated by reference.

Besides the requirements in terms of acceptable electromagnetic behavior, small size, reduced cost and limited interaction with the human body (such as for instance SAR), other aspects of further relevance when designing a radiating system are those oriented to simplify the manufacturing process. One of the current limitations of the prior-art is that generally the radiating system, namely the antenna system is customized for every particular wireless handheld or portable device platform. The mechanical architecture of each wireless handheld or portable device platform is different and the volume available for the antenna depends to a large extent on the form factor of the wireless handheld or portable device platform and the arrangement of the multiple components embedded into the device (e.g., displays, keyboards, battery, connectors, cameras, flashes, speakers, chipsets, memory devices, etc.). As a result, the antenna within the device is mostly designed ad hoc for every model, resulting in a higher cost and a delayed time to market.

Furthermore, the radiating system integrated in a wireless handheld or portable device must provide enough bandwidth for the emergent applications that require high data rates such as HDTV streaming, video-conference in real time, interactive games, VoIP, etc. However, the bandwidth associated to the cellular communication standards, wireless connectivity standards, and broadcast standards is already allocated and can not be increased mainly due to the well-known electromagnetic spectrum limitations. In this sense, MIMO (Multiple Input Multiple Output) technology appears as a particularly promising solution to increase the data rate required by the aforementioned emergent applications, without the need of increasing said bandwidth. Thus, since it is well-known that in a MIMO system the capacity of the channel is directly proportional to the number of paired antennas (i.e., two antennas in the transmitter (M=2) and two antennas in the receiver (M=2) lead to a MIMO system (M×M) of MIMO order (M) equal to 2, which means that the MIMO system is capable of increasing the channel capacity in a factor around 2 with respect to that provided by a SISO system (Single Input Single Output) composed by a single antenna in the transmitter (M=1) and a single antenna in the receiver (M=1)), MIMO technology is based on the use of multiple antennas in the transmitter and in the receiver in order to attain said desirable data rates. As discussed, the integration of a single multiband antenna capable of providing operation in at least two frequency bands with an acceptable radioelectric behavior in a small wireless device is cumbersome as it is strongly constrained by the physical limitations of the wireless handheld or portable device platforms, so shifting from a single antenna system to a multiple antenna MIMO system becomes challenging.

The prior art solutions disclosed in the literature for providing a wireless handheld or portable device integrating the MIMO technology are usually based on antenna elements with a size comparable to the wavelength of operation (A. A. H. Azremi, M. Kyro, J. Ilvonen, J. Holopainen, S. Ranvier, C. Icheln, P. Vainikainen, "Five-element Inverted-F Antenna Array for MIMO Communications and Radio-finding on Mobile Terminal", *Loughborough Antennas and Propagation Conference*, November 2009, Loughborough UK, pp. 557-560; Z. Li, Z. Du, K. Gong, "Compact Reconfigurable Antenna Array for Adaptive MIMO systems", *IEEE Antennas and Wireless Propagation Letters*, vol. 8, 2009, pp. 1317-1320). This limitation prevents the possibility of arranging a large number of antenna elements since on one hand the available space in the wireless handheld or portable device is limited and on the other hand undesired coupling effects appear due to the proximity between the antennas elements caused by said limited available space.

Thus, the arrangement of several conventional handset antenna elements in a wireless handheld or portable device in order to provide MIMO capabilities becomes a challenge since usually the antennas will occupy too much space and/or be placed too close to each other. It is known that reducing the size of an antenna results in a penalty on the attainable bandwidth and radiation efficiency, which might severely drop below the minimum required by a particular application, such as cellular communications. In this sense, a trade-off appears since small antennas are preferred for integration in wireless handheld or portable devices incorporating MIMO technology but, at the same time, these elements must provide good radioelectric performance in order to preserve the benefits of the MIMO technology.

Some techniques to miniaturize and/or optimize the multiband behavior of an antenna element have been described in the prior art. However, the radiating structures disclosed therein still rely on exciting a radiation mode on the antenna element (patent application Publication No. US2007/0152886; patent application Publication No. US2008/0042909), thus, setting its size comparable to the operating wavelength.

In this sense, the antenna elements provided by the prior-art (A. A. H. Azremi, M. Kyro, J. Ilvonen, J. Holopainen, S. Ranvier, C. Icheln, P. Vainikainen, "Five-element Inverted-F Antenna Array for MIMO Communications and Radio-finding on Mobile Terminal", *Loughborough Antennas and Propagation Conference*, November 2009, Loughborough UK, pp. 557-560; Z. Li, Z. Du, K. Gong, "Compact Reconfigurable Antenna Array for Adaptive MIMO systems", *IEEE Antennas and Wireless Propagation Letters*, vol. 8, 2009, pp. 1317-1320) as MIMO solutions for wireless handheld or portable devices mainly operate at a frequency located in a high frequency region where the operating wavelength is small enough to allow the integration of several quarter wavelength antenna elements into the wireless handheld or portable device. Therefore, these proposals are still antenna-based solutions since the contribution to the radiation is predominantly provided by the antenna elements.

Furthermore, a radiating structure operating at a resonant frequency of the antenna element is typically very sensitive to external effects (such as for instance the presence of plastics or dielectric covers that constitute the wireless handheld or portable device), to components of the wireless handheld or portable device (such as for instance, but not limited to, a speaker, a microphone, a connector, a display, a shield can, a vibrating module, a battery, or an electronic module or subsystem) placed either in the vicinity of, or even underneath, the antenna element, and/or to the presence of the user of the wireless handheld or portable device.

Some other attempts (M. Kyrö, M. Mustonen, C. Icheln, P. Vainikainen, "Dual-Element Antenna for DVB-H Terminal", *Loughborough Antennas and Propagation Conference*, March 2008, Loughborough UK, pp. 265-268; S. K. Chaudhury, H. J. Chaloupka, A. Ziroff, "Novel MIMO Antennas for Mobile Terminals", *Proceedings of the* 38$^{th}$ *European Microwave Conference*, October 2008, Amsterdam The Netherlands, pp. 1751-1754; S. K. Chaudhury, W. L. Schroeder, H. J. Chaloupka, "Multiple Antenna Concept Based on Characteristic Modes of Mobile Phone Chassis", *The Second European Conference on Antennas and Propagation, EuCAP* 2007, Edinburgh, pp. 1-6) are focused on antenna elements not requiring a complex geometry while still providing some degree of miniaturization by using an antenna element that is not resonant in the one or more frequency ranges of operation of the wireless handheld or portable device.

The solution presented in (M. Kyrö, M. Mustonen, C. Icheln, P. Vainikainen, "Dual-Element Antenna for DVB-H Terminal", *Loughborough Antennas and Propagation Conference*, March 2008, Loughborough UK, pp. 265-268) is based on the aforementioned concept. However, it provides operation in DVB-H and LTE700 communication standards, which are located in a very low frequency region that clearly limits the integration of such antenna elements in wireless handheld or portable devices. Although some miniaturization is achieved, such a solution is not enough to provide low correlation and low coupling or high isolation between these antenna elements.

Owing to such limitations, while the MIMO performance of the former solution may be sufficient for reception of electromagnetic wave signals, the antenna elements still could not provide an adequate MIMO behavior (for example, in terms of input return losses or gain) for a cellular communication standard requiring also the transmission of a significant amount of power in the form of electromagnetic wave signals.

At the same time, those solutions (S. K. Chaudhury, H. J. Chaloupka, A. Ziroff, "Novel MIMO Antennas for Mobile Terminals", *Proceedings of the* 38$^{th}$ *European Microwave Conference*, October 2008, Amsterdam The Netherlands, pp. 1751-1754; S. K. Chaudhury, W. L. Schroeder, H. J. Chaloupka, "Multiple Antenna Concept Based on Characteristic Modes of Mobile Phone Chassis", *The Second European Conference on Antennas and Propagation, EuCAP* 2007, Edinburgh, pp. 1-6) providing suitable transmission and reception of electromagnetic wave signals are limited to single band operation.

Consequently, antennas for a MIMO enabled wireless device, such as for instance a mobile phone or handset, need to keep a certain size to fully operate within the entire bandwidth of several frequency bands. Even if a few mid-size antennas fit inside a handset, another challenge is to ensure that the multiple antennas are sufficiently uncoupled and uncorrelated to benefit from the MIMO gain. The challenge further exacerbates when the system has to operate at multiple frequency bands, since the antenna performance strongly depends on the antenna size to wavelength relationship, a fact that clearly makes the achievement of multiband operation in a reduced space even more difficult.

The co-pending patent application Publication No. WO2010/015364, the entire disclosure of which is hereby incorporated by reference, discloses a wireless handheld or portable device not requiring an antenna element for multiband operation. This solution is advantageous since more space is available to integrate other wireless handheld components such as batteries, displays, speakers, front-end modules and the like. Nevertheless, since the ground plane acts as the main radiator, there could appear to be a challenge in providing sufficiently uncorrelated current paths in order to preserve the benefits of the MIMO technology.

As discussed, another limitation of current wireless handheld or portable devices relates to the fact that the design and integration of an antenna element for a radiating structure in a wireless device is typically customized for each device. Different form factors or platforms, or a different distribution of the functional blocks of the device will force to redesign the antenna element and its integration inside the device almost from scratch.

For at least the above reasons, wireless device manufacturers regard the volume dedicated to the integration of the radiating structure, and in particular the antenna element, as being a toll to pay in order to provide wireless capabilities to the wireless handheld or portable device.

In order to solve the aforementioned limitations, this patent application discloses a new solution based on miniature radiation boosters (for example, of the type disclosed in, for example, patent application Publication No. WO2010/015364 referred to above; reference is also made to patent application Publication No. WO2010/015365, relating to an antennaless wireless device using a radiation booster; the entire disclosure of WO2010/015365 is incorporated herein by reference) and their arrangement for MIMO systems inside a wireless handheld or portable device, which benefits from their reduced volume to enable a standardized solution capable of multiband operation suitable for several wireless handheld or portable device platforms.

SUMMARY

An antennaless wireless handheld or portable device according to the present invention integrates one or more radiation boosters that enable MIMO operation in the wireless handheld or portable device in two, three, four or more cellular communication standards (such as for example GSM 850, GSM 900, GSM 1800, GSM 1900, UMTS, HSDPA, CDMA 850, CDMA 900, CDMA 1800, CDMA 1900, W-CDMA, LTE, CDMA2000, TD-SCDMA, etc.), wireless connectivity standards (such as for instance WiFi, IEEE802.11 standards, Bluetooth, ZigBee, UWB, WiMAX, WiBro, or other high-speed standards), and/or broadcast standards (such as for instance FM, DAB, XDARS, SDARS, DVB-H, DMB, T-DMB, or other related digital or analog video and/or audio standards), each standard being allocated in one or more frequency bands, and said frequency bands being contained within one, two, three or more frequency regions of the electromagnetic spectrum.

The term antennaless wireless handheld or portable device is just adopted in the context of this document to indicate the integration of radiation boosters. A person skilled in the art would not identify said radiation boosters as "antennas" mainly due to their poor stand-alone radioelectric behavior.

In the context of this document, a frequency band preferably refers to a range of frequencies used by a particular communication standard, a wireless connectivity standard or a broadcast standard; while a frequency region preferably refers to a continuum of frequencies of the electromagnetic spectrum. For example, the GSM 1800 standard is allocated in a frequency band from 1710 MHz to 1880 MHz while the GSM 1900 standard is allocated in a frequency band from 1850 MHz to 1990 MHz. A wireless device operating the GSM 1800 and the GSM 1900 standards must have a radiating system capable of operating in a frequency region from 1710 MHz to 1990 MHz. As another example, a wireless device operating the GSM 1800 standard and the UMTS standard (allocated in a frequency band from 1920 MHz to 2170 MHz), must have a radiating system capable of operating in two separate frequency regions.

In this sense, MIMO operation in two, three, four or more cellular communication standards, wireless connectivity standards and/or broadcast standards directly refers to MIMO operation in two or more frequency bands.

At the same time, MIMO operation in two or more frequency bands requires a combination of radiating systems that must be able of providing operation in at least two common frequency bands. For example, a wireless handheld or portable device capable of multiband MIMO operation according to the present invention includes at least two radiating systems. Said at least two radiating systems are capable of transmitting and receiving electromagnetic wave signals in at least a first frequency band, and at least two of said radiating systems are capable of transmitting and receiving electromagnetic wave signals in at least a second frequency band.

The number of radiating systems having frequency bands in common determines the MIMO order for the particular frequency band in common (i.e. a MIMO system could have different MIMO orders for different frequency bands of operation).

The antennaless or substantially antennaless wireless handheld or portable device capable of multiband MIMO operation according to the present invention may have a candy-bar shape, which means that its configuration is given by a single body. It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated around two or more axes of rotation which are preferably not parallel). Also, the present invention makes it possible for radically new form factors, such as for example devices made of elastic, stretchable and/or foldable materials.

For a wireless handheld or portable device which is slim and/or whose configuration comprises two or more bodies, the requirements on maximum height of the antenna element are very stringent, as the maximum thickness of each of the two or more bodies of the device may be limited to 5, 6, 7, 8 or 9 mm. The technology disclosed herein makes it possible for a wireless handheld or portable device to feature an enhanced MIMO radioelectric performance by means the integration of radiation boosters instead of one or more antenna elements for providing MIMO capabilities, thus solving the space constraint problems associated to such devices.

In the context of the present document a wireless handheld or portable device is considered to be slim if it has a thickness of less than 14 mm, but preferably less than 13 mm, 12 mm, 11 mm, 10 mm, 9 mm or 8 mm.

According to the present invention, an antennaless wireless handheld or portable device advantageously comprises at least five functional blocks: a user interface module, a processing module, a memory module, a communication module and a power management module. The user interface module comprises a display, such as for instance a high resolution LCD, OLED or equivalent, which is an energy consuming module, most of the energy drain coming typically from the backlight use. The user interface module may also comprise for instance a keypad and/or a touchscreen, and/or an embedded stylus pen. The processing module comprises for instance a microprocessor or a CPU, and the associated memory module, which are also sources of significant power consumption. The fourth module responsible of energy consumption is the communication module, an essential part of which is the radiating system. The power management module of the antennaless wireless handheld or portable device includes a source of energy (such as for instance, but not limited to, a battery or a fuel cell) and a power management circuit that manages the energy of the device.

In accordance with the present invention, the communication module of the antennaless wireless handheld or portable device capable of multiband MIMO operation includes at least one MIMO system. A MIMO system according to the present invention comprises a radiating system including a radiating structure comprising a ground plane, a radiation booster, and an internal port. The radiating system further comprises an external port, and a radiofrequency system including a first port and a second port. The MIMO system further includes a MIMO module, a MIMO internal port and a MIMO external port.

The radiating system and the MIMO module are two main blocks of a MIMO system. The radiating system is in charge of transmitting and receiving electromagnetic waves carrying information signals, whereas the MIMO module is in charge of both processing signals received by two or more radiating systems, and signals generated by a base band processor which are then transmitted by at least one radiating system. An external port of a radiating system is used to connect said radiating system to a MIMO internal port of a MIMO module, that is, the MIMO module has as many internal ports as there are radiating systems in the MIMO system. The external port of the MIMO module is connected to a base band processor which is in charge of generating an information signal.

A radiating system comprises at least one radiating structure. In some embodiments said radiating system further comprises a radiofrequency system and an external port for connecting the radiating system to the MIMO internal port of the MIMO module. According to the present invention, at least one radiating structure includes at least one radiation booster and a ground plane. In some embodiments a radiating structure comprises an antenna element. A radiation booster excites a radiation mode or modes on a ground plane that induce radiating currents on said ground plane. The radiating structure including said radiation booster is connected to a radiofrequency system through its internal port. In some embodiments said radiofrequency system modifies the input impedance of said radiating structure, for instance for the purpose of impedance matching, for the purpose of broad banding or a combination of both. In some embodiments the radiofrequency system combines or splits the currents from one or more radiation modes excited by two or more radiation boosters. In some other embodiments the radiofrequency system contributes to reduce the correlation between the signals transmitted or received by two or more radiating systems. In further embodiments the radiofrequency system of a particular radiating system is intended for providing both effects, impedance matching in at least a frequency band and low correlation between radiofrequency signals transmitted or received by said particular radiating systems and the radiofrequency signals transmitted or received by other radiating systems.

In the present document, a radiation mode of a ground plane refers to a radiating current distribution on said ground plane that follows a predominant direction. In some cases, the predominant direction is the direction of the longest side of the ground plane. A radiating current distribution determines the efficiency and the radiation pattern of a radiating structure. According to the present invention, a ground plane size of a MIMO enabled wireless handheld or portable device is comparable to or larger than an operating free-space wavelength, such that said currents may radiate effectively when they are excited by a radiation booster. Radiation from a ground plane in the present invention enables using multiple electromagnetically small elements in the form of radiation boosters which by themselves would not radiate efficiently since they are much smaller than an operating free-space wavelength, i.e. the radiation boosters by themselves feature an extremely poor stand-alone radioelectric behavior. The location and the type of a radiation booster are advantageously designed in the present invention to achieve both good radiation efficiency and also low correlation among the multiple signals transmitted or received by two or more radiating systems.

A MIMO system according to an embodiment of the present invention comprises at least two radiating systems capable of transmitting and receiving electromagnetic wave signals in at least two frequency bands of the electromagnetic spectrum: a first frequency band and a second frequency band, wherein preferably the central frequency of the first frequency band is lower than the central frequency of the second frequency band. Each one of said two or more radiating systems include a radiating structure comprising: at least one ground plane, said at least one ground plane including at least one connection point; at least one radiation booster to couple electromagnetic energy from/to the at least one ground plane, such radiation booster including at least one connection point; and at least one internal port. Said internal port is defined between a connection point of said radiation booster and one of the at least one connection point of the at least one ground plane. Although the ground planes of different radiating systems may be implemented for instance by means of different conducting structures, in some preferred embodiments two or more radiating systems share the same conducting structure for the ground plane. For instance, a wireless handheld or portable device, namely a mobile phone or a handset according to the present invention embeds a plurality of radiating systems including one or more radiation boosters that share the same ground plane in the form of a ground plane layer within a printed circuit board (PCB). Said two or more radiating systems further comprises each one a radiofrequency system and an external port. A MIMO system further comprises a MIMO module including at least two MIMO internal ports and a MIMO external port. Each radiating system includes an external port for connecting the radiating system to the internal port of the MIMO module. In this sense, the two external ports associated to the at least two radiating systems are connected each one to a different internal port of the at least two internal ports of the MIMO module.

In this document, a port of the radiating structure is referred to as an internal port; while a port of the radiating system is referred to as an external port. In this context, the terms "internal" and "external" when referring to a port are used simply to distinguish a port of the radiating structure from a port of the radiating system, and carry no implication as to whether a port is accessible from the outside or not.

In some embodiments, the radiating system of an antennaless wireless handheld or portable device capable of multiband MIMO operation comprises a radiating structure including: at least one ground plane including at least one connection point; at least two radiation boosters, the/each radiation boosters including a connection point; and at least two internal ports.

A radiofrequency system comprises a port connected to each of the at least one internal ports of the radiating structure (i.e., as many ports as there are internal ports in the radiating structure), and a port connected to the external port of the radiating system. Said radiofrequency system comprises a circuit that modifies the impedance of the radiating structure, providing impedance matching to the radiating system in the at least two frequency bands of operation of the radiating system.

The MIMO module comprises an internal port connected to each of the at least one external ports of the radiating system (i.e., as many internal ports as there are external ports in each radiating system). The 'internal' and 'external' names for the ports of the MIMO module carry no implication as to whether a port is accessible from the outside of said module or not.

In some embodiments, the radiating system is capable of operating in at least two, three, four, five or more frequency bands of the electromagnetic spectrum, said frequency bands allowing the allocation of one or more standards of cellular communications standards, wireless connectivity and/or broadcast services.

In some embodiments, a frequency region of operation (such as for example the first and/or the second frequency region) of a radiating system is preferably one of the following (or contained within one of the following): 470-858 MHz, 698-890 MHz, 746-787 MHz, 824-960 MHz, 1710-2170 MHz, 2.4-2.5 GHz, 3.4-3.6 GHz, 4.9-5.875 GHz, or 3.1-10.6 GHz.

In some embodiments, the radiating structure comprises two, three, four, five, six, or more radiation boosters, each of said radiation boosters including a connection point, and each of said connection points defining, together with a connection point of the at least one ground plane, an internal port of the radiating structure. Therefore, in some embodiments the radiating structure comprises two, three, four, five, six or more radiation boosters, and correspondingly two, three, four, five, six or more internal ports.

In further embodiments, the radiating system comprises a second external port and the radiofrequency system comprises an additional port, said additional port being connected to said second external port. That is, the radiating system features two external ports.

An aspect of the present invention relates to the use of the ground plane of the radiating structure as an efficient radiator to provide an enhanced radioelectric performance in two or more frequency bands of operation of the wireless handheld or portable device, eliminating thus the need of integrating a set of antenna elements for providing MIMO capabilities. Different radiation modes of the ground plane can be advantageously excited when, according to the present invention a longest dimension of said ground plane is at least one tenth of the lowest free-space operating wavelength, preferably at least one fifth of the lowest free-space operating wavelength.

A ground plane rectangle is defined as being the minimum-sized rectangle that encompasses a ground plane of the radiating structure. That is, the ground plane rectangle is a rectangle whose sides are tangent to at least one point of said ground plane. The ground plane rectangle has two longer sides and two shorter sides (in some particular examples such ground plane rectangle is a ground plane square), and the ground plane rectangle further has a length and a width, the length of the ground plane rectangle being the length of the longer side of the ground plane rectangle, and the width of the ground plane rectangle being the length of the shorter side of the ground plane rectangle. In the present document, reference is sometimes made to a position "close to" a position, such as a corner or the middle of a side or edge, of the ground plane. In the context of the present document, "close to" means close in relation to the dimensions of the ground plane rectangle. Preferably, "close to" means at a distance of less than ¼ of the width of the ground plane rectangle, more preferably less than $1/6$, $1/8$, $1/10$, $1/12$ or even $1/15$ or $1/20$ of the width of the ground plane rectangle.

In some cases, the ratio between a side of the ground plane rectangle, preferably a long side of the ground plane rectangle, and the free-space wavelength corresponding to the lowest frequency of the first frequency band of operation is advantageously larger than a minimum ratio. Some possible minimum ratios are 0.1, 0.16, 0.2, 0.3, 0.4, 0.5, 0.6, 0.8, 1, 1.2, and 1.4. Said ratio may additionally be smaller than a maximum ratio (i.e., said ratio may be larger than a minimum ratio but smaller than a maximum ratio). Some possible maximum ratios are 0.4, 0.5, 0.6, 0.6, 1.2, 1.4, 1.6, 2, 3, 4, 5, 6, 7 and 10.

Setting a dimension of the ground plane rectangle, preferably the length of its longest side, relative to said free-space wavelength within these ranges makes it possible for the ground plane to support one, two, three or more efficient radiation modes.

Furthermore, in some situations, the location of at least two radiation boosters, especially radiation boosters of radiating systems arranged for radiation within a common frequency band, may be advantageously designed according to the present invention in order to excite at least two substantially orthogonal radiation modes within the ground plane which is preferable to provide low correlation in a MIMO system.

In the context of this application, two radiation modes are considered to be substantially orthogonal if they form an angle in the range from approximately 60 degrees to approximately 120 degrees, approximately 70 degrees to approximately 110 degrees or approximately 80 degrees to approximately 100 degrees.

In the context of this application, two radiation modes are considered to be substantially parallel if they form an angle of less than, or equal to, approximately 30, approximately 20 or approximately 10 degrees.

Additionally, when two radiation modes are substantially orthogonal, the angle between each polarization is also substantially orthogonal. In this sense, two radiation modes can also be considered substantially orthogonal if the polarization of each radiated field form an angle in the range from approximately 60 to approximately 120 degrees, approximately 70 degrees to approximately 110 degrees or approximately 80 degrees to approximately 100 degrees.

Another preferred embodiment excites the same radiation mode but the radiation boosters present opposite reactive behavior (inductive and capacitive), which becomes preferable in order to provide the required MIMO low correlation paths. A radiating structure capable of coupling capacitive electromagnetic energy is defined as that radiating structure that features an input impedance having a capacitive reactance for the frequencies of at least one frequency band of operation when the radiofrequency system is disconnected, said input impedance being measured at the internal port associated to said radiation booster. In the present document, this kind of radiating structure is sometimes also referred to as a radiating structure with capacitive character. A radiation booster of such a radiating structure is sometimes referred to as a capacitive radiation booster. Analogously, a radiating structure capable of coupling inductive electromagnetic energy is defined as that radiating structure that features an input impedance having a an inductive reactance for the frequencies of at least one frequency band of operation when the radiofrequency system is disconnected, said input impedance being measured at the internal port associated to said radiation booster. In the present document, this kind of radiating structure is sometimes also referred to as a radiating structure with inductive character. A radiation booster of such a radiating structure is sometimes referred to as an inductive radiation booster.

The combination of radiating systems including radiating structures featuring opposite characters (inductive and capacitive) becomes preferable for providing low correlation in the frequency bands that these radiating systems have in common.

In another preferred embodiment the mutual coupling between ports is reduced by the integration of at least two radiating systems where at least one of the radiating systems comprises at least two radiation boosters and the other one at least one antenna element. The radiating system comprising at least two radiation boosters and the radiating system comprising the at least one antenna element further comprise a transmission line to improve the bandwidth of at least one of the radiating systems, to reduce the mutual coupling between said radiating systems or a combination of both effects. In some embodiments the length of said transmission line is not larger than 40 mm, 60 mm, 80 mm, 100 mm, 125 mm, 150 mm, 175 mm, 200 mm, 250 mm, 300 mm, and 400 mm.

The realized gain of a radiating system depends on factors such as its directivity, its radiation efficiency and its input return loss. Both the radiation efficiency and the input return loss of the radiating system are frequency dependent (even directivity is strictly frequency dependent). A radiating system is usually very efficient around the frequency of a radiation mode excited in the ground plane and maintains a similar radioelectric performance within the frequency range defined by its impedance bandwidth around said frequency.

A wireless handheld or portable device generally comprises one, two, three or more printed circuit boards (PCBs) on which to carry the electronics. In a preferred embodiment of an antennaless wireless handheld or portable device capable of MIMO operation, a ground plane of the radiating structure comprised in the MIMO system is at least partially, or completely, contained in at least a layer of a PCB. Preferably, said ground plane is a common ground plane layer for all the radiating systems comprised in the MIMO system.

In some cases, a MIMO wireless handheld or portable device may comprise two, three, four or more ground plane. For example a clamshell, flip-type, swivel-type or slider-type wireless device may advantageously comprise two PCBs, each one including a ground plane.

In some examples, the at least one radiation boosters has a maximum size smaller than $1/30$, $1/40$, $1/50$, $1/60$, $1/80$, $1/100$, $1/140$ or even $1/180$ times the free-space wavelength corresponding to the lowest frequency of the first frequency band of operation provided by the radiating system including said radiation booster.

In some further examples, at least one (such as for instance, one, two, three or more) radiation booster has a maximum size smaller than $1/30$, $1/40$, $1/50$, $1/60$, $1/80$, $1/100$, $1/140$ or even $1/180$ times the free-space wavelength corresponding to the lowest frequency of the second frequency band of operation provided by the radiating system including said at least one radiation booster.

At least one of the radiation boosters of a MIMO system according to the present invention has a maximum size at least smaller than $1/30$, preferably $1/50$, of the free-space wavelength corresponding to the lowest frequency of the first frequency band of operation. That is, the/each radiation booster fits in an imaginary sphere having a diameter smaller than $1/4$, or preferably smaller than $1/6$ of the diameter of a radiansphere at said same operating wavelength.

Setting the dimensions of said radiation booster or boosters to be below some certain maximum value is advantageous in order to allow a suitable transfer of energy to the radiation mode or radiation modes of the ground plane while minimizing the volume occupied in the PCB; the space required by the booster is far less than the space that would have been occupied by an antenna element arranged to radiate in the corresponding frequency band. The radiation booster substantially behaves as a non-radiating element for all the frequencies of the first frequency band. Therefore, the person skilled in the art could not possibly regard the/each radiation booster as being an antenna element. Thus, the radiation is mainly provided by the radiation mode or radiation modes excited on the ground plane by said radiation booster.

Furthermore, in some of these examples, at least one, two, or three radiation boosters have a maximum size larger than 1/1400, 1/700, 1/350, 1/175, 1/120, or 1/90 times the free-space wavelength corresponding to the lowest frequency of the second frequency band of operation of the antennaless wireless handheld or portable device.

Setting the dimensions of a radiation booster to be above some certain minimum value is advantageous to obtain a higher level of the real part of the input impedance of the radiating structure (measured at the internal port of the radiating structure associated to said radiation booster when disconnected from the radiofrequency system) enhancing, in this way, the transfer of energy between said radiation booster and the ground plane.

In a preferred example, the radiating structure features at the/each internal port, when disconnected from the radiofrequency system, a first resonant frequency located above (i.e., higher than) the first frequency band of operation of the radiating system.

In the context of this document, a resonant frequency associated to an internal port of the radiating structure preferably refers to a frequency at which the input impedance measured at said internal port of the radiating structure, when disconnected from the radiofrequency system, has an imaginary part equal to zero.

Being said radiation booster so small, and with the radiating structure including said radiation booster or boosters operating in a frequency band much lower than the first resonant frequency at the/each internal port associated to the/each radiation booster, the input impedance of the radiating structure (measured at the/each internal port when the radiofrequency system is disconnected) features an important reactive component (either capacitive or inductive) within the range of frequencies of the first and/or second frequency band of operation. That is, the input impedance of the radiating structure at the/each internal port when disconnected from the radiofrequency system has an imaginary part not equal to zero for any frequency of the first and/or second frequency band.

In some embodiments, the first resonant frequency at an internal port is at the same time located below (i.e., at a frequency lower than) a second frequency band of operation of the radiating system. Hence, the first resonant frequency at said internal port is located above the first frequency band but below the second frequency band.

In yet another preferred embodiment, a radiating structure includes a first radiation booster comprising a conductive part and a second radiation booster comprising a non-conductive gap defined in the ground plane. Such an embodiment may be particularly advantageous in some cases to excite radiation modes on the ground plane having substantially orthogonal polarizations or an increased level of isolation.

In one embodiment, a radiation booster is located preferably substantially close to a short side of the ground plane rectangle, and more preferably substantially close to an end of said short side. In other embodiments, said radiation boosters are placed substantially close to the middle point of said short side. Such a placement for a radiation booster with respect to the ground plane is particularly advantageous when the radiating structure features an input impedance having a capacitive component for the frequencies of the first and second frequency bands of operation, said impedance measured at the internal port associated to said radiation booster when the radiofrequency system is disconnected.

In another embodiment, a radiation booster is located preferably substantially close to a long side of the ground plane rectangle, and more preferably substantially close to an end of said long side or to the middle point of said long side. Such a placement for a radiation booster is particularly advantageous when the radiating structure features at the internal port associated to said radiation booster, an input impedance having an inductive component for the frequencies of said first and second frequency bands when the radiofrequency system is disconnected.

In some embodiments, a radiating structure for a radiating system of a MIMO wireless handheld or portable device comprises a first radiation booster, a second radiation booster and a ground plane. The radiating structure therefore comprises two internal ports: a first internal port being defined between a connection point of the first radiation booster and the at least one connection point of the ground plane; and a second internal port being defined between a connection point of the second radiation booster and said at least one connection point of the ground plane.

In an advantageous embodiment, the first radiation booster is substantially close to a first corner of the ground plane and the second radiation booster is substantially close to a second corner of the ground plane (said second corner not being the same as said first corner). Such a placement of the radiation boosters may be particularly interesting when it is necessary to achieve higher isolation between the two internal ports of the radiating structure.

In another advantageous embodiment, and in order to facilitate the interconnection of the radiation boosters to the radiofrequency system, said first and second radiation booster are substantially close to a first corner of the ground plane, the first corner being preferably in common with a corner of the ground plane rectangle. In this example, preferably, the first and the second radiation boosters are such that the first internal port, when the radiofrequency system is disconnected, features an input impedance having an inductive component for the frequencies of the first and second frequency bands, and the second internal port, also when the radiofrequency system is disconnected, features an input impedance having a capacitive component for the frequencies of the first and second frequency bands.

In yet another advantageous embodiment, the first radiation booster is located substantially close to a short edge of the ground plane and the second radiation booster is located substantially close to a long edge of the ground plane. Preferably, said short edge and said long edge are in common with a short side and a long side respectively of the ground plane rectangle and meet at a corner. Such a choice of the placement of the first and second radiation boosters may be particularly advantageous to excite radiation modes on the ground plane having substantially orthogonal polarizations and/or to achieve an increased level of isolation and correlation between the two internal ports of the radiating structure.

In some embodiments, the radiofrequency system comprises at least one matching network (such as for instance, one, two, three, four or more matching networks) to transform the input impedance of the radiating structure, providing impedance matching to the radiating system in at least one frequency band of operation of the radiating system.

In a preferred example, the radiofrequency system comprises as many matching networks as there are radiation boosters (and, consequently, internal ports) in the radiating structure.

In further embodiments, the radiofrequency system of a particular radiating system comprises a electric circuit capable of improving the isolation between the internal port of the radiating structures associated to said particular radiating system and other internal ports corresponding to other radiating systems including other radiating structures.

A stage for a matching network comprises one or more circuit components (such as for example but not limited to inductors, capacitors, resistors, jumpers, short-circuits, switches, delay lines, resonators, or other reactive or resistive components). In some cases, a stage has a substantially inductive behavior in the frequency bands of operation of the radiating system, while another stage has a substantially capacitive behavior in said frequency bands, and yet a third one may have a substantially resistive behavior in said frequency bands.

A matching network can comprise a single stage or a plurality of stages. In some embodiments, said matching network comprises at least two, at least three, at least four, at least five, at least six, at least seven, at least eight or more stages.

A stage can be connected in series or in parallel to other stages and/or to one of the at least one port of the radiofrequency system.

In some examples, the at least one matching network alternates stages connected in series (i.e., cascaded) with stages connected in parallel (i.e., shunted) forming a ladder structure. In some cases, a matching network comprising two stages forms an L-shaped structure (i.e., series-parallel or parallel-series). In some other cases, a matching network comprising three stages forms either a pi-shaped structure (i.e., parallel-series-parallel) or a T-shaped structure (i.e., series-parallel-series).

In some examples, the at least one matching network alternates stages having a substantially inductive behavior, with stages having a substantially capacitive behavior.

In some embodiments, at least some circuit components in the stages of the at least one matching network are discrete lumped components (such as for instance SMT components), while in some other examples all the circuit components of the at least one matching network are discrete lumped components. In some examples, at least some circuit components in the stages of the at least one matching network are distributed components (such as for instance a transmission line printed or embedded in a PCB containing the ground plane of the radiating structure), while in some other examples all the circuit components of the at least one matching network are distributed components.

In an example, the radiofrequency system comprises a first diplexer to separate the electrical signals of a first and a second frequency band of operation of the radiating system, a first matching network to provide impedance matching in said first frequency band, a second matching network to provide impedance matching in said second frequency band, and a second diplexer to recombine the electrical signals of said first and second frequency bands.

In some examples, the radiating system does not require a radiofrequency system. This is the case of radiating systems including radiating structures comprising antenna elements since an antenna element does not always need a radiofrequency system. For example, a MIMO system may comprise a radiating system including a radiating structure comprising a PIFA antenna. In this example, the PIFA antenna may be matched without any radiofrequency system since its geometry may be designed in such a way that the input impedance is properly matched.

In a preferred embodiment a MIMO system comprises at least two radiating systems capable of transmitting and receiving electromagnetic wave signals in at least two frequency bands of the electromagnetic spectrum: a first frequency band and a second frequency band, wherein preferably the central frequency of the first frequency bands is lower than the central frequency of the second frequency band. Each one of said radiating systems comprise a radiating structure comprising: at least one ground plane capable of supporting at least one radiation mode, the at least one ground plane including at least one connection point; at least one radiation booster to couple electromagnetic energy from/to the at least one ground plane, the/each radiation booster including a connection point; and at least one internal port. The/each internal port is defined between the connection point of the/each radiation booster and one of the at least one connection points of the at least one ground plane. The radiating system further comprises a radiofrequency system, and an external port. The MIMO system further comprises a MIMO module including at least two internal ports and a MIMO external port. The external port of the at least one radiating system is connected to the at least one of the internal ports of the MIMO module.

In yet another preferred embodiment a MIMO system comprises at least two radiating systems capable of transmitting and receiving electromagnetic wave signals in at least two frequency bands of the electromagnetic spectrum: a first frequency band and a second frequency band, wherein preferably the central frequency of the first frequency band is lower than the central frequency of the second frequency band. The first radiating system comprises a radiating structure comprising: at least one ground plane capable of supporting at least one radiation mode, the at least one ground plane including at least one connection point; at least one antenna element including a connection point; and at least one internal port. Said internal port is defined between the connection point of said radiation booster and one of the at least one connection points of the at least one ground plane. The radiating system further comprises a radiofrequency system, and an external port. The second radiating system comprises a radiating structure comprising: at least one ground plane capable of supporting at least one radiation mode the at least one ground plane including at least one connection point; at least one radiation booster to couple electromagnetic energy from/to the at least one ground plane, the/each radiation booster including a connection point; and at least one internal port. The/each internal port is defined between the connection point of the/each radiation booster and one of the at least one connection points of the at least one ground plane. The radiating system further comprises a radiofrequency system, and an external port. The MIMO system further comprises a MIMO module including at least two internal ports and a MIMO external port. The external port of the at least one radiating system is connected to the at least one of the internal ports of the MIMO module.

In some preferred embodiments at least one slot is advantageously introduced in the common ground plane of each radiating structure in order to improve the correlation values.

One aspect of the present invention relates to a wireless handheld or portable device capable of multiband MIMO operation comprising a communication module including at least one MIMO system, wherein said at least one MIMO system comprises:

at least two radiating systems capable of transmitting and receiving electromagnetic wave signals, wherein at least two of said radiating systems are capable of transmitting and receiving electromagnetic wave signals in at least a first frequency band, wherein at least two of said radiating systems are capable of transmitting and receiving electromagnetic wave signals in at least a second frequency band (that is, the MIMO system can for example comprise four radiating systems, two assigned to the first frequency band and two assigned to the second frequency band, or two radiating systems each assigned to handle both the first and the second frequency band, or three radiating systems a first one of which is assigned both to the first and the second frequency bands, a second one of which is assigned to handle the first frequency band, and the third one of which is assigned to handle the second frequency band, etc.; one or more of the radiating systems can further be capable of receiving and transmitting on further frequency bands, when referring to the capability of transmitting and receiving electromagnetic wave signals in a frequency band, reference is made to reception and transmission with an acceptable radioelectric performance in accordance with the applicable standards, examples of which are mentioned in the present description); and a MIMO module arranged for processing the electromagnetic wave signals transmitted and received by said at least two radiating systems;

wherein said MIMO module includes at least two MIMO internal ports;

wherein each one of said radiating systems comprises at least one external port connected to a respective one of said MIMO internal ports;

wherein at least one of said radiating systems includes a radiating structure comprising:

a ground plane capable of supporting at least one radiation mode, said ground plane including a connection point;

a radiation booster arranged to couple electromagnetic energy from/to said ground plane, said radiation booster including a connection point;

and an internal port, the internal port being defined between the connection point of the radiation booster and the connection point of the ground plane;

wherein said at least one of said at least two radiating systems further comprises a radiofrequency system, said radiofrequency system comprising:

a port connected to a corresponding external port of said radiating system, and a port connected to said internal port of said radiating structure;

wherein the input impedance of said radiating structure measured at its internal port when disconnected from the radiofrequency system has an imaginary part not equal to zero for any frequency of at least one of (for example, for one, two, three, or all of) the frequency bands of operation associated to said internal port (the term "frequency bands of operation associated to said internal port" refer to the frequency bands of operation provided by the radiating system when said internal port is connected to said radiofrequency system, and wherein the radiating system would not be able to operate with a similar radioelectric performance in the absence of said radiofrequency system), said at least one of the frequency bands of operation including (or being) said first and/or said second frequency band;

wherein said radiofrequency system is arranged to modify the impedance of said radiating structure for operating in said at least one of the frequency bands of operation associated to said internal port (that is, for operating also in the frequency band or bands of operation for which the input impedance of the radiating structure, measured at its internal port when disconnected from the radiofrequency system, has an imaginary part not equal to zero for any frequency of the band) (thus, said imaginary part of the input impedance not equal to cero for any frequency of a frequency band as indicated above, can be brought to cero or close to cero for at least one or more frequencies of said frequency band, by said radiofrequency system, so as to allow for acceptable operation within said frequency band);

and wherein said radiation booster has a maximum size of less than 1/30 (or even less, such as less than 1/40, 1/50, 1/60, 1/80, 1/100, 1/140 or 1/180) of the free-space operating wavelength of the lowest frequency band of operation associated to said internal port.

The term "frequency band of operation associated to said internal port" refers to the frequency bands within which the corresponding radiating system operates when the device is in operation, and wherein which it would not be able to operate with a similar radioelectric performance in the absence of said radiating structure at said internal port.

As extensively explained in the above-mentioned application Publication No. WO2010/015364, by using a radiation booster together with this kind of radio frequency system, it can be possible to use the ground plane as a radiating element for transmitting and receiving electromagnetic wave signals, thus allowing for antenna-less operation. However, multiband MIMO operation requires the use of two or more radiating systems simultaneously operating in two or more frequency bands. Thus, it could appear to the person skilled in that art that it would be non-appropriate to use the technology of WO2010/015364 for MIMO operation, as the use of the ground-plane as the substantial radiating element would appear to give rise to problems due to coupling. However, it has been found that contrarily to what could be believed, it is indeed possible to arrange the radiating systems so as to reduce the coupling to acceptable levels, compatible with MIMO operation. The present application describes a large number of embodiments which allow this to be achieved, and further embodiments can be easily conceived by the skilled person on the basis of the teachings of the present document.

Some embodiments of the device can further feature the following characteristics:

The first and the second frequency bands can, for example, be within the 600 MHz to 3600 MHz frequency range.

At least two of said radiating systems can comprise a radiating structure including a radiation booster, one of said radiation boosters being a capacitive radiation booster in at least one of the first and the second frequency band and another one of said radiation boosters being an inductive radiation booster in at least one of the first and the second frequency band. Thus, by using both inductive and capacitive radiating structures, such as booster based radiating structures, the number of radiating structures operating in the same frequency band can be increased while keeping the radiating structures sufficiently uncoupled to allow a reasonable quality MIMO operation, even if both radiating structures are based on radiation boosters sharing and using the same ground plane as the radiating element.

The capacitive radiation booster can be placed closer to a corner of the ground plane or ground plane rectangle, and the inductive radiation booster can be placed further away from the corners of said ground plane or ground plane rectangle. This positioning has been found to be helpful to achieve appropriate excitation of the corresponding radiation modes. For instance, for properly exciting the longitudinal radiation mode, the capacitive radiation booster could be placed near the corner of the ground plane where the minimum current distribution of the corresponding longitudinal radiation mode takes place while the inductive radiation booster could be placed near the center of the longest edge of the ground plane where the maximum current distribution of the corresponding longitudinal radiation mode appears.

The wireless device can include, for radiation in at least one frequency band, a radiating structure comprising a radiation booster having a conductive part, and a radiating structure comprising a radiation booster comprising a non-conductive gap defined in the ground plane. The radiation booster comprising the conductive part, such as a conductive sheet or cube, can feature a capacitive character, and the radiation booster comprising the non-conductive gap can feature an inductive character. This helps to decouple the radiation of these two boosters, and thus enhances MIMO operation at the corresponding frequency band or bands.

At least two of the radiating systems can be arranged for providing operation in the same frequency band, wherein two of said at least two radiating systems can be arranged to excite two substantially orthogonal radiation modes within the ground plane. In this way, coupling between the radiating systems can be reduced. For example, the radiating systems can be arranged to excite two different radiation modes corresponding to two different current distributions following substantially orthogonal paths, for instance one of the radiation modes can extend in a direction substantially parallel to the short side of the ground plane or ground plane rectangle, whereas the other radiation mode can extend in a direction substantially parallel to the long side of the ground plane or the ground plane rectangle.

The wireless device can comprise at least one capacitive radiation booster located close to a corner of the ground plane or of the ground plane rectangle. In the present document, when referring to the position of a radiation booster, reference is preferably made to the position of the connection point of said radiation booster. Placing a capacitive radiation booster close to a corner can serve to enhance radiation efficiency since the longitudinal radiation mode is better excited. The wireless device can comprise a plurality of capacitive radiation boosters located close to a plurality of corners of said ground plane or ground plane rectangle. For example, a capacitive radiation booster can be located close to two, three or four of said corners.

The wireless device can comprise at least one inductive radiation booster located close to a center point of one of the longer sides of the ground plane or ground plane rectangle. This position has been found to enhance radiation efficiency; as mentioned above, by combining inductive and capacitive systems, improved decoupling of the corresponding radiating systems is achieved, which is beneficial for MIMO operation. For example the wireless device can comprise at least two inductive radiation boosters, one of which is located close to a center point of one of the longer sides of the ground plane or ground plane rectangle, and the other one of which is located close to a center point of the other one of the longer sides of the ground plane or ground plane rectangle.

The wireless device can comprise at least one capacitive radiation booster and at least one inductive radiation booster located at the same side of the ground plane or ground plane rectangle, the capacitive radiation booster being placed closer to a corner of said ground plane or ground plane rectangle than the inductive radiation booster. This arrangement can help to achieve increased compactness of the device and of the MIMO system. Usually, to achieve low correlation, antenna elements need to be placed far from each other. For this capacitive-inductive radiation booster configuration, low correlation can be achieved within in a small space which is advantageous for integration purposes, i.e., connecting lines between boosters are minimized.

The ground plane can include at least one slot, said slot preferably having a length of at least ⅕ of the length of a shorter side of the ground-plane rectangle. The slot can be arranged to improve de-coupling between radiating structures, and also to modify the radiation modes excited in the ground plane, and/or to improve the impedance bandwidth. At least a part of at least one such slot can make up at least part of an inductive radiation booster of one of said radiating structures, or make up at least part of an antenna element.

The wireless device can include at least one capacitive radiation booster having a substantially flat shape (that is, a substantially 2-dimensional configuration), said radiation booster being substantially coplanar with the corresponding ground plane. The flat shape of the radiation booster can be helpful to facilitate integration of the radiating system into, for example, ultra-slim devices.

The ground-plane can include at least one gap in its periphery, at least one radiation booster being placed at least partly in or above said gap. In this way, by providing gaps, the radiation boosters such as capacitive radiation boosters can be placed over a non-conductive part of the ground plane rectangle, but still within the limits of the ground plane rectangle, which can facilitate design of the device and integration of the ground-plane, with the radiating structures, into the device.

At least one radiation booster can be placed above at least another radiation booster, in a vertical direction when said ground plane is in a horizontal plane, so that the orthogonal projection of one of said radiation boosters on said horizontal plane overlaps at least in part (such as, for example, by more than 50%, 60%, 75% or 90%) with the orthogonal projection of said another radiation booster on said horizontal plane. This can allow for an fairly compact arrangement of the boosters.

At least one of said at least two radiating systems can comprise an antenna element, wherein the antenna element is selected from a group comprising: a monopole antenna, a patch antenna, an IFA, a PIFA, a slot antenna, and a dielectric antenna.

The at least one radiation booster can have a maximum size smaller than 1/50 of the free-space operating wavelength of the lowest frequency band of operation associated to said internal port.

Each of at least two of said radiating systems can be capable of transmitting and receiving electromagnetic wave signals in at least two frequency bands, said at least two frequency bands of operation including said first and/or said second frequency band (that is, at least two of said radiating systems can be at least dual-band radiating systems, operative in at least two frequency bands which include said first and/or said second frequency band).

The ground plane can be at least partially contained in at least a layer of a PCB. Said ground plane can, for example, be a common ground plane layer for all the radiating systems comprised in the MIMO system.

At least one ground plane of at least one radiating structure having a radiation booster can be provided with a plurality of gaps in correspondence with a periphery of said ground plane. Providing this kind of gaps in the periphery of the ground-plane, for example, in correspondence with the longer sides thereof and optionally also in correspondence with the shorter sides thereof, increases flexibility as it allows for easy insertion of boosters in said gaps. Thus, one "standard" ground-plane can be used for a large variety of products, without any need to substantially customize the design of the ground-plane for the specific device and for the specific layout of the radiating systems of the device. A number of gaps N=6 can be a suitable minimum value of the number of gaps, but it can be preferred to have an even larger number of gaps, such as 8, 10, 15, or more.

At least one radiating structure can comprise at least two radiation boosters connected to a common radiofrequency system for providing at least triple band operation.

The radiofrequency system can be arranged to provide operation in at least two frequency bands while improving the isolation between at least two radiating systems operating in the same frequency band.

The ratio between the length of a long side of the ground plane rectangle and the free-space wavelength corresponding to the lowest frequency of the lowest frequency band of operation, can, for example, be larger than 0.1.

The MIMO system can, for example, be arranged to provide a MIMO order at least equal to 2 for at least two frequency bands of operation of the wireless handheld or portable device.

BRIEF DESCRIPTION OF THE DRAWINGS

Embodiments of the invention are shown in the enclosed figures. Herein shows.

DETAILED DESCRIPTION

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

Figure 1A:
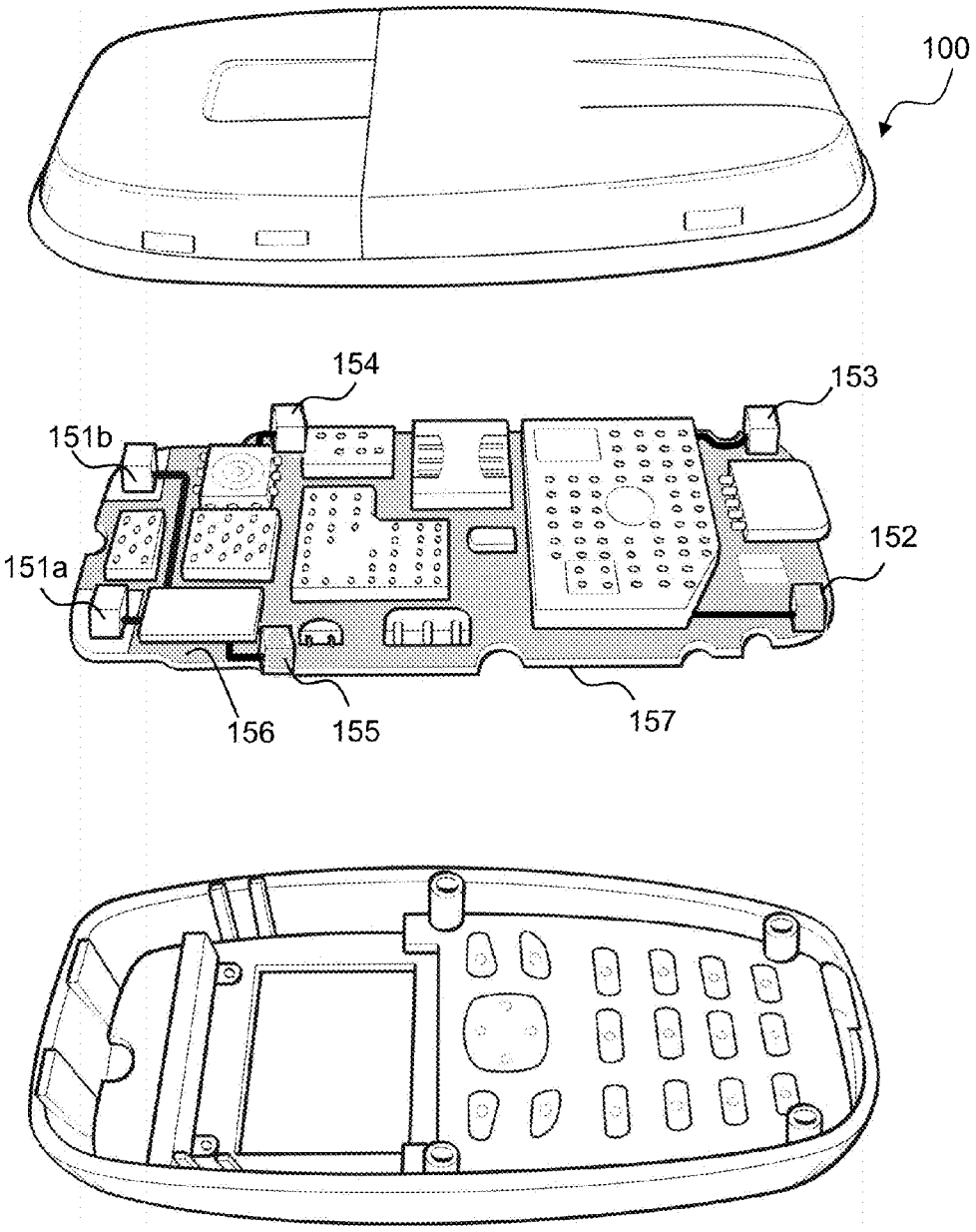
FIG. 1A is an example of an antennaless wireless handheld or portable device including a radiating system according to the present invention.
Figure 1B:
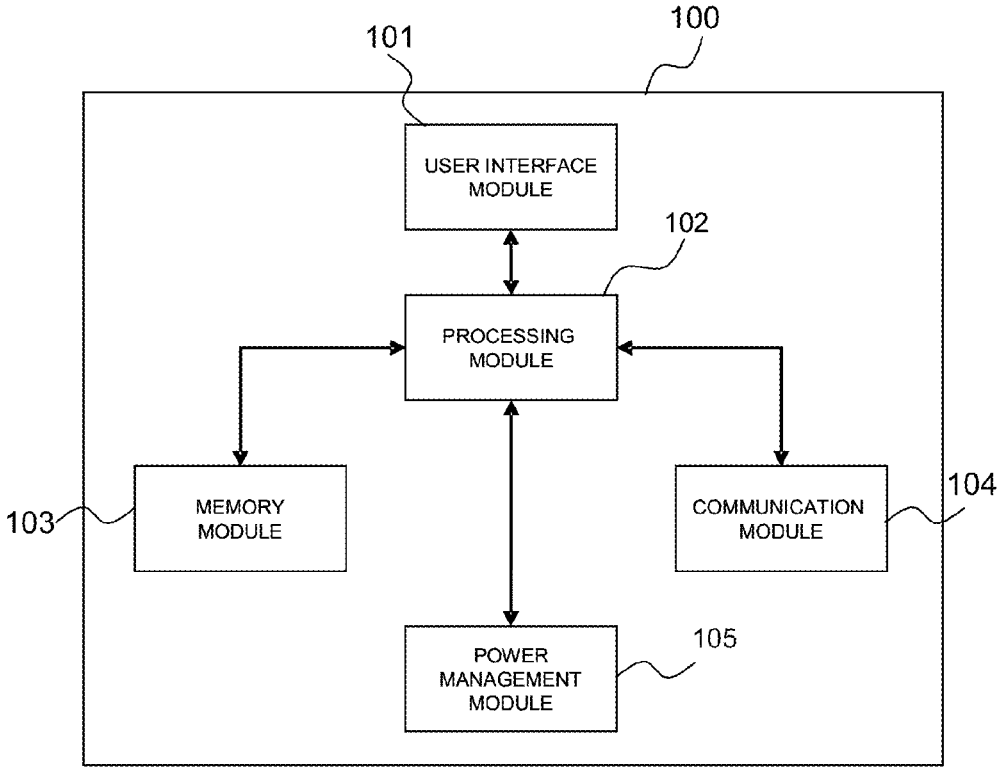
FIG. 1B is a block diagram of an antennaless wireless handheld or portable device illustrating the basic functional blocks thereof.

FIGS. 1A and 1B show an illustrative example of what can be considered to be an antennaless (as it does not include what the person skilled in the art would understand by "antenna") wireless handheld or portable device 100 capable of multiband MIMO operation according to the present invention. In FIG. 1A, there is shown an exploded perspective view of the antennaless wireless handheld or portable device 100 comprising six radiation boosters 151*a*, 151*b*, 152-155, and a ground plane 157 (which could be included in a layer of a multilayer PCB). The antennaless wireless handheld or portable device 100 also comprises a radiofrequency system 156, which can be interconnected with a radiating structure comprising the radiation boosters 151*a*, 151*b*, 155 to form a first radiating system capable of providing operation in multiple frequency bands. At the same time, the radiation boosters 152, 153 can be connected to a second radiofrequency system thus forming a second radiating system also capable of providing operation at multiple frequency bands. Finally, the radiation booster 154 can also be connected to a third radiofrequency system constituting a third radiating system that can be intended for providing operation at a single frequency band or multiple frequency bands.

Other configurations are also possible for a MIMO system according to the present invention. In this sense, each radiation booster can be connected independently to a radiofrequency system in order to attain as many radiating systems capable of multiband operation as there are radiation boosters. In the same way, the radiation boosters can be combined into a single or several radiofrequency systems thus forming as many radiating systems capable of multiband operation as there are radiofrequency systems.

In order to preserve the benefits of a MIMO system, the resulting radiating systems have to operate in a common frequency band, that is, at least two radiating systems should operate in a common frequency band.

Referring now to FIG. 1B, it is shown a block diagram of the antennaless wireless handheld or portable device 100 capable of multiband MIMO operation advantageously comprising, in accordance to the present invention, a user interface module 101, a processing module 102, a memory module 103, a communication module 104 and a power management module 105. In a preferred embodiment, the processing module 102 and the memory module 103 have herein been listed as separate modules. However, in another embodiment, the processing module 102 and the memory module 103 may be separate functionalities within a single module or a plurality of modules. In a further embodiment, two or more of the five functional blocks of the antennaless wireless handheld or portable device 100 may be separate functionalities within a single module or a plurality of modules.

In FIGS. 2A-2D, four schematic representations of MIMO systems are shown for an antennaless wireless handheld or portable device capable of multiband MIMO operation according to the present invention.

Figure 2A:
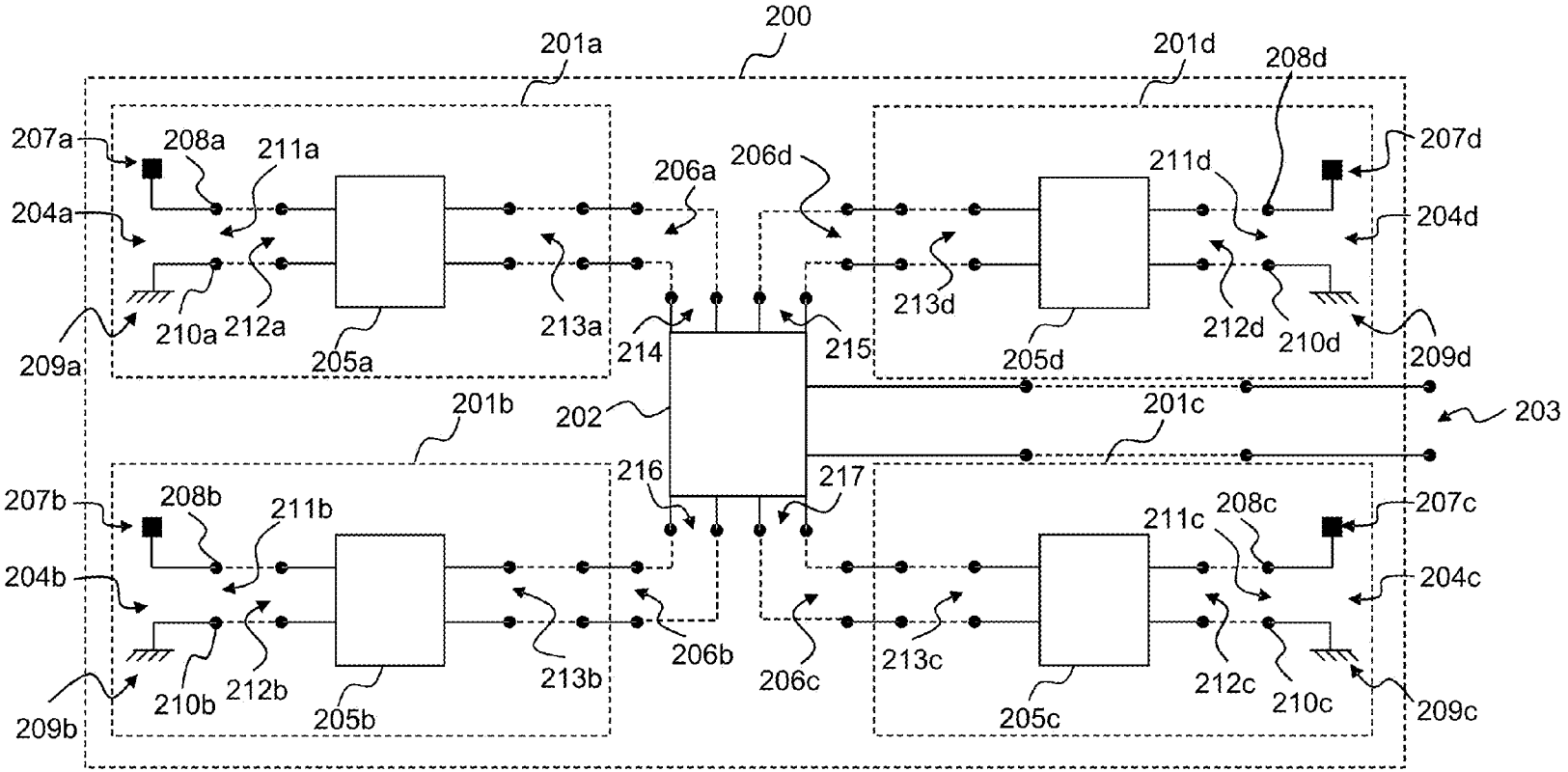
FIG. 2A is a schematic representation of a MIMO system with four radiating systems including each one a radiation booster.

In particular, in FIG. 2A a MIMO system 200 comprises four radiating systems 201*a*, 201*b*, 201*c*, and 201*d*, a MIMO module 202, and a MIMO external port 203 in charge of carrying the information signal. Each radiating system 201*a*, 201*b*, 201*c*, and 201*d* include respectively a radiating structure 204*a*-204*d* comprising respectively, a radiation booster 207*a*-207*d*, a ground plane 209*a*-209*d*, and an internal port 211*a*-211*d* defined between the connection point of the radiation booster 208*a*-208*d* and the connection point of the ground plane 210*a*-210*d*. Each radiating system further comprises respectively a radiofrequency system 205*a*-205*d* comprising a first port 212*a*-212*d* connected to the internal port 211*a*-211*d* of the radiating structure 204*a*-204*d* and a second port 213*a*-213*d* connected to an external port 206*a*-206*d* of the radiating system 201*a*-201*d*. The external ports 206*a*, 206*b*, 206*c*, and 206*d* of the radiating systems 201*a*, 201*b*, 201*c*, and 201*d* are connected to the internal ports 214, 215, 216, and 217 of the MIMO module 202. In particular, the external port 206*a* of the radiating system 201*a* is connected to the internal port 214 of the MIMO module 202. The external port 206*b* of the radiating system 201*b* is connected to the internal port 216 of the MIMO module 202. The external port 206*c* of the radiating system 201*c* is connected to the internal port 217 of the MIMO module 202. And the external port 206*d* of the radiating system 201*d* is connected to the internal port 215 of the MIMO module 202.

Figure 2B:
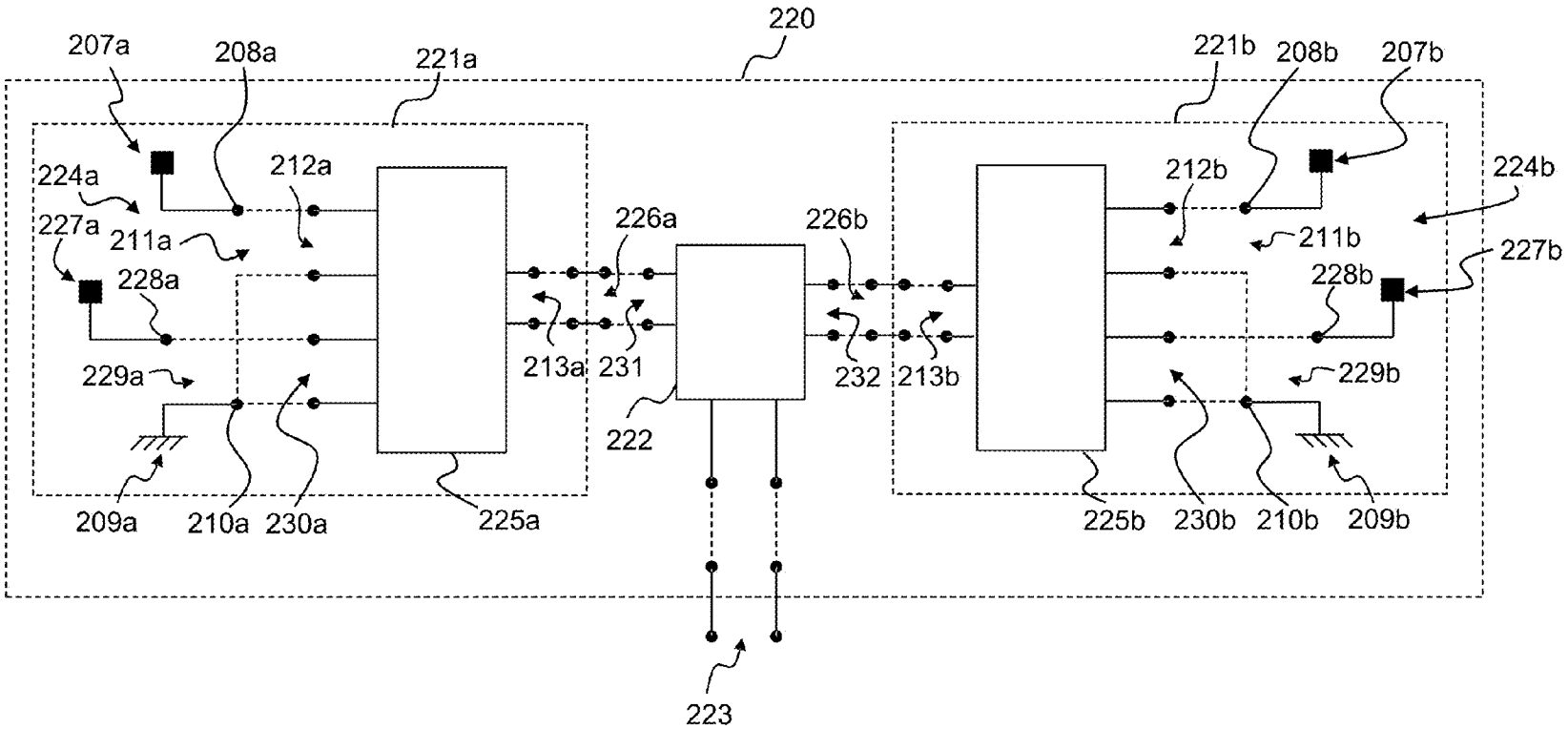
FIG. 2B is a schematic representation of a MIMO system with two radiating systems including each one at least two radiation boosters.

FIG. 2B depicts a further example of a MIMO system 220 comprising two radiating systems 221*a* and 221*b*, a MIMO module 222, and a MIMO external port 223 in charge of carrying the information signal. The external port 226*a* of the radiating system 221*a* is connected to the internal port 231 of the MIMO module 222. The external port 226*b* of the radiating system 221*b* is connected to the internal port 232 of the MIMO module 222.

More specifically each radiating system 221*a* and 221*b* of the MIMO system 220 from FIG. 2B comprises respectively a radiating structure 224*a* and 224*b*. The radiating structure 224*a* includes two radiation boosters 207*a*, 227*a*, a ground plane 209*a*, and two internal ports 211*a*, 229*a*. The first internal port 211*a* is defined between the connection point 208*a* of the radiation booster 207*a* and the connection point 210*a* of the ground plane 209*a*, whereas the second internal port 229*a* is defined between the connection point 228*a* of the radiation booster 227*a* and the same connection point 210*a* of the ground plane 209*a*. The radiating system 221*a* further comprises a radiofrequency system 225*a* including three ports: a first port 212*a* connected to the first internal port 211*a*, a second port 230*a* connected to the second internal port 229*a* and a third port 213*a* connected to the external port 226*a* of the radiating system. In other words, the radiofrequency system 225*a* comprises a port connected to each of the at least one internal ports of the radiating structure 224*a*, and a port connected to the external port 226*a* of the radiating system. In a similar way, the radiating structure 224*b* also includes two radiation boosters 207*b*, 227*b*, a ground plane 209*b*, and two internal ports 211*b*, 229*b*. The first internal port 211*b* is defined between the connection point 208*b* of the radiation booster 207*b* and the connection point 210*b* of the ground plane 209*b*, whereas the second internal port 229*b* is defined between the connection point 228*b* of the radiation booster 227*b* and the same connection point 210*b* of the ground plane 209*b*. The radiating system 221*b* further comprises a radiofrequency system 225*b* including three ports: a first port 212*b* connected to the first internal port 211*b*, a second port 230*b* connected to the second internal port 229*b* and a third port 213*b* connected to the external port 226*b* of the radiating system.

Figure 2C:
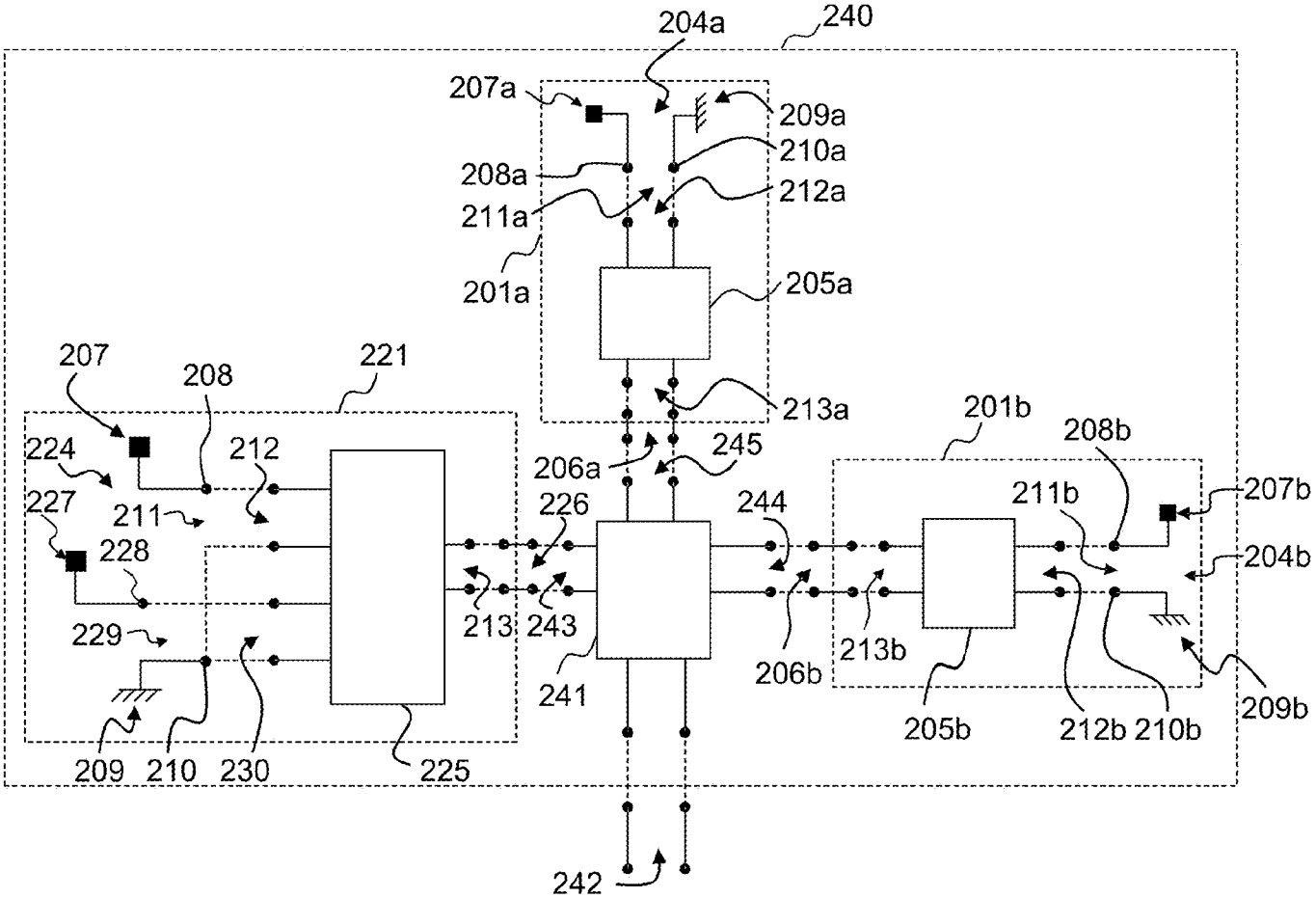
FIG. 2C is a schematic representation of a MIMO system with three radiating systems including one of them at least two radiation boosters and the other radiating systems one radiation booster.

FIG. 2C depicts a further example of a MIMO system 240 comprising three radiating systems 201*a*, 201*b*, and 221, a MIMO module 241, and a MIMO external port 242 in charge of carrying the information signal.

In this case, the radiating system 221 comprises a radiating structure 224 including two radiation boosters 207, 227, a ground plane 209, and two internal ports 211, 229. The first internal port 211 is defined between the connection point 208 of the radiation booster 207 and the connection point 210 of the ground plane 209, whereas the second internal port 229 is defined between the connection point 228 of the radiation booster 227 and the same connection point 210 of the ground plane 209. The radiating system 221 further comprises a radiofrequency system 225 including three ports: a first port 212 connected to the first internal port 211, a second port 230 connected to the second internal port 229 and a third port 213 connected to the external port 226 of the radiating system.

At the same time, the radiating systems 201*a* and 201*b* respectively comprise a radiating structure 204*a*, 204*b* including a radiation booster 207*a*, 207*b*, a ground plane 209*a*, 209*b*, and an internal port 211*a*, 211*b* respectively defined between the connection point 208*a*, 208*b* of the radiation booster and the connection point 210*a*, 210*b* of the ground plane 209*a*, 209*b*. Each one of the radiating systems further comprise a radiofrequency system 205*a*, 205*b* having a first port 212*a*, 212*b* connected respectively to the internal port 211*a*, 211*b* of the radiating structure 204*a*, 204*b* and a second port 213*a*, 213*b* connected to the external port 206*a*, 206*b* of the radiating system.

The external ports 206*a*, 206*b*, 226 of the radiating systems 201*a*, 201*b*, and 221 are connected respectively to the MIMO internal ports 245, 244, 243.

The MIMO system gathered in FIG. 2C may be preferred when the radiating system 221 is used to provide operation in at least two frequency bands, a first frequency band and a second frequency band. In this case, the radiating system 201*a* can be used for providing simultaneous operation in said first frequency band while the system 201*b* can be used for operating simultaneously in said second frequency band.

Figure 2D:
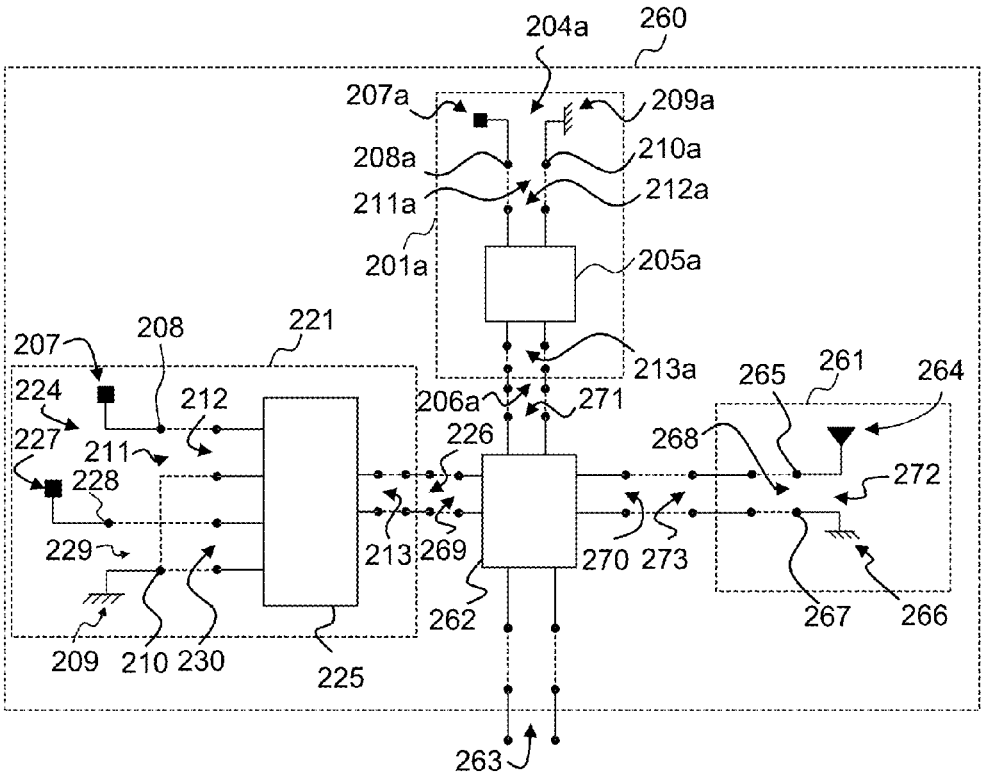
FIG. 2D is a schematic representation of a MIMO system including one radiating system including at least two radiation boosters, another radiating system including a radiation booster, and another radiating system including an antenna element.

FIG. 2D depicts a further example of a MIMO system 260 comprising three radiating systems 201*a*, 221, and 261, a MIMO module 262, and a MIMO external port 263 in charge of carrying the information signal.

The main difference with respect to previous configurations lies in the fact that in this case the radiating system 261 includes a radiating structure 272 comprising an antenna element 264, a ground plane 266, and an internal port 268 defined between the connection point 265 of the antenna element 264 and the connection point 267 of the ground plane 266. Said internal port 268 is connected to the external port 273 of the radiating system 261, which at the same time is connected to the MIMO internal port 270.

The antenna element can be for example and without any limiting purpose a microstrip patch, PIFA, IFA, monopole, slot, dipole or a combination thereof. The antenna element 264 clearly differs from the radiation booster in the fact that it presents a size comparable to the wavelength of operation and in this way the radiation is predominantly provided by the radiation mode associated to said antenna element. On the contrary, the radiation booster is featured by its small size compared to the operating wavelength. Said small size provides a poor stand-alone electromagnetic behavior that ensures the maximum transfer of energy to the efficient radiation mode of the ground plane. Thus, for the booster based solutions the radiation is entirely provided by the ground plane.

The embodiment depicted in FIG. 2D becomes preferred when the radiating systems 221, 261, and 201*a* are capable of providing operation in multiple frequency bands. In this case, the radiating systems 221, 261, and 201*a* can be intended for having at least one frequency band in common. For example, the radiating system 221 can operate in a first and in a second frequency band, whereas the radiating system 201*a* can operate in one of said first and second frequency bands or in both depending on the radiofrequency system 205*a*, whereas the radiating system 261 can operate in the other one of said first and second frequency bands, or in both, depending on the antenna element 264.

Figure 3A:
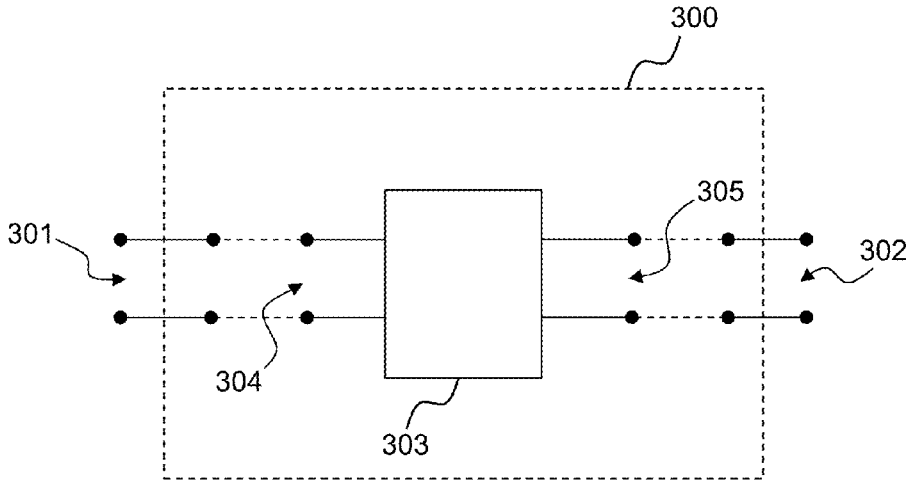
FIGS. 3A, 3B and 3C are block diagrams of three examples of matching networks for a radiofrequency system used in a radiating system according to the present invention.
Figure 3B:
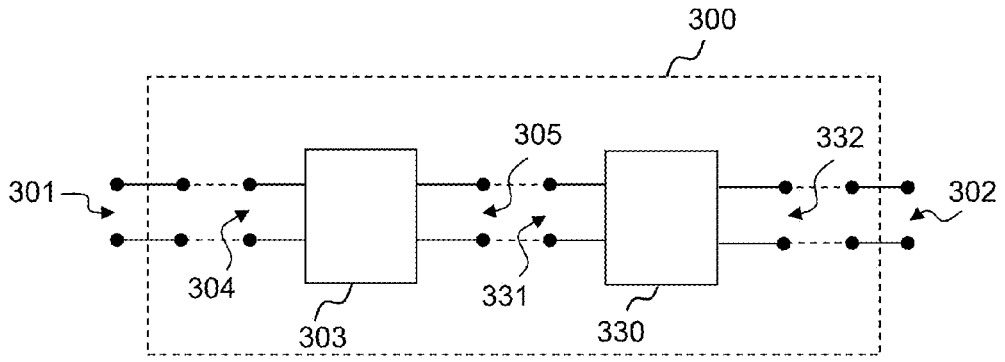
Figure 3C:
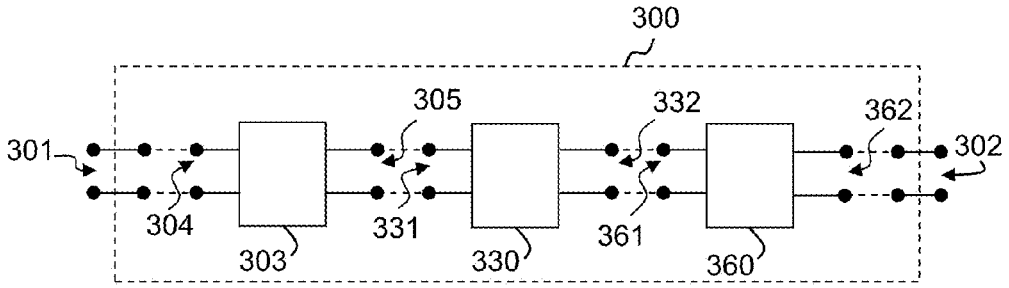

FIGS. 3A-3C show the block diagram of three preferred examples of a matching network 300 for a radiofrequency system, the matching network 300 comprising a first port 301 and a second port 302. One of said two ports may at the same time be a port of a radiofrequency system and, in particular, be interconnected with an internal port of a radiating structure.

In FIG. 3A the matching network 300 comprises a reactance cancellation circuit 303. In this example, a first port of the reactance cancellation circuit 304 may be operationally connected to the first port of the matching network 301 and another port of the reactance cancellation circuit 305 may be operationally connected to the second port of the matching network 302.

Referring now to FIG. 3B, the matching network 300 comprises the reactance cancellation circuit 303 and a broadband matching circuit 330, which is advantageously connected in cascade with the reactance cancellation circuit 303. That is, a port of the broadband matching circuit 331 is connected to port 305. In this example, port 304 is operationally connected to the first port of the matching network 301, while another port of the broadband matching circuit 332 is operationally connected to the second port of the matching network 302.

FIG. 3C depicts a further example of the matching network 300 comprising, in addition to the reactance cancellation circuit 303 and the broadband matching circuit 330, a fine tuning circuit 360. Said three circuits are advantageously connected in cascade, with a port of the reactance cancellation circuit (in particular port 304) being connected to the first port of the matching network 301 and a port the fine tuning circuit 362 being connected to the second port of the matching network 302. In this example, the broadband matching circuit 330 is operationally interconnected between the reactance cancellation circuit 303 and the fine tuning circuit 360 (i.e., port 331 is connected to port 305 and port 332 is connected to port 361 of the fine tuning circuit 360).

The radiofrequency systems 205*a*, 205*b*, 205*c*, 205*d*, 225*a*, 225*b*, 225, in the example of the radiating systems of FIGS. 2A-2D may advantageously include at least one, and preferably two in case of having radiating structures having two radiation boosters such as that shown in FIG. 2B, matching networks such as the matching network 300 of FIGS. 3A-3C.

However, the radiofrequency system can also include other matching network topologies suitable for providing a sufficient impedance bandwidth as for allowing operation in at least two frequency bands. The radiofrequency system can also include isolation means for lowering the correlation factor between radiating systems.

Figure 4A:
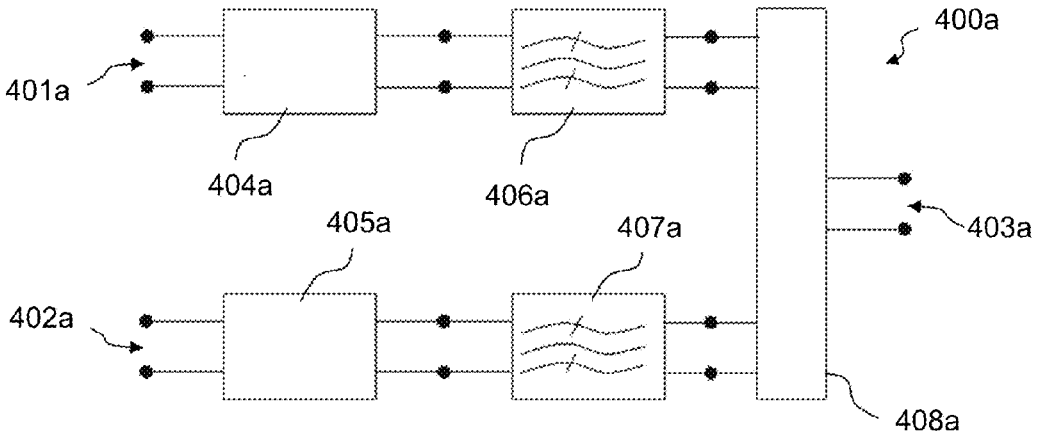
FIG. 4A is a schematic representation of a radiofrequency system including matching networks, filters, and a combiner/splitter.
Figure 4B:
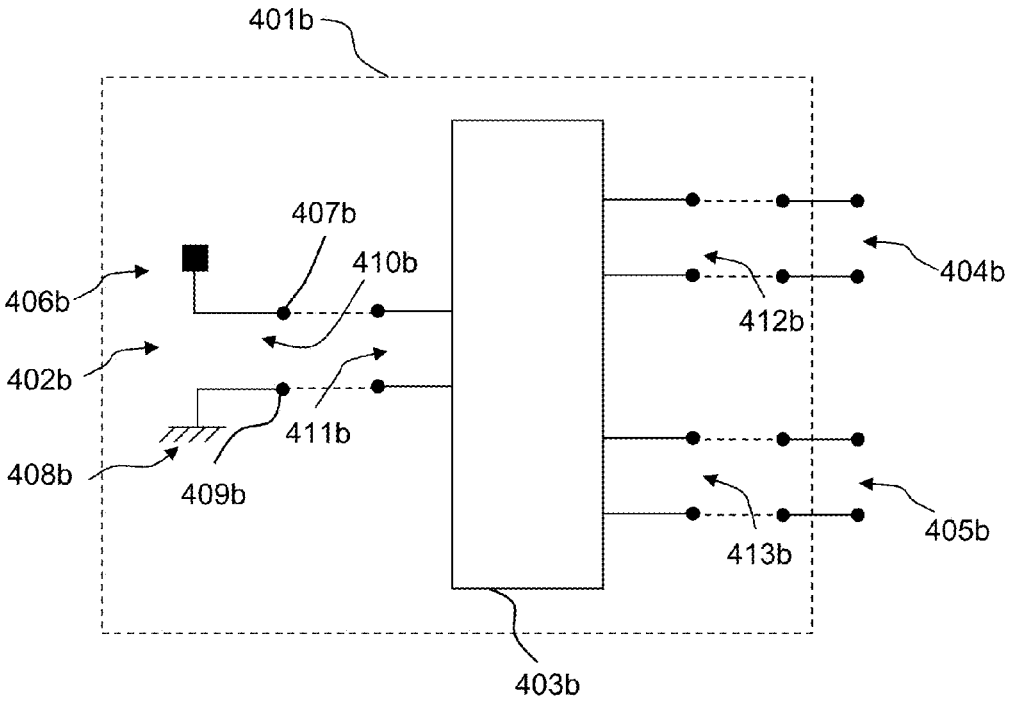
FIG. 4B is a schematic representation of a radiation booster connected to a radiofrequency system. The radiating system shown has two external ports.

FIGS. 4A and 4B depict a schematic representation of a radiofrequency system including matching networks, filters, and a combiner/splitter as well as the interconnection of a radiating structure comprising a radiation booster with a radiofrequency system having three ports.

In particular, FIG. 4A represents as schematic of a radiofrequency system 400*a* to be connected to two internal ports of a radiating structure in order to transform the input impedance of the radiating structure and provide impedance matching in at least a first and a second frequency band of operation of a radiating system.

The radiofrequency system 400*a* comprises two ports 401*a*, 402*a* to be connected respectively to the first and second internal ports of a radiating structure and a third port 403*a* to be connected to a single external port of a radiating system. Said external port of the radiating system is connected to a MIMO internal port of a MIMO module.

The radiofrequency system 400*a* depicted in FIG. 4A can be used for instance to the radiating structure 224*a* of FIG. 2B where the two internal ports 212*a*, 230*a* can be respectively connected to a port 401*a* and a port 402*a* of the radiofrequency system 400*a*. The port 403*a* of the radiofrequency system 400*a* can be connected to the external port of the radiating system 221*a*, which at the same time is connected to a MIMO internal port 231 of a MIMO module. The radiofrequency system 400*a* can be also used for instance for the radiating structure 224*b* also shown in FIG. 2B.

The radiofrequency system 400*a* further comprises a first matching network 404*a* connected to port 401*a*, providing impedance matching within the first band; and a second matching network 405*a* connected to port 402*a*, providing impedance matching within the second frequency band. The matching network 300 shown in FIGS. 3A-3C can be used for instance as the first matching network 404*a* and the second matching network 405*a*.

The radiofrequency system 400*a* further comprises a first band-pass filter 406*a* connected to said first matching network 404*a*, and a second band-pass filter 407*a* connected to said second matching network 405*a*. The first band-pass filter 406*a* is designed to present low insertion loss in at least the first frequency band and high impedance in at least the second frequency band of operation of the radiating system. Analogously, the second band-pass filter 407*a* is designed to present low insertion loss in at least said second frequency band and high impedance in said at least frequency band.

The radiofrequency system 400*a* additionally includes a combiner/splitter 408*a* to combine (or split) the electrical signals of different frequency bands. Said combiner/splitter 408*a* is connected to the first and second band-pass filters 406*a*, 407*a*, and to the port 403*a*.

The radiofrequency systems 400*a*, 403*b* provide modularity to facilitate the connection to a MIMO module. For example, if the MIMO module has an internal port able to operate at two frequency bands, the radiofrequency system 400*a* can be used, where the upper path defined by the port 401*a* provides operation at one band and the lower path defined by the port 402*a* provides operation at the other band. In another situation the MIMO module may present an input port for one band and another input port for another band. Then, the radiofrequency system 401*b* can be advantageously used since it provides two external ports 404*b* (used for one band) and 405*b* (used for the other band).

FIG. 4B depicts a further example of a radiating system 401*b* having the same radiating structure 402*b* as in the example of FIG. 2A. However, differently from the example of FIG. 2A, the radiating system 401*b* comprises an additional port 405*b*.

The radiating system 401*b* includes a radiofrequency system 403*b* having a first port 411*b* connected to the internal port of the radiating structure 410*b*, a second port 412*b* connected to the external port 404*b*, and a third port 413*b* connected to the additional external port 405*b*.

Such radiating system 401*b* may be preferred when said radiating system 401*b* is to provide operation in at least one cellular communication standard and at least one wireless connectivity standard. In one example, the external port 404*b* may provide the GSM 900 and GSM 1800 standards, while the external port 405*b* may provide an IEEE802.11 standard.

Figure 5:
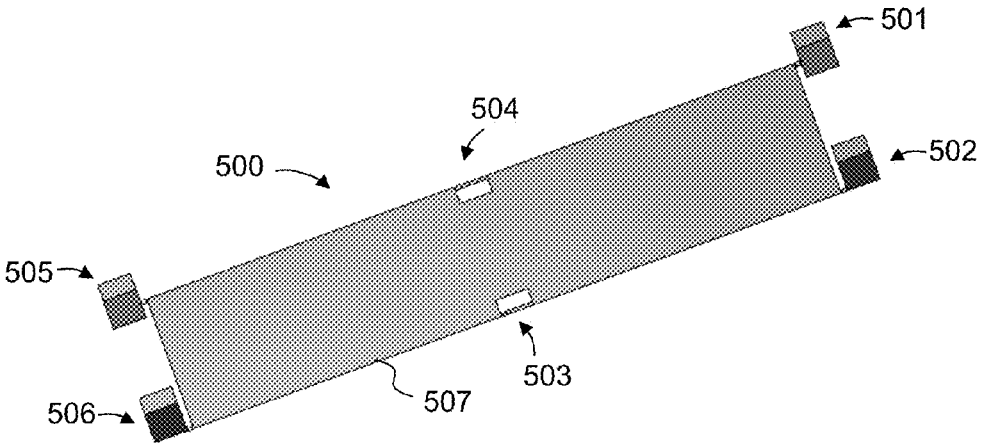
FIG. 5 is a perspective view of an example of a MIMO system including six radiation boosters: two radiation boosters used to couple inductive energy to the ground plane radiation mode (or modes) and four radiation boosters performing a capacitive coupling of energy to the ground plane radiation mode (or modes).

FIG. 5 shows a preferred example of a MIMO system 500 including six radiating structures comprising six radiation boosters (501-506) and a ground plane 507. On one hand, the radiation boosters 503 and 504 are inductive radiation boosters since they feature at their respective internal ports when disconnected from the radiofrequency system an input impedance having an inductive reactance for the frequencies of at least one frequency band of operation provided by the radiating system including said inductive radiation booster. On the other hand, the radiation boosters 501, 502, 505, 506 are capacitive radiation boosters since they present an input impedance having a capacitive reactance for the frequencies of at least one frequency band of operation provided by the radiating system including said capacitive radiation booster, preferably the lowest frequency band of operation when the radiofrequency system is disconnected. The radiating structure further comprises a ground plane 507. In this example, since the ground plane 507 has a substantially rectangular shape the capacitive radiation boosters are located in opposite corners of the shorter edges of said ground plane while the inductive radiation boosters are arranged at the center part of each one of the longer edges of said ground plane.

Each radiation booster in combination with the ground plane constitutes a radiating structure. Said radiating structure, when interconnected with a radiofrequency system as that described in FIGS. 3A-3C, forms a radiating system capable of providing operation in multiple frequency bands. The combination of radiating structures comprising inductive and capacitive radiation boosters becomes preferred for reducing the mutual coupling between them.

In a particular example, each radiation booster is connected to a different matching network 300. Each external port of each radiofrequency system is connected to an internal port of a MIMO module. That is, the MIMO module has six internal ports, as many as radiation boosters.

In yet another example, the radiation boosters 501, 502 are connected to a radiofrequency system 400*a*, the radiation boosters 503, 504 to a different radiofrequency system 400*a*, and the radiation boosters 505, 506 to a different radiofrequency system 400*a*. Each external port of each radiofrequency system in connected to an internal port of a MIMO module. In this example, the MIMO module has three internal ports.

In yet another example, the radiation booster 501 is connected to a matching network 300, the radiation booster 502 is connected to another matching network 300, the radiation boosters 505, 506 to a radiofrequency system 400*a*, the radiation booster 503 to a matching network 300, and the radiation booster 504 to another matching network 300. Each external port of each radiofrequency system is connected to an internal port of a MIMO module. For this example, the MIMO module has five internal ports.

Different embodiments can satisfy different specifications of a MIMO system. For instance, the example using six radiating systems leads to a MIMO system of order M=6 in at least two frequency bands. In other examples, three radiating systems may be employed for a MIMO system of order M=3 in at least two frequency bands. Both examples may use the same number of radiation boosters whereas in the first one, a large MIMO order can be obtained. The difference resides in the radiofrequency systems used. On one hand, the first example presents a radiofrequency system having a single port connected to the external port of each one of the six radiating systems and is used for providing operation in at least two frequency bands. Thus, the MIMO system is composed by six radiating systems providing each one operation in the same two frequency bands. On the other hand, the second example comprises three radiating system each one including two radiation boosters that are combined into a single port through a radiofrequency system as that shown in FIG. 4A to advantageously improve the impedance bandwidth and/or the radiation efficiency in at least two frequency bands.

Figure 6:
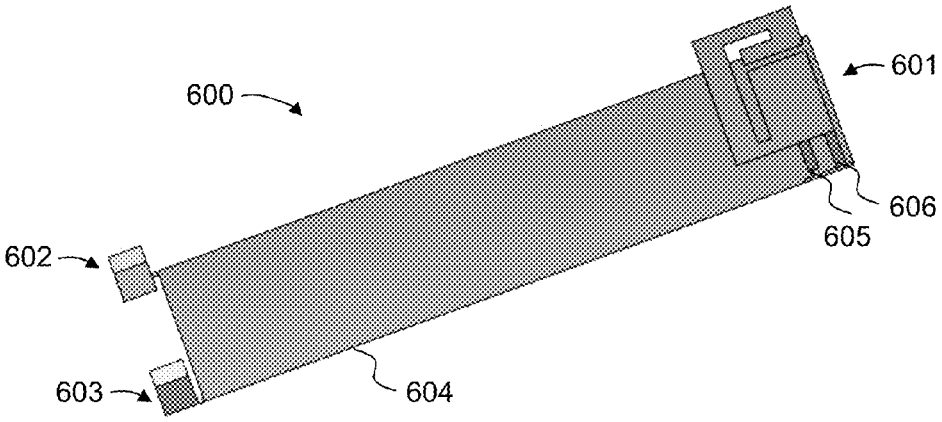
FIG. 6 is a perspective view of an example of a MIMO system combining radiation boosters with an antenna element.

FIG. 6 depicts a MIMO system 600 comprising several radiating structures. The first radiating structure includes an antenna element 601 and a ground plane 604. The antenna element 601 in this case and just for illustrative purposes corresponds to a PIFA antenna 601 having a feeding means 605 and a shorting means 606 intended for providing operation in multiple frequency bands. The second radiating structure comprises a first radiation booster 602 and the same ground plane 604 than the first radiating structure whereas the third radiating structure includes a second radiation booster 603 and also shares the ground plane 604 with previous radiating structures.

The second and third radiating structures comprise first and second internal ports defined between a connection point of the first and second radiation booster and a connection point of the ground plane. Said first and second internal ports are respectively connected to a first and a second matching network as that shown in FIGS. 3A-3C, thus constituting a first and a second radiating system for attaining respectively multiband operation.

Another possible configuration of the embodiment shown in FIG. 6 results in a MIMO system 600 comprising only two radiating structures. In this case, the first radiation booster 602 and the second radiation booster 603 are interconnected through a radiofrequency system 400*a* as that shown in FIG. 4A, thus constituting a single radiating system capable of providing multiband operation.

In any case, the resulting radiating systems have at least one operating frequency band in common with the operating bands of the radiating system including the antenna element, in this case the PIFA antenna.

Figure 7:
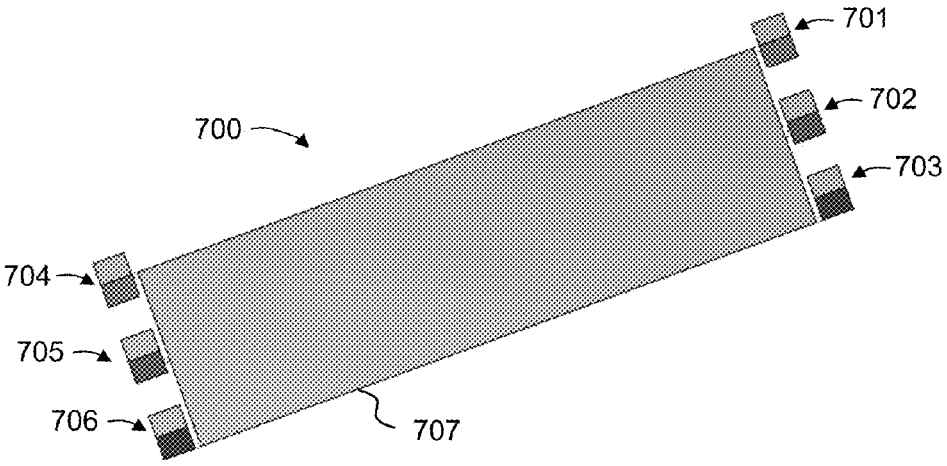
FIG. 7 is a perspective view of an example of a MIMO system including six radiation boosters conceived to couple capacitive electromagnetic energy to the ground plane radiation mode.

FIG. 7 depicts a MIMO system including six radiating structures comprising respectively a radiation booster (701, 702, 703, 704, 705, 706) and sharing the ground plane 707. The internal ports of said radiating structures defined between a connection point of a radiation booster and a connection point of the ground plane are respectively connected to a first port of a radiofrequency system. In this sense, there are as many radiofrequency systems as radiating structures and as many radiating systems as radiofrequency systems. In other examples two or more radiation boosters can constitute a single radiating structure connected to a single radiofrequency system in a similar way as that shown in FIG. 2B for achieving multiband operation.

In this particular embodiment all the radiation boosters are capacitive radiation boosters featuring an input impedance having a capacitive reactance for the frequencies of at least one frequency band of operation when the radiofrequency system is disconnected. Due to said electromagnetic behavior, the boosters are preferably located in the shorter edges of the ground plane 707, which presents a substantially rectangular shape.

Figure 8:
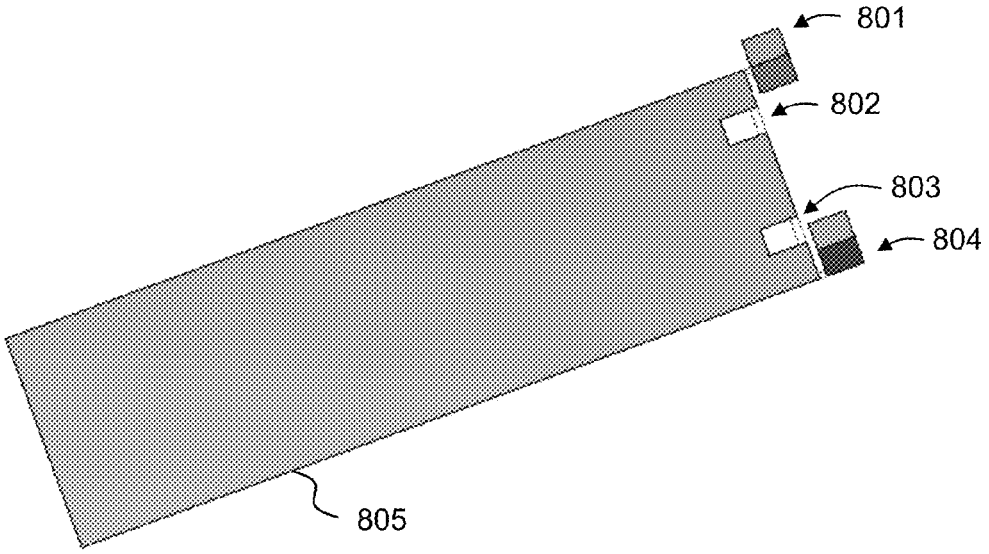
FIG. 8 is a perspective view of an example of a MIMO system including four radiation boosters: two radiation boosters used to couple inductive electromagnetic energy to the ground plane radiation mode and two radiation boosters for coupling capacitive electromagnetic energy to the ground plane radiation mode. The radiation boosters are arranged in the shorter edge of a substantially rectangular ground plane.

FIG. 8 shows another preferred embodiment for a MIMO system 700 including radiation boosters performing different electromagnetic behavior. Thus, the radiations boosters 801 and 804 are featured by an input impedance having a capacitive reactance for the frequencies of at least one frequency band of operation when the radiofrequency system is disconnected. At the same time, the radiation boosters 802 and 803 present an input impedance having an inductive reactance for the frequencies of at least one frequency band of operation when the radiofrequency system is disconnected.

In this particular embodiment, the four radiation boosters can be connected to four different radiofrequency systems for providing operation in multiple frequency bands, thus resulting in four different radiating systems. Otherwise, two or more radiation boosters featuring same or different electromagnetic behavior (capacitive or inductive) can be combined into a single radiofrequency system, thus resulting in a single radiating system comprising two or more radiating structures.

The capacitive boosters are placed advantageously on opposite corners of a shorter edge or side of a ground plane 805 having a substantially rectangular shape, whereas the inductive boosters are placed on said short side or edge but at a certain distance from said corners.

The embodiment of FIG. 8 is advantageous since it uses four radiation boosters occupying a small space of a ground plane 805 being radiation boosters 801, 804 of capacitive nature and radiation boosters 802, 803 of inductive nature. It is due to this complementary nature (inductive and capacitive) that radiation boosters can be placed very close while preserving good electromagnetic behavior in terms of correlation and isolation.

Figure 9:
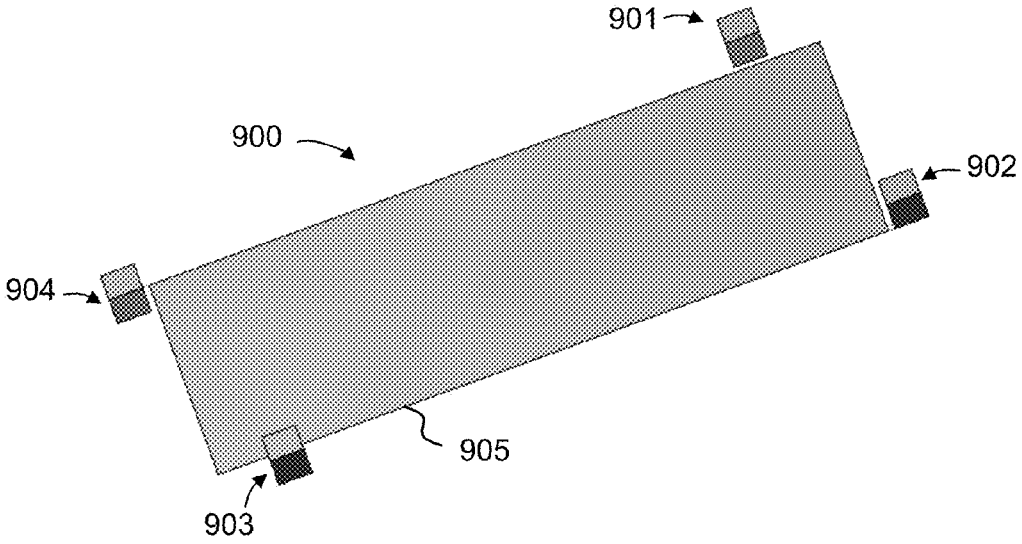
FIG. 9 is a perspective view of an example of a MIMO system including four radiation boosters conceived to couple capacitive electromagnetic energy to the ground plane radiation mode. A first and a second radiation booster are arranged respectively in a first short edge and a second short edge of a substantially rectangular ground plane close to opposite corners in order to provide high isolation whereas a third and a fourth radiation boosters are arranged respectively in a third and a fourth long edge for providing substantially orthoghonal radiation modes.

FIG. 9 depicts another example of a MIMO system 900 according to the present invention including four radiation boosters featuring an input impedance having a capacitive reactance for the frequencies of at least one frequency band of operation when the radiofrequency system is disconnected. In this case the radiation boosters 902 and 904 are located in opposite corners of the shorter edge and radiation boosters 901, 903 close to the corner of the ground plane 905. This distance between the location of the radiation boosters 901, 903 and the corner of the ground plane 905 is adjusted to optimize electromagnetic behavior such as the correlation and isolation.

Figure 10:
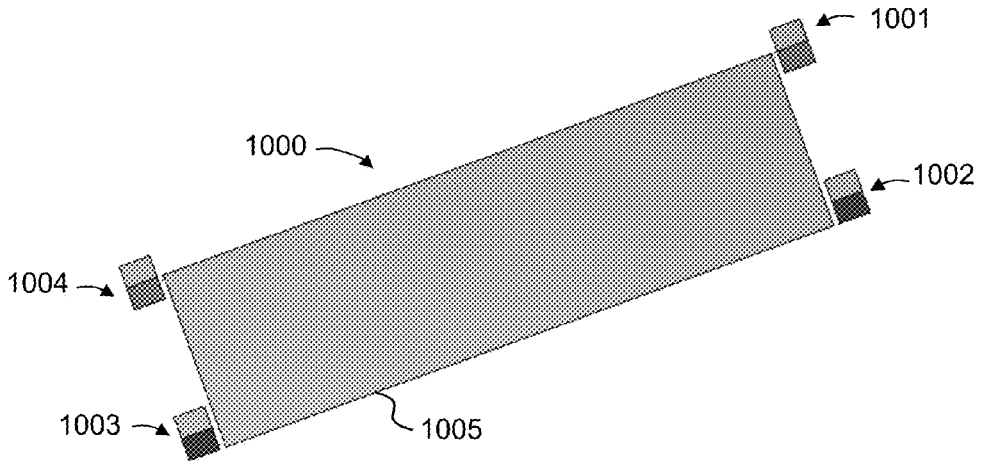
FIG. 10 is a perspective view of an example of a MIMO system including four radiation boosters conceived to couple capacitive electromagnetic energy to the ground plane radiation mode. The four radiation boosters are arranged respectively in the four corners of a substantially rectangular ground plane in order to be substantially isolated.

FIG. 10 shows a similar embodiment as that in FIG. 9 but in this case the radiation boosters are located at the four corners of a substantially rectangular ground plane of a wireless handheld or portable device such as a handset phone.

Figure 11:
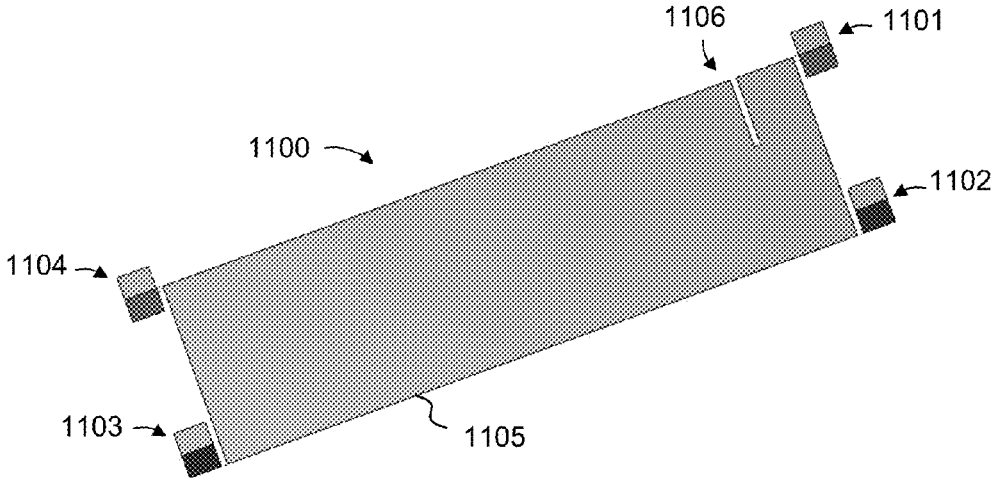
FIG. 11 is the same configuration as that depicted in FIG. 10 but with the addition of a slot extending in a direction substantially perpendicular to the long edge of the substantially rectangular ground plane for tuning the radiation modes excited in said substantially rectangular ground plane and for improving the isolation between radiating systems.
Figure 12:
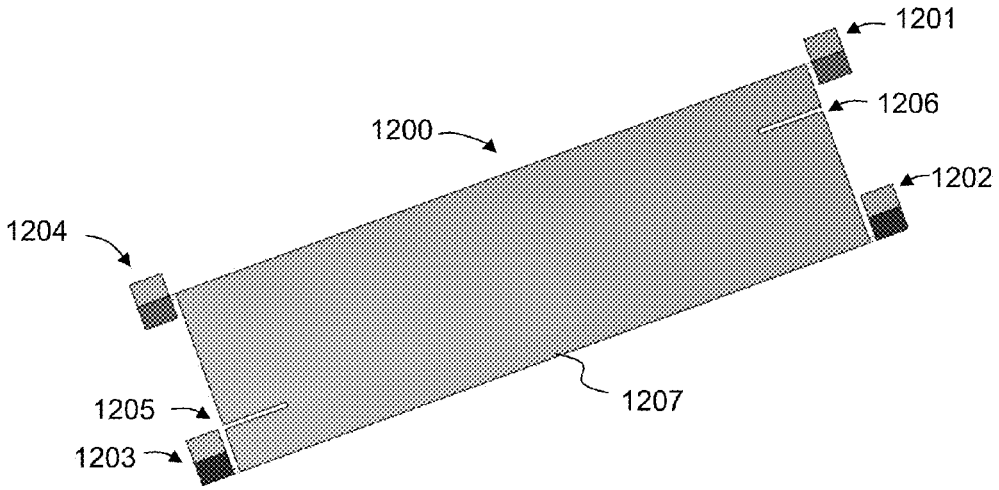
FIG. 12 is the same configuration as that depicted in FIG. 10 but with the addition of two slots, each one located at each one of the shorter edges of the ground plane extending in a direction substantially perpendicular to said short edges for tuning the radiation modes excited in said substantially rectangular ground plane and for improving the isolation between radiating systems.
Figure 13:
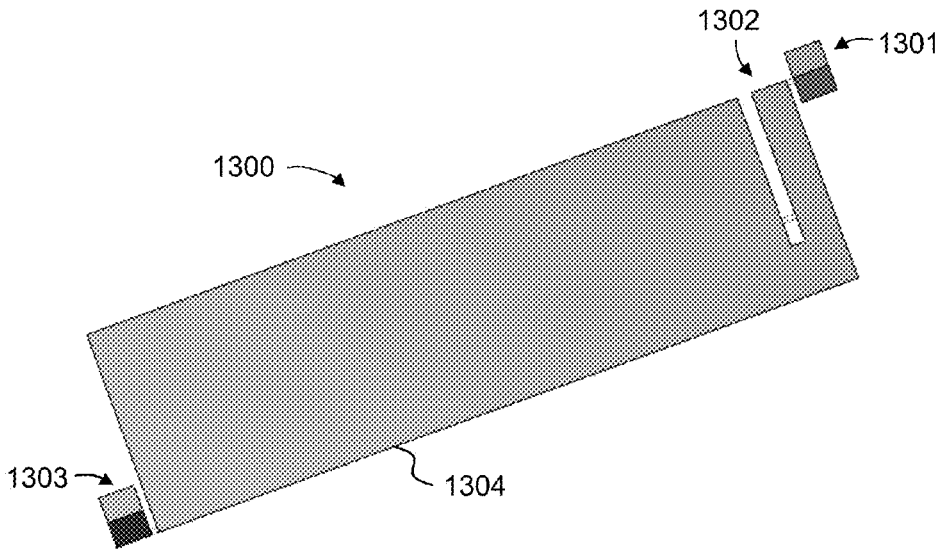
FIG. 13 is a perspective view of an example of a MIMO system including three radiation boosters conceived to couple capacitive and inductive energy to the ground plane radiation mode. The radiation booster featuring an inductive behavior is used simultaneously as a mechanism to modify the radiation modes and consequently the current distributions flowing along the ground plane.

FIGS. 11, 12 and 13 depict several embodiments of MIMO systems comprising radiation boosters including slots 1106, 1205, 1206, 1302 on the ground plane 1105, 1207, 1304. The size of the slots 1106, 1205, 1206, 1302 and their relative arrangement with respect to the ground plane 1105, 1207, 1304 and to the radiation boosters are advantageously selected either for enhancing the impedance bandwidth or for increasing the isolation between radiation boosters so as to decrease the correlation coefficient. Both effects can be obtained at the same time. Furthermore, the slot can be reused as a radiation booster if its input impedance presents a reactive behavior for the frequencies of at least one frequency band of operation of the wireless handheld or portable device, or as an antenna element if it features resonant dimensions for at least one frequency belonging to a frequency band of operation of the wireless handheld or portable device, as is the case of the slot 1302, which resonates in a particular frequency associated to the frequency band where the standard GSM1900/PCS is allocated.

In a particular example, the radiation booster 1101 and 1102 are connected to a radiofrequency system 400*a* similar to that shown in FIG. 4A so as to provide operation in the communication standards GSM850, GSM900, GSM1800/DCS, GSM1900/PCS, and UMTS. The radiation booster 1104 provides operation at GSM850 and GSM900 while the radiation booster 1103 is intended for operating at GSM1800, GSM1900, and UMTS. The external port of each of the radiofrequency systems is each one connected to a MIMO internal port of a MIMO module. This particular example provides MIMO M=2 at GSM850, GSM900 and MIMO M=2 at GSM1800, GSM1900, and UMTS.

Figure 14:
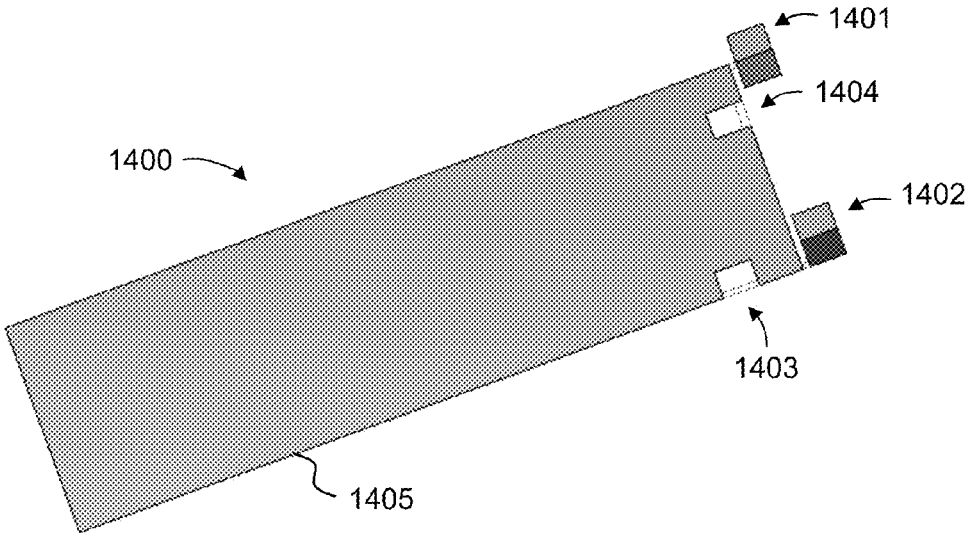
FIG. 14 is the same configuration as in FIG. 8 but in this case those radiation boosters in charge of coupling inductive energy to the ground plane radiation mode are located at the short and the long edge of the ground plane.

FIG. 14 shows a particular embodiment of a MIMO system including four radiation boosters. Radiation boosters 1401, 1402 feature an input impedance having a capacitive reactance for the frequencies of at least one frequency band of operation when the radiofrequency system is disconnected. Radiation boosters 1404, 1403 feature an input impedance having an inductive reactance for the frequencies of at least one frequency band of operation when the radiofrequency system is disconnected.

In a particular example, radiation boosters 1401, 1403 operate in a first frequency band and radiation boosters 1402, 1404 in a second frequency band. Each radiation booster is connected to a radiofrequency system as shown in FIG. 2A. In this particular example, the MIMO module 202 has four internal ports, one per each radiation booster 1401, 1402, 1403, and 1404.

In another particular example, radiation booster 1401 and 1402 are connected to a radiofrequency system 221*a* (FIG. 2B) and radiation booster 1403, 1404 are connected to a radiofrequency system 221*b*. For this particular example, the MIMO module has two internal ports. Other combinations are also possible to optimize correlation/isolation depending upon the frequency bands of operation.

In another particular example, radiation booster 1401 and 1402 are connected to the radiofrequency system 225, the radiation booster 1403 to the radiofrequency system 205*a*, and the radiation booster 1404 to the radiofrequency system 205*b*. In this particular example, the MIMO module has three internal ports.

Figure 15:
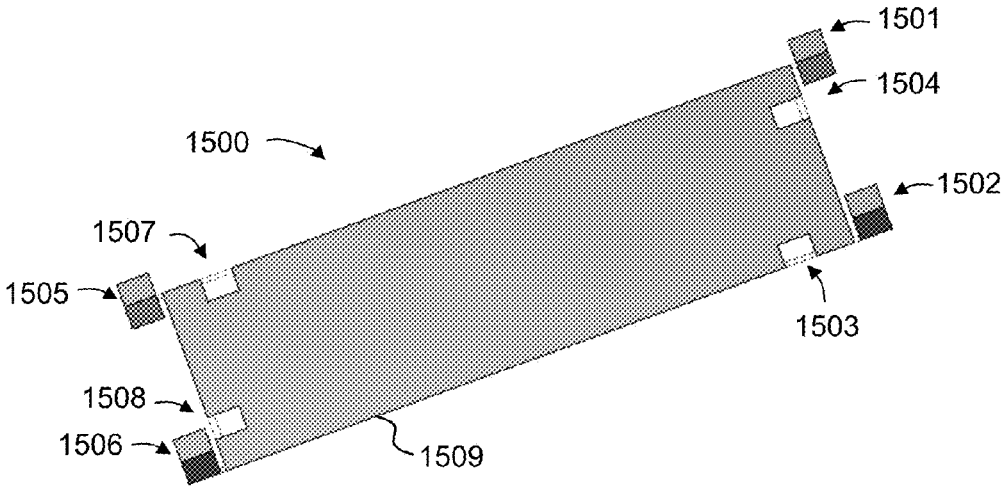
FIG. 15 is the configuration shown in FIG. 14 is duplicated at both ends of the ground plane of the embodiment shown in FIG. 15.

FIG. 15 shows an embodiment similar to the embodiment of FIG. 14. In this particular embodiment, four more boosters (1505, 1506, 1507, 1505) are located at the opposite edge of a ground plane of a wireless device. The addition of more boosters helps to increase the MIMO order so as to increase the capacity of the wireless MIMO device.

Figure 16:
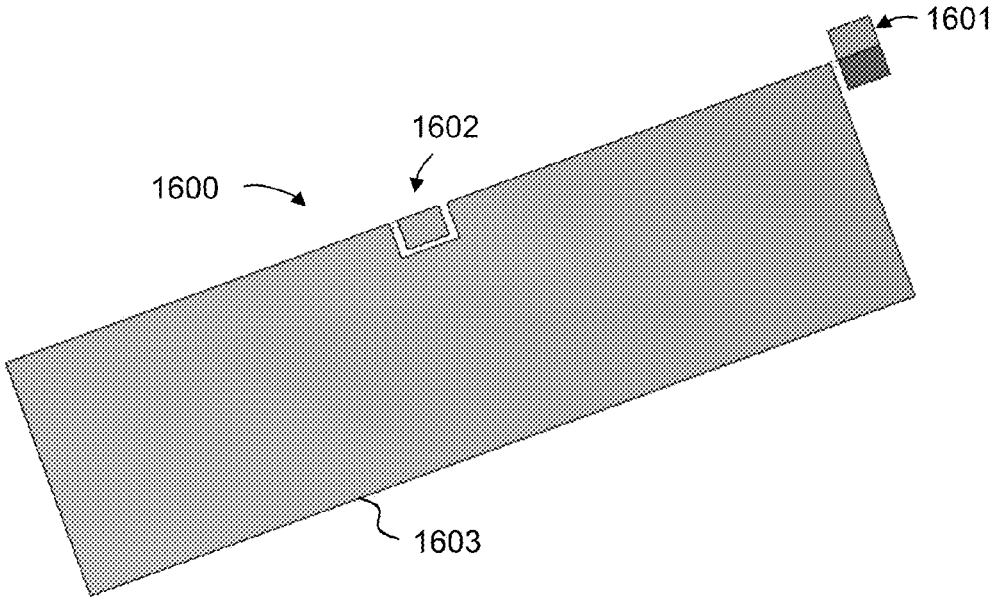
FIG. 16 is a perspective view of another example of a MIMO system including two radiation boosters conceived to couple capacitive energy to the ground plane radiation mode.

FIG. 16 shows another embodiment of a MIMO system including two radiation boosters (1601, 1602). The radiation booster 1602 present a 2D profile which may be advantageously used so as to facilitate the integration of radiation booster in the middle of the ground plane where many wireless components (battery, RF circuitry, displays) are located.

In a particular example, radiation booster 1601 can provide operation in GSM1800, GSM1900, and UMTS and radiation booster 1602 can provide operation in at least one of the aforementioned communication standards.

In another particular example, radiation booster 1601 can provide operation in LTE700, GSM850, and GSM900 and radiation booster 1602 can provide operation in at least one of the aforementioned communication standards.

Figure 17:
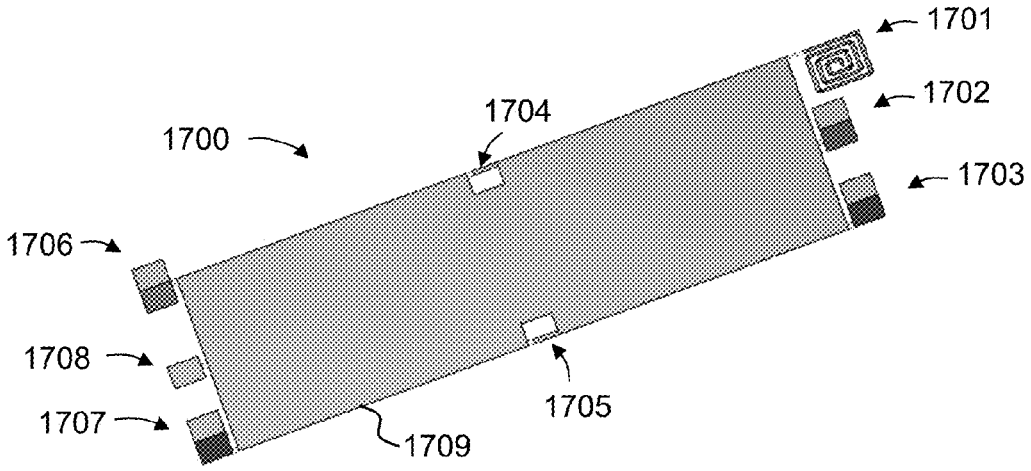
FIG. 17 is a perspective view of another example of a MIMO system including five radiation boosters conceived to couple capacitive energy to the ground plane radiation mode, two radiation boosters conceived to couple inductive energy to the ground plane radiation mode, and an antenna element.

FIG. 17 shows a particular embodiment including seven radiation boosters (1702, 1703, 1704, 1705, 1706, 1707, 1708) and an antenna element 1701.

In a particular example, radiation booster 1702, 1703 are connected to a radiofrequency system 400*a*. The radiation boosters 1704, 1705 are connected to another radiofrequency system 400*a* and the radiation boosters 1706, 1707 to another radiofrequency system 400*a*. In this example, the MIMO module has five input ports, one for the antenna element 1701, another for the external port of the radiofrequency system combining radiation boosters 1702, 1702, another for the external port of the radiofrequency system combining radiation boosters 1704, 1705, another for the external port of the radiofrequency system combining radiation boosters 1706, 1707, and another for the external port of the matching network of the radiation booster 1708.

In a particular example, antenna element 1701 operates in GSM900 and GSM1800, radiation boosters 1702 and 1703 in GSM850, GSM900, radiation boosters 1704, 1705 in GSM1800, GSM1900, UMTS, radiation boosters 1706, 1707 in GSM850, GSM900 and radiation booster 1708 in UMTS.

Figure 18:
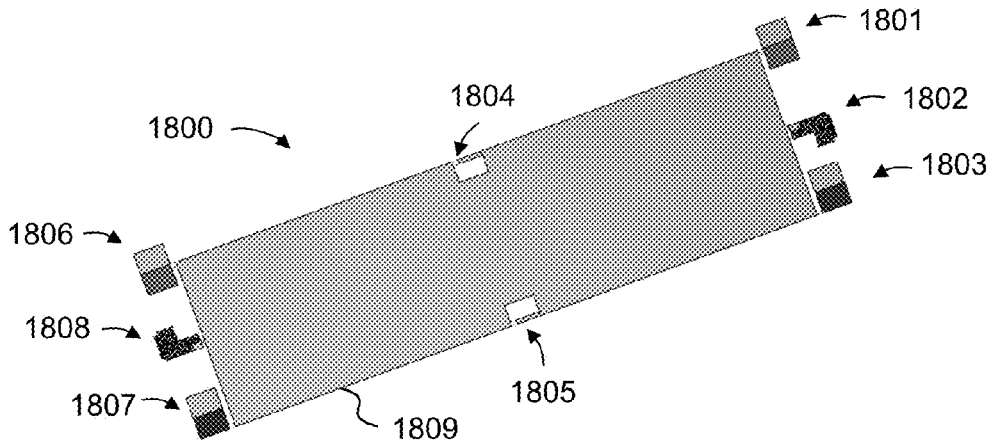
FIG. 18 is a perspective view of another example of a MIMO system including four radiation boosters conceived to couple capacitive energy to the ground plane radiation mode, two radiation boosters conceived to couple inductive energy to the ground plane radiation mode, and two antenna elements.

FIG. 18 shows an embodiment including six radiation boosters (1801, 1803, 1804, 1805, 1806, 1807) and two antenna elements (1802, 1808). The radiation boosters 1801, 1803, 1806, 1807 feature an input impedance having a capacitive reactance for the frequencies of at least one frequency band of operation when the radiofrequency system is disconnected. Radiation boosters 1804, 1805 feature an input impedance having an inductive reactance for the frequencies of at least one frequency band of operation when the radiofrequency system is disconnected. The location of radiation boosters 1801, 1803, 1806, 1807 is advantageously used so as to excite an efficient radiation mode of the ground plane 1809 and in particular, the preferred position for this particular example is at the corner of said ground plane 1809. The location of the radiation boosters 1804, 1805 is advantageously used so as to excite an efficient radiation mode of the ground plane 1809 and in particular, the preferred position for this particular example is at the center of the long edge of the ground plane 1809. The antenna elements 1802 and 1808 are space-filling curves.

In a particular example, radiation boosters 1801, 1803 are connected to a radiofrequency system 400*a* so as to provide operation in at least GSM850, GSM900, GSM1800, GSM1900, UMTS. The radiation boosters 1806, 1807 are connected to another radiofrequency system 400*a* so as to provide operation in at least GSM850, GSM900, GSM1800, GSM1900, UMTS. The radiation boosters 1804, 1805 are connected to another radiofrequency system 400*a* so as to provide operation in at least GSM1800, GSM1900, UMTS. Antenna elements 1802 and 1808 provide operation in at least the WiFi connectivity standard. The external port of the radiofrequency system hosting radiation boosters 1801, 1803 is connected to an input port of a MIMO module. The external port of the radiofrequency system hosting radiation boosters 1806, 1807 is connected to another input port of said MIMO module. The external port of the radiofrequency system hosting radiation boosters 1804, 1805 is connected to another input port of the MIMO module being said internal port different than previous ones. Antenna element 1802 in connected to another input port of said MIMO module being said internal port different than the previous ones. Antenna element 1808 is connected to another input port of said MIMO module being said port different than previous ones. This example features MIMO order M=2 for at least GSM850, GSM900, MIMO order M=3 for at least GSM1800, GSM1900, UMTS, and MIMO order M=2 for at least WiFi.

In yet another example radiation booster 1801 is connected to a matching network 300 wherein the external port is connected to an internal port of a MIMO module. The radiation booster 1801 provides operation in at least GSM850, GSM900 or LTE, GSM850, or LTE, GSM900. The radiation booster 1803 is connected to another matching network 300 wherein the external port is connected to another internal port of said MIMO module. The radiation booster 1803 provides operation in at least GSM850, GSM900 or LTE, GSM850, or LTE, GSM900. The radiation booster 1806 is connected to another matching network 300 wherein the external port is connected to another internal port different than previous ones of said MIMO module. The radiation booster 1806 provides operation in at least GSM850, GSM900 or LTE, GSM850, or LTE, GSM900. The radiation booster 1807 is connected to another matching network 300 wherein the external port is connected to another internal port different than previous ones of said MIMO module. The radiation booster 1807 provides operation in at least GSM850, GSM900 or LTE, GSM850, or LTE, GSM900. The radiation booster 1804 is connected to another matching network 300 wherein the external port is connected to another internal port different than previous ones of said MIMO module. The radiation booster 1804 provides operation in at least GSM1800, GSM1900 or GSM1900, UMTS or GSM1800, UMTS. The radiation booster 1805 is connected to another matching network 300 wherein the external port is connected to another internal port different than previous ones of said MIMO module. The radiation booster 1805 provides operation in at least GSM1800, GSM1900 or GSM1900, UMTS or GSM1800, UMTS. Antenna element 1802 may optionally be connected to another matching network 300 for impedance matching purposes. The external port of said radiofrequency system is connected to another internal port different than previous ones of said MIMO module. Antenna element 1802 provides operation in at least a communication system located in the 2.4-2.5 GHz band. Antenna element 1808 may be optionally connected to another matching network 300 for impedance matching purposes. The external port of said radiofrequency system is connected to another internal port different than previous ones of said MIMO module. Antenna element 1808 provides operation in at least a communication system located in the 2.4-2.5 GHz band. For this particular example, the MIMO module includes eight internal ports. The MIMO order M is M=4 for the set of radiation boosters 1801, 1803, 1806, 1807, M=2 for the set of radiation boosters 1804, 1805, and M=3 for the set of antenna elements 1802, 1808.

Figure 19:
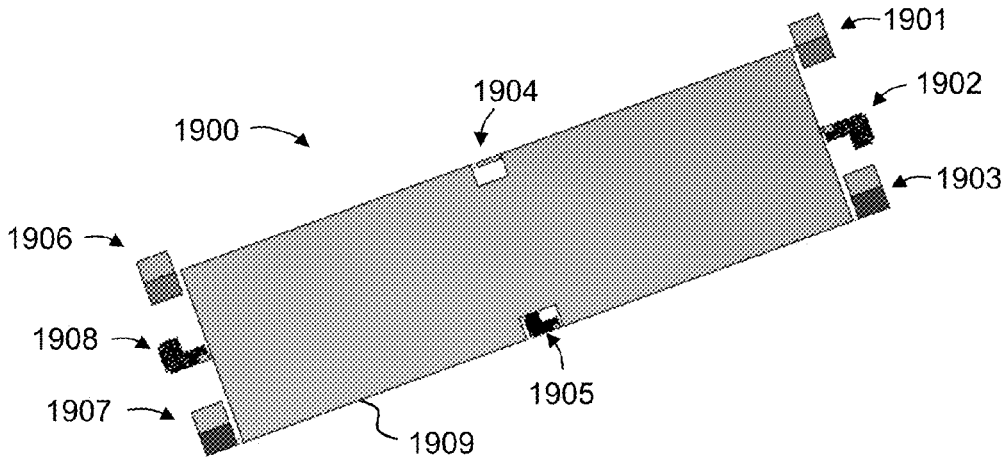
FIG. 19 is a perspective view of an example of a MIMO system including four radiation boosters conceived to couple capacitive energy to the ground plane radiation mode, one radiation booster to couple inductive energy to the ground plane radiation mode, and three antenna elements using space-filling curves as that described in the corresponding patent application Publication No. US2007/0152886.

FIG. 19 shows an embodiment including four radiation boosters featuring an input impedance having a capacitive reactance for the frequencies of at least one frequency band of operation when the radiofrequency system is disconnected, one radiation booster 1904 featuring an input impedance having an inductive reactance for the frequencies of at least one frequency band of operation when the radiofrequency system is disconnected, and three antenna elements 1902, 1905, 1908 using space filling curves located along a ground plane 1909 having en substantially elongated shape typical of a wireless device such as handset phone.

Figure 20:
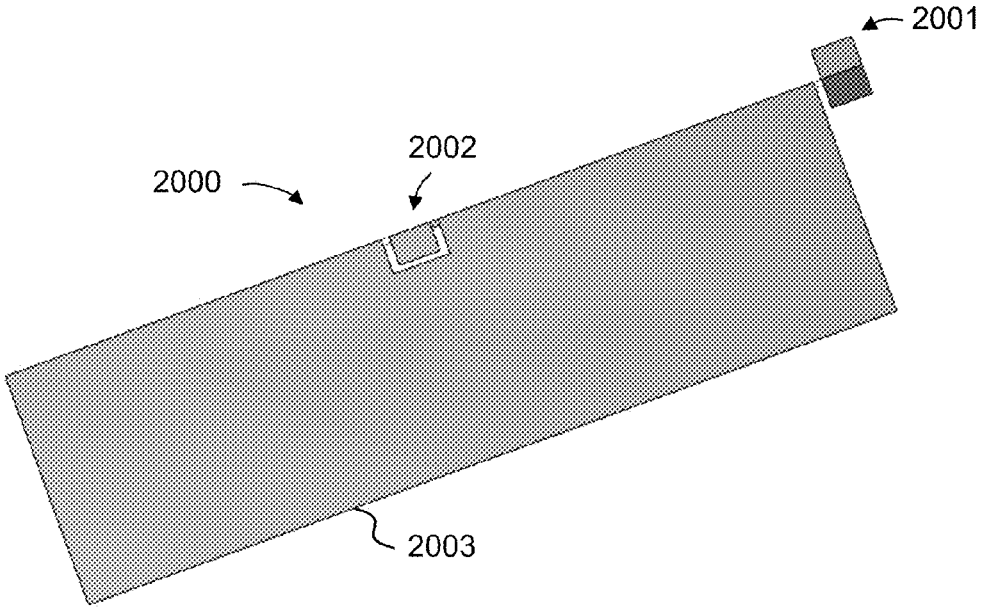
FIG. 20 is a perspective view of an example of a MIMO system including one radiation booster conceived to couple capacitive energy to the ground plane radiation mode and one radiation booster conceived to couple inductive energy to the ground plane radiation mode.

FIG. 20 shows an embodiment including a radiation booster 2001 featuring an input impedance having a capacitive reactance for the frequencies of at least one frequency band of operation when the radiofrequency system is disconnected and a radiation booster 2002 featuring an input impedance having an inductive reactance for the frequencies of at least one frequency band of operation when the radiofrequency system is disconnected located along a ground plane 2003.

In a particular example, the radiation boosters 2001 and 2002 provide operation in at least GSM1800, GSM1900. The radiation booster 2001 is connected to a matching network 300 wherein the external port of said matching network 300 is connected to an internal port of a MIMO module. The radiation booster 2002 is connected to another radiofrequency system wherein the external port of said radiofrequency system is connected to a second port of the said MIMO module, that is, the MIMO module has two internal ports. This is an example of a wireless device providing multiband (at least GSM1800, GSM1900) MIMO operation of order M=2.

Figure 21:
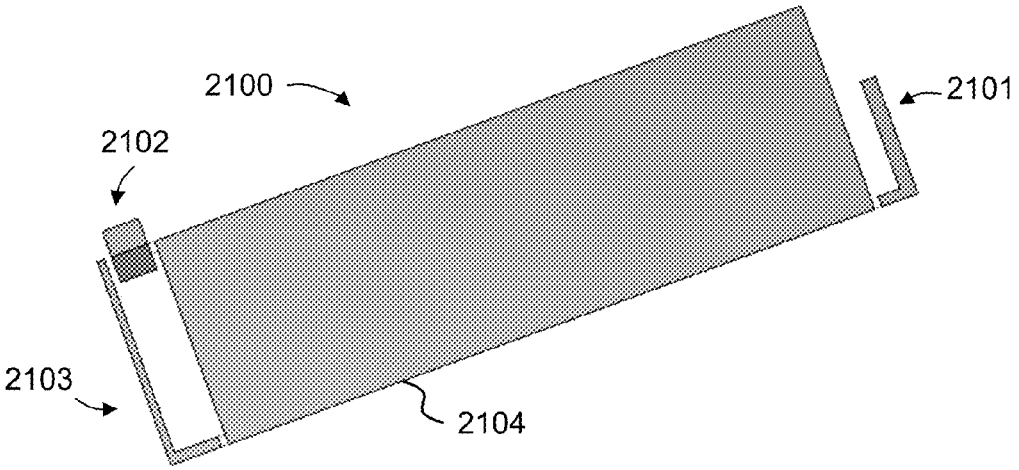
FIG. 21 is a perspective view of an example of a MIMO system including one radiation booster close to an antenna element where said radiation booster and antenna element share the same area close to the short edge of the ground plane. Another antenna element located at the opposite short edge of the ground plane.

FIG. 21 shows an embodiment including two antenna elements 2103 and 2101 and a radiation booster 2102 placed in the vicinity of the antenna element 2103.

In a particular example, antenna element 2013 operates at GSM850, GSM900, antenna elements 2101 operate at GSM1800, GSM1900, UMTS, and the radiation booster 2102 operates in at least one of the following GSM1800, GSM1900, UMTS.

Figure 22:
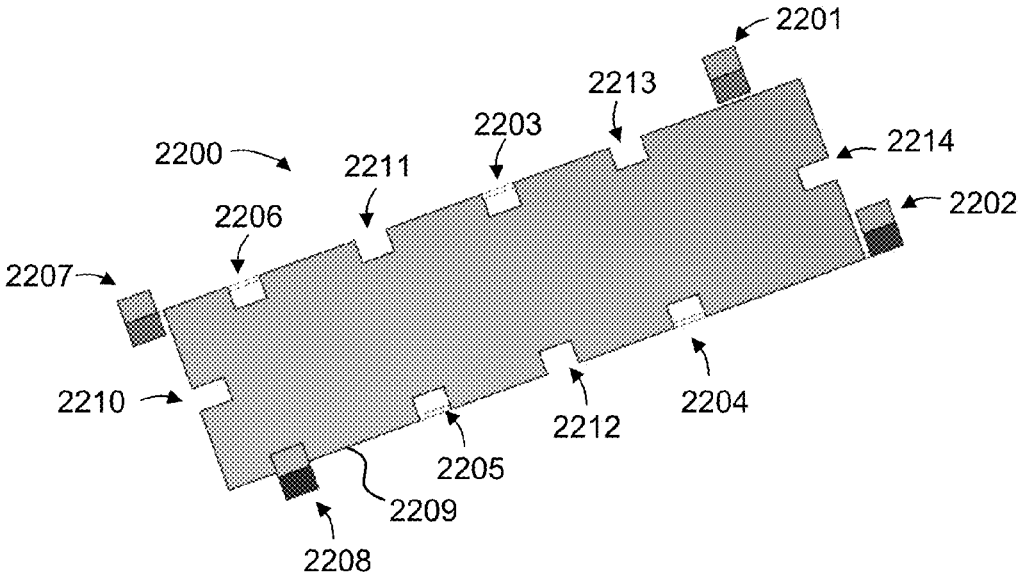
FIG. 22 is a perspective view of an example of a MIMO system including four radiation boosters conceived to couple capacitive energy to the ground plane radiation mode and four radiation boosters conceived to couple inductive energy to the ground plane radiation mode. The ground plane has five gaps in order to incorporate radiation boosters conceived to couple inductive energy to the ground plane radiation mode and even to incorporate radiation boosters to couple capacitive energy to the ground plane radiation mode.

FIG. 22 shows another embodiment including eight radiation boosters. The radiation boosters 2201, 2202, 2207, 2208 featuring an input impedance having a capacitive reactance for the frequencies of at least one frequency band of operation when the radiofrequency system is disconnected. The radiation boosters 2203, 2204, 2205, 2206 feature an input impedance having an inductive reactance for the frequencies of at least one frequency band of operation when the radiofrequency system is disconnected. The five gaps 2210, 2212, 2211, 2213, 2214 on the ground plane are used to host either capacitive radiation booster or inductive radiation boosters. This present example outlines the advantage of creating gaps on the ground plane 2209 to host radiation boosters in the design phase without the need of designing a new ground plane.

Figure 23:
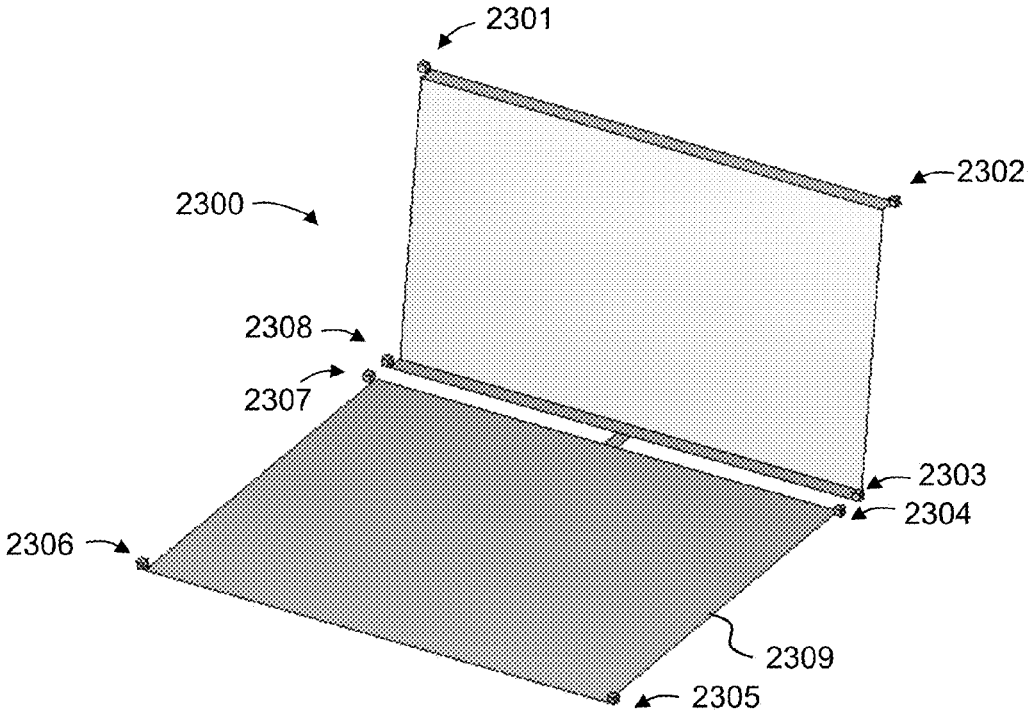
FIG. 23 is a perspective view of an example of a MIMO system representative of a laptop including eight radiation boosters conceived to couple capacitive energy to the ground plane radiation mode.

FIG. 23 shows an embodiment of a laptop computer for multi band MIMO operation 2300 including eight radiation boosters (2301, 2302, 2303, 2304, 2305, 2306, 2307, 2308) placed at the corner of the ground plane 2309 of the bottom and upper part of the laptop computer 2300. This particular example can be used to provide multi band MIMO operation for a MIMO (M×M) of M=2, 3, 4, 5, 6, 7, 8. Higher order M can be used by arranging more capacitive radiation boosters and/or inductive boosters such as 2203 (FIG. 22).

In a particular example, all the radiation boosters operate in at least LTE700, GSM850, and GSM900. In another particular example, radiation boosters 2301, 2303, 2304, 2307 operate in LTE700, GSM850, GSM900 and radiation boosters 2303, 2305, 2306, 2308 operate in GSM1800, GSM1900, and UMTS.

In yet another example, all radiation boosters operate in at least GSM1800, GSM1900, UMTS.

Figure 24:
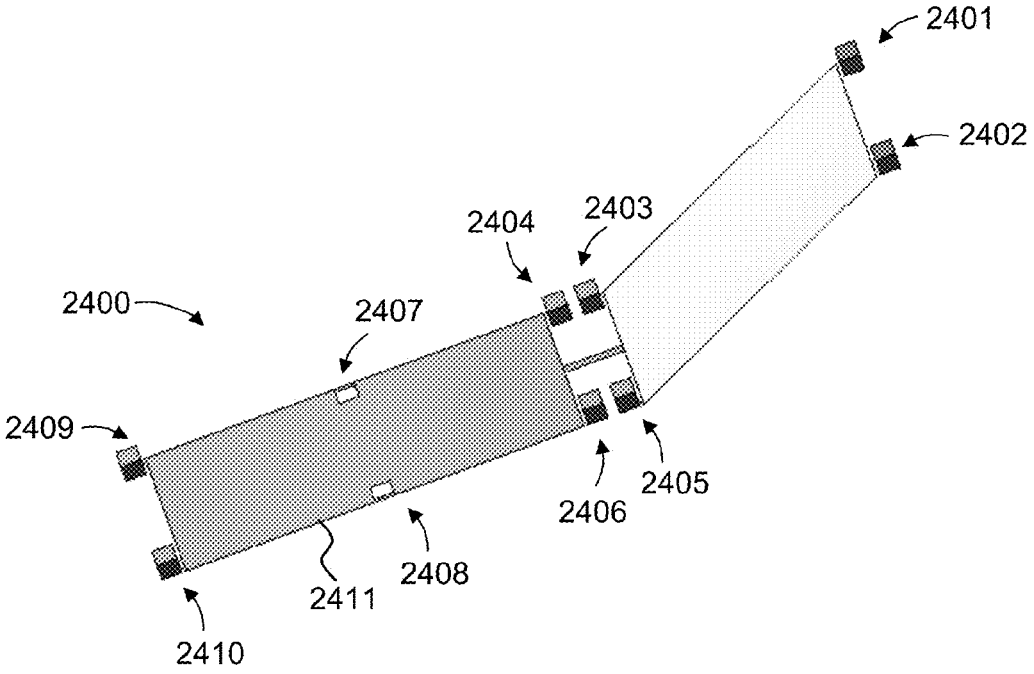
FIG. 24 is a perspective view of an example of a MIMO system representative of a clamshell mobile phone including eight radiation boosters conceived to couple capacitive energy to the ground plane radiation mode and two radiation boosters conceived to couple inductive energy to the ground plane radiation mode.

FIG. 24 shows an embodiment of a clamshell phone 2400 including ten radiation boosters along the ground plane 2411. Eight radiation boosters (2401, 2402, 2403, 2404, 2405, 2406, 2409, 2410) feature an input impedance having a capacitive reactance for the frequencies of at least one frequency band of operation when the radiofrequency system is disconnected. The radiation boosters 2407, 2408 feature an input impedance having an inductive reactance for the frequencies of at least one frequency band of operation when the radiofrequency system is disconnected. This particular example can be used to provide multi band MIMO operation for a MIMO (M×M) of M=2, 3, 4, 5, 6, 7, 8, 9 and 10.

Figure 25:
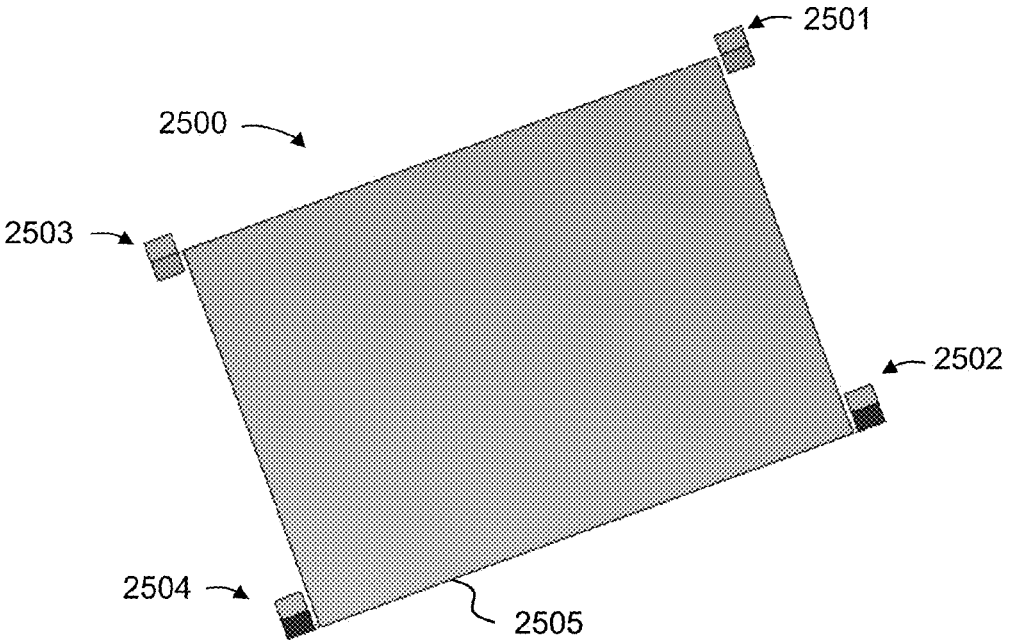
FIG. 25 is a perspective view of an example of a MIMO system including four radiation boosters and a ground plane substantially square-shaped representative of an e-book.

FIG. 25 shows an embodiment of a tablet, e-book, iPad or the like 2500 featuring multi band MIMO operation, including four radiation boosters placed at the corner of the ground plane 2505.

In a particular example, the radiation boosters 2501, 2504 are connected to a radiofrequency system 400*a*, and the radiation boosters 2502, 2503 to another radiofrequency system 400*a*. Each external port or each radiofrequency system is connected to an internal port a MIMO module. In this example, the MIMO module has two internal ports.

Figure 26:
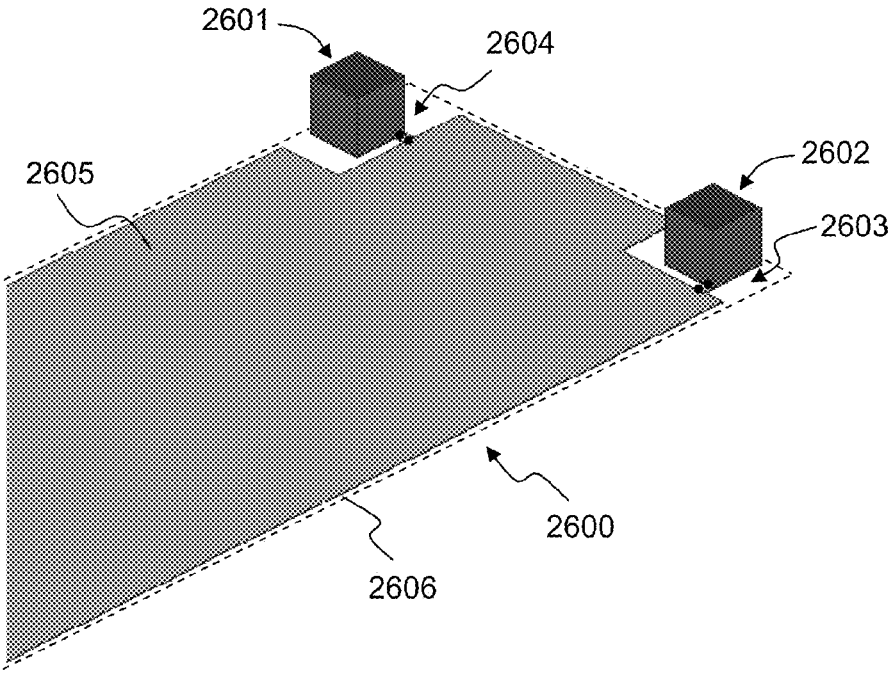
FIG. 26 is a perspective view of an example of a MIMO system including two radiation boosters located at the corners of the short edge of the ground plane and embedded in the ground plane area.

FIG. 26 shows a radiating structure 2600 in which its ground plane 2605 has been modified to include two cut-out portions in which metal has been removed from the ground plane 2605. A first cut-out portion 2604 and a second cut-out portion 2603 has been provided in the ground plane 2605.

Despite the fact that the ground plane 2605 is irregularly shaped (compared to for instance the rectangular ground plane 905), it has a ground plane rectangle enclosing the ground plane 2605 equal to that associated to the ground plane 905.

The first radiation booster 2601 can now be provided on the first cut-out portion 2604, while the second radiation booster 2602 can be provided on the second cut-out portion 2603. That is, the radiation boosters 2601, 2602 have been receded towards the inside of the ground plane rectangle 2606, so that the orthogonal projection of the first and second radiation booster 2601, 2602 on the plane containing the ground plane 2605 is completely inside the perimeter of the ground plane rectangle 2606. Such a ground plane and arrangement of the radiation boosters with respect to the ground plane are advantageous to facilitate the integration of the radiating structure within a particular handheld or portable wireless device.

Figure 27:
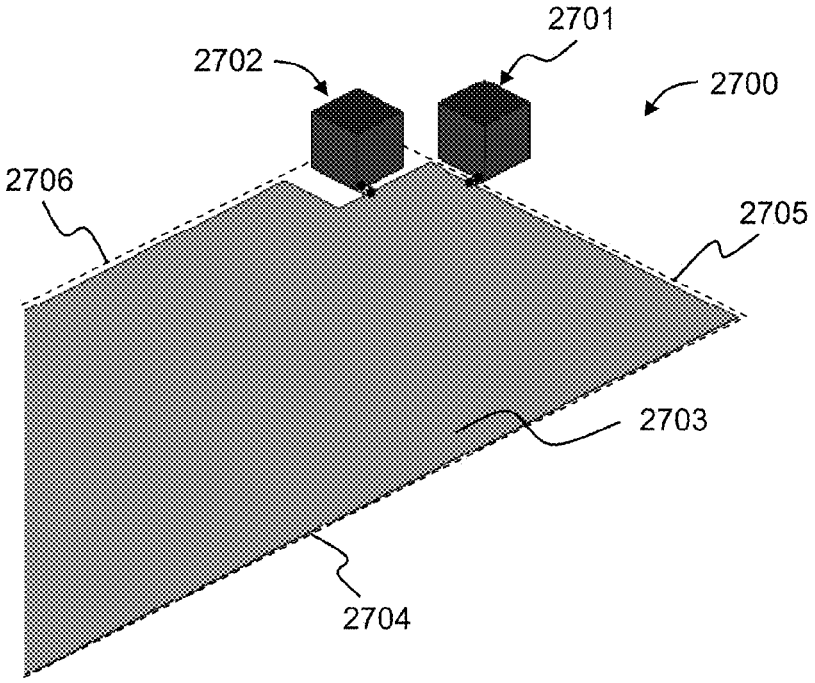
FIG. 27 is a perspective view of an example of a MIMO system including two radiation boosters located at the same corner of a ground plane.

In FIG. 27, it is presented another example of a radiating structure for a radiating system according to the present invention. The radiating structure 2700 comprises two radiation boosters: a first radiation booster 2701 and a second ration booster 2702, each again comprising a conductive part. The radiating structure 2700 further comprises a ground plane 2703 (shown only partially in FIG. 27), inscribed in a ground plane rectangle 2704. The ground plane rectangle 2704 has a short side 2705 and a long side 2706.

The first radiation booster 2701 is arranged substantially close to said short side 2705, and the second radiation booster 2702 is arranged substantially close to said long side 2706. Moreover, the first and second radiation boosters 2701, 2702 are also substantially close to a first corner of the ground plane rectangle 2704, said corner being defined by the intersection of said short side 2705 and said long side 2706.

In this particular case, the first radiation booster 2701 protrudes beyond the short side 2705 of the ground plane rectangle 2704, so that the orthogonal projection of the first radiation booster 2701 on the plane containing the ground plane 2703 is outside the ground plane rectangle 2704. On the other hand, the second radiation booster 2702 is arranged on a cut-out portion of the ground plane 2703, so that the orthogonal projection of the second radiation booster 2702 on said plane containing the ground plane 2703 does not overlap the ground plane. Moreover, said projection is completely inside the perimeter of the ground plane rectangle 2704.

However, in another example both the first and the second radiation boosters could have been arranged on cut-out portions of the ground plane, so that the radiation boosters are at least partially, or even completely, inside the perimeter of the ground plane rectangle associated to the ground plane of a radiating structure. And yet in another example, both the first and the second radiation boosters could have been arranged at least partially, or even completely, protruding beyond a side of said ground plane rectangle.

The radiating structure 2700 may be advantageous to facilitate the interconnection of the radiation boosters 2701, 2702 to a radiofrequency system, since the connection points of said radiation boosters (not indicated in FIG. 27) are much closer to each other, than they are for example in the radiating structures of FIG. 26.

Figure 28:
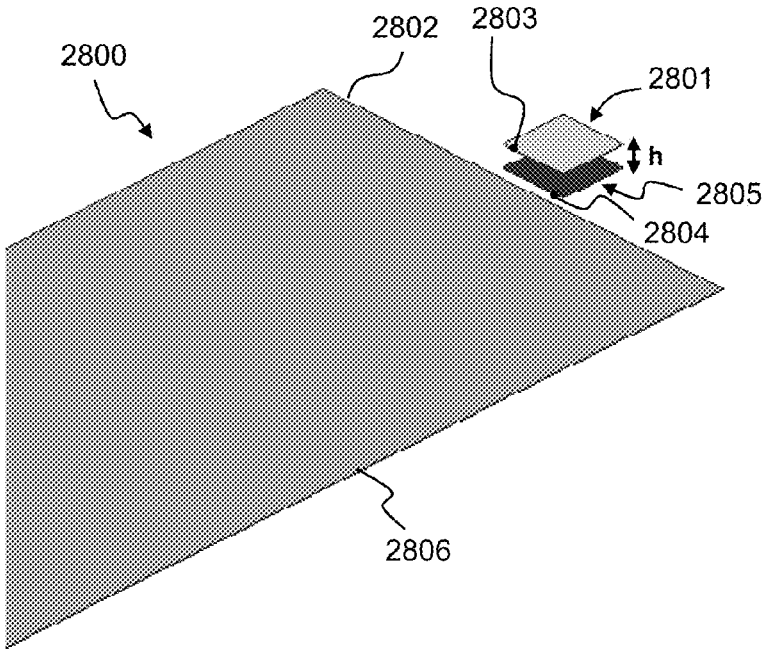
FIG. 28 is a perspective view of an example of a MIMO system including two radiation boosters in a stacked configuration.

FIG. 28 presents another example of a radiating structure comprising two radiation boosters, in which one radiation booster is arranged on top of the other radiation booster forming a stacked configuration.

The radiating structure 2800 comprises a first and a second radiation booster 2805, 2801 and a ground plane 2806. The first radiation booster 2805 comprises a substantially planar conducting part having a polygonal shape (in this example a square shape) and a first connection point 2804 located substantially on the perimeter of said conducting part. The second radiation booster 2801 also comprises a substantially planar conducting part having a polygonal shape and a second connection point 2803 located substantially on the perimeter of said conducting part. Said first and second connection points 2804, 2803 define together with a connection point of the ground plane 2806 (not shown in the figure) a first and a second internal port of the radiating structure 2800.

In the example of the figure, the shape and dimensions of the two radiation boosters 2801, 2805 are substantially the same, although in other examples the boosters may have different shapes and/or sizes, although preferably they will be substantially planar.

The first radiation booster 2805 is substantially coplanar to the ground plane 2806 of the radiating structure 2800, and is arranged with respect to said ground plane 2806 such that the first radiation booster 2805 is substantially close to a short edge 2802 of the ground plane 2806 and protrudes beyond said short edge 2802.

The second radiation booster 2801 is advantageously located at a certain height h above the first radiation booster 2805, such that the orthogonal projection of the second radiation booster 2801 on the plane containing the ground plane 2806 overlaps a substantial portion of the orthogonal projection of the first radiation booster 2805 on said plane. A substantial portion may preferably refer to at least 50%, 60%, 75% or 90% of the area of the orthogonal projection of the first radiation booster 2805. In the example of the figure, the portion overlapped corresponds to 100% of the area of the orthogonal projection of the first radiation booster 2805. This overlapping between the radiation boosters of a radiating structure is advantageous for achieving a very compact arrangement.

Furthermore, in order to facilitate the integration of the first and second boosters 2805, 2801, the height h is preferably not larger than a 2% of the free-space wavelength corresponding to the lowest frequency of the first frequency band of operation of the radiating system comprising the radiating structure 2800. In this example, said height h is about 5 mm, although in other examples it could be even smaller.

Figure 29A:
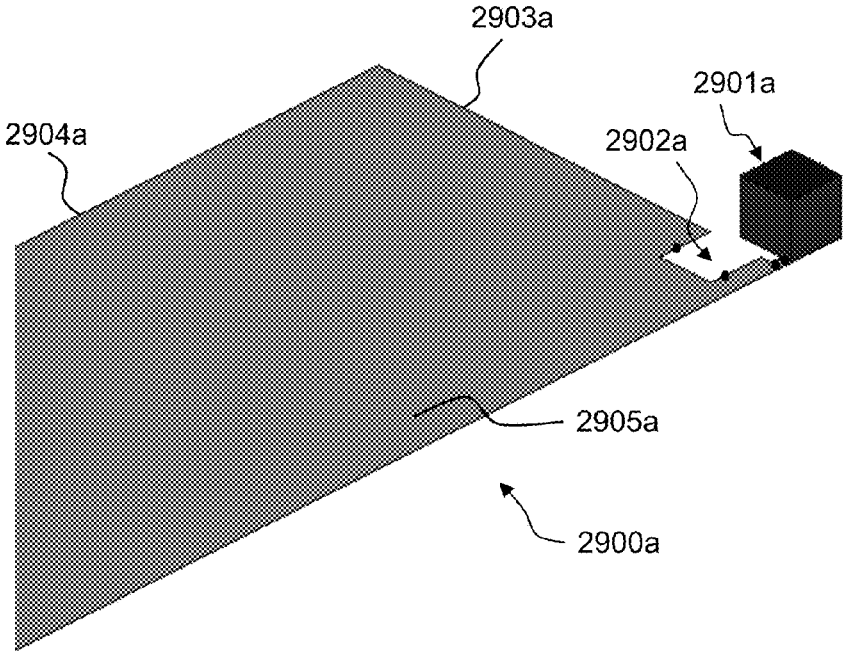
FIG. 29A is a perspective view of an example of a MIMO system including two radiation boosters, located substantially close to a corner of a ground plane, one conceived to couple capacitive energy to the ground plane radiation mode and the other radiation booster to couple inductive energy to the ground plane radiation mode.
Figure 29B:
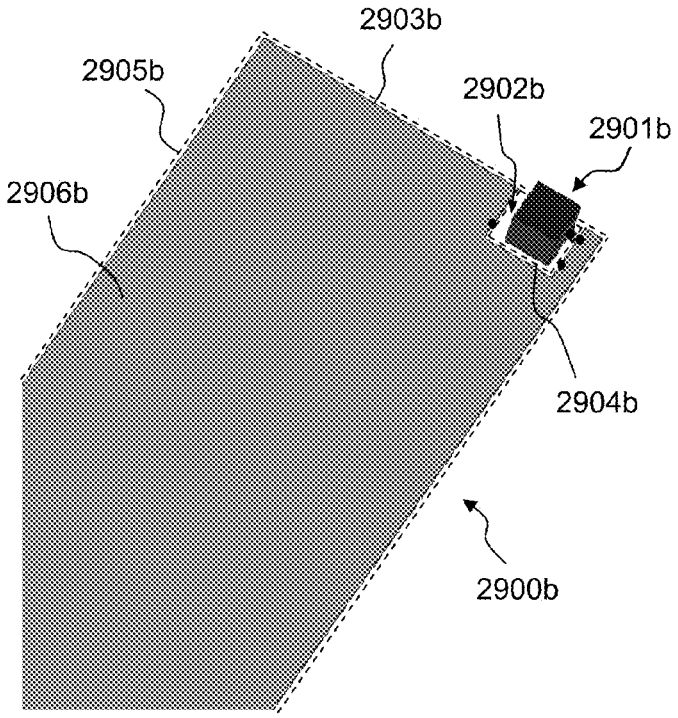
FIG. 29B is a perspective view of an example of a MIMO system including two radiation boosters, one radiation booster being embedded in an area of the other radiation booster.

FIGS. 29A-29B provide two examples of radiating structures for a radiating system capable of operating in a first and in a second frequency region according to the present invention that combine a radiation booster comprising a conductive part with another radiation booster comprising a gap defined in the ground plane of the radiating structure.

In particular, the radiating structure 2900 shown in FIG. 29A depicts the arrangement of a first and a second radiation booster 2901*a*, 2902*a* with respect to the ground plane 2905*a*.

In particular, the second radiation booster 2902*a* is located substantially close to the short edge 2903*a* of the ground plane 2905*a*, and more precisely substantially close to an end of said short edge 2903*a*. Given that the first radiation booster 2901*a* is also located substantially close to said end of the short edge 2903*a*, the first and second radiation boosters 2901*a*, 2902*a* are arranged near the same corner of the ground plane 2905*a*, which facilitates the interconnection of the radiation boosters with a radiofrequency system.

Furthermore, the second radiation booster 2902*a* has undergone a 90 degree clockwise rotation, so that the curve delimiting the gap of said second radiation booster 2902*a* intersects now the short edge 2903*a* of the ground plane 2905*a*. Such an orientation makes it possible for the second radiation booster 2902*a* to excite a radiation mode on the ground plane 2905*a* having a polarization substantially orthogonal to the polarization of the radiation mode excited on the ground plane 2905*a* by the first radiation booster 2901*a*. Orthogonal polarization of the radiation mode refers to the polarization of the radiated electric field. Such orthogonal polarizations between modes operating in the same frequency band enables a low correlation coefficient which ensures a good MIMO performance (if the correlation coefficient is high, the MIMO performance is degraded), The advantage of this example is its compactness, since both radiation boosters 2901*a* and 2902*a* are close together. Even though they are close together, the present scheme may achieve a low correlation coefficient since the radiation modes excited by such radiation boosters are substantially orthogonal.

Referring now to FIG. 29B, it is shown another example of a radiating structure that constitutes a further modification of the previous ones. More specifically, the position of the first radiation booster 2901*b* has been modified with respect to the position it had in the case of FIG. 29A, so that the first radiation booster 2901*b* has a projection on the plane containing the ground plane 2906*b* that is completely within the projection of the second radiation booster 2902*b* on said same plane. Moreover, the orthogonal projection of the first and second radiation boosters 2901*b*, 2902*b* on said plane containing the ground plane 2906*b* is completely inside the perimeter of the ground plane rectangle 2905*b* associated to the ground plane 2906*b*. Such an arrangement leads to very compact solutions.

The first radiation booster 2901*b* is advantageously embedded within the second radiation booster 2902*b*, because at least a part of a first booster box associated to the first radiation booster 2901*b* is contained within a second booster box 2904*b* associated to the second radiation booster 2902*b*. In this particular example, the first booster box coincides with the external area of the first radiation booster 2901*b*, while the second booster box 2904*b* is a two-dimensional entity defined around the gap of the second radiation booster 2902*b*. The bottom face of the first booster box is thus contained within the second booster box 2904*b*.

Figure 30:
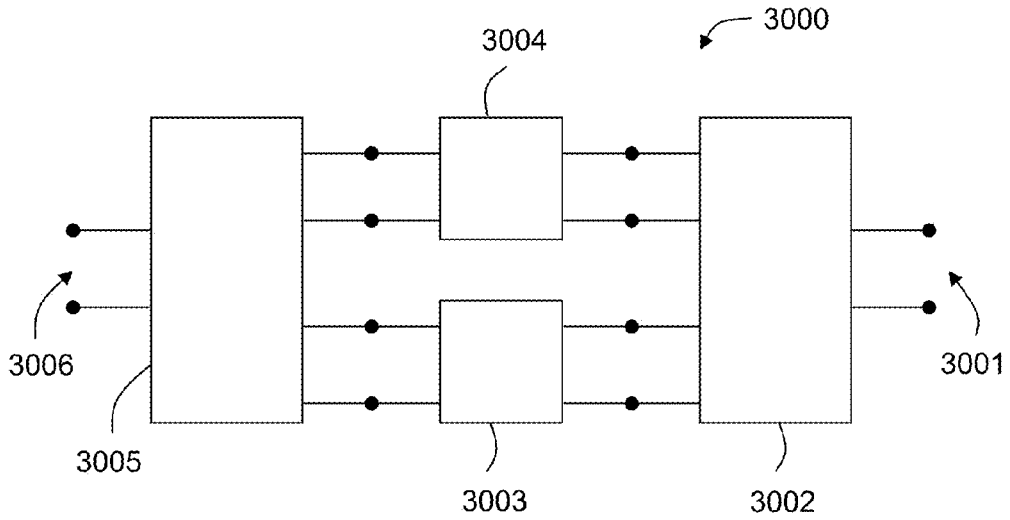
FIG. 30 is a schematic representation of a radiofrequency system including combiner/splitter and matching networks.

FIG. 30 shows an example of a radiofrequency system suitable for interconnection with for instance the radiating structure 204*a* of FIG. 2A. The radiofrequency system 3000 comprises a first diplexer 3005 to separate the electrical signals of a first and a second frequency bands of operation of a radiating system, a first matching network 3004 to provide impedance matching in said first frequency band, a second matching network 3003 to provide impedance matching in said second frequency band, and a second diplexer 3002 to recombine the electrical signals of said first and second frequency bands.

Each of the first and second matching networks 3004, 3003 may be as in any of the examples of matching networks described in connection with FIGS. 3A-3C.

The first diplexer 3005 is connected to a first port 3006, while the second diplexer 3002 is connected to a second port 3001. In a radiating system, an internal port of a radiating structure (such as for instance the internal port of the radiating structure 204*a*) may be connected to said first port 3006, while an external port of the radiating system may be connected to said second port 3001.

The use of diplexers in the radiofrequency system is advantageous to separate the electrical signals of different frequency regions and transform the input impedance characteristics in each frequency region independently from the others.

Even though that in the illustrative examples described above in connection with the figures some particular designs of radiation boosters have been used, many other designs of radiation boosters having for example different shape and/or dimensions could have been equally used in the radiating structures.

Also, even though that some examples of radiating structures have been described as comprising radiation boosters having a conductive part, other possible examples could have been constructed using radiation boosters comprising a gap defined in the ground plane of the radiating structure.

In the same way, despite the fact some radiation boosters have been chosen to be equal in topology (i.e., a planar versus a volumetric geometry), shape and size, they could have been selected to have different topology, shape and/or size, while preserving for example the relative location of the radiation boosters with respect to each other and with respect to the ground plane.

What is claimed is:

1. A wireless handheld or portable device, comprising:

a communication module comprising a MIMO system configured to provide multiband MIMO operation in a first frequency band and in a second frequency band, the first frequency band having a central frequency lower than a central frequency of the second frequency band, the MIMO system comprising:

a ground plane common to a first and second radiating systems;

the first radiating system being configured to transmit and receive electromagnetic wave signals in the first and second frequency bands, the first radiating system comprising:

at least one external port; and a first radiating structure comprising: the ground plane, a first radiation booster that fits in an imaginary sphere having a diameter smaller than ¼ of a diameter of a radiansphere of a free-space operating wavelength corresponding to a lowest frequency of the first frequency band and configured to couple electromagnetic energy from/to the ground plane, and a first internal port defined between a connection point of the first radiation booster and a first connection point of the ground plane;

a first radiofrequency system comprising: a first port connected to the first internal port; and a second port connected to the at least one external port of the first radiating system, wherein: an input impedance of the first radiating structure, measured at the first internal port when disconnected from the first radiofrequency system, has an imaginary part not equal to zero for any frequency of the first frequency band; and the first radiofrequency system modifies impedance of the first radiating structure to provide impedance matching to the first radiating system within the first and second frequency bands;

the second radiating system being configured to transmit and receive electromagnetic waves in the first and second frequency bands, the second radiating system comprising:

at least one external port; and a second radiating structure comprising: the ground plane, a second radiation booster that fits in an imaginary sphere having a diameter smaller than ¼ of a diameter of a radiansphere of a free-space operating wavelength corresponding to the lowest frequency of the first frequency band and configured to couple electromagnetic energy from/to the ground plane, and a second internal port defined between a connection point of the second radiation booster and a second connection point of the ground plane;

a second radiofrequency system comprising: a first port connected to the second internal port; and a second port connected to the at least one external port of the second radiating system, wherein: an input impedance of the second radiating structure, measured at the second internal port when disconnected from the second radiofrequency system, has an imaginary part not equal to zero for any frequency of the first frequency band; and the second radiofrequency system modifies impedance of the second radiating structure to provide impedance matching to the second radiating system within the first and second frequency bands; and a module with MIMO capabilities connected to the first and second radiating systems and configured to process the electromagnetic wave signals from the first and second frequency bands.

2. The wireless handheld or portable device according to claim 1, wherein:

a ground plane rectangle is a minimum-sized rectangle that encompasses the ground plane;

the ground plane rectangle has first, second, third and fourth sides, a length of the first and second sides being greater than a length of the third and fourth sides;

the first radiation booster is arranged substantially close to a first end of the first side; and the second radiation booster is arranged substantially close to a second end of the first side.

3. The wireless handheld or portable device according to claim 1, wherein the first and second frequency bands are within a 600 MHz to 3600 MHz frequency range.

4. The wireless handheld or portable device according to claim 3, wherein the first and second frequency bands do not overlap in frequency.

5. The wireless handheld or portable device according to claim 1, wherein each of the first and second radiation boosters has a maximum size less than 1/30 times a free-space operating wavelength corresponding to the lowest frequency of the first frequency band.

6. The wireless handheld or portable device according to claim 1, wherein:

a ground plane rectangle is a minimum-sized rectangle that encompasses the ground plane;

the ground plane rectangle has first, second, third and fourth sides, a length of the first and second sides being greater than a length of the third and fourth sides; and a ratio between the length of the first or second side of the ground plane rectangle and a free-space operating wavelength corresponding to the lowest frequency of the first frequency band is smaller than 1.2.

7. The wireless handheld or portable device according to claim 1, wherein:

the first radiating structure comprises: a third radiation booster that fits in an imaginary sphere having a diameter smaller than ¼ of a diameter of a radiansphere at a free-space operating wavelength corresponding to the lowest frequency of the first frequency band, and a third internal port defined between a connection point of the third radiation booster and a third connection point of the ground plane;

the first radiofrequency system comprises a third port connected to the third internal port;

an input impedance of the first radiating structure, measured at the third internal port when disconnected from the first radiofrequency system, has an imaginary part not equal to zero for any frequency of the first frequency band;

the second radiating structure comprises: a fourth radiation booster that fits in an imaginary sphere having a diameter smaller than ¼ of a diameter of a radiansphere at a free-space operating wavelength corresponding to the lowest frequency of the first frequency band, and a fourth internal port defined between a connection point of the fourth radiation booster and a fourth connection point of the ground plane;

the second radiofrequency system comprises a third port connected to the fourth internal port; and an input impedance of the second radiating structure, measured at the fourth internal port when disconnected from the second radiofrequency system, has an imaginary part not equal to zero for any frequency of the first frequency band.

8. The wireless handheld or portable device according to claim 7, wherein each of the first, second, third and fourth radiation boosters has a maximum size less than 1/30 times a free-space operating wavelength corresponding to the lowest frequency of the first frequency band.

9. The wireless handheld or portable device according to claim 7, wherein:

a ground plane rectangle is a minimum-sized rectangle that encompasses the ground plane;

the ground plane rectangle has first, second, third and fourth sides, a length of the first and second sides being greater than a length of the third and fourth sides;

the first radiation booster is arranged substantially close to a first corner corresponding to a first end of the first side and a first end of the third side;

the second radiation booster is arranged substantially close to a second corner corresponding to a second end of the first side and a first end of the fourth side;

the third radiation booster is arranged substantially close to a third corner corresponding to a second end of the third side and a first end of the second side; and the fourth radiation booster is arranged substantially close to a fourth corner corresponding to a second end of the second side and a second side of the fourth side.

10. The wireless handheld or portable device according to claim 7, wherein:

the ground plane is formed by at least a first conducting structure and a second conducting structure, the first and second conducting structures being electrically connected;

the first and third connections points of the ground plane are located in the first conducting structure; and the second and fourth connections points of the ground plane are located in the second conducting structure.

11. The wireless handheld or portable device according to claim 1, wherein:

the input impedance of the first radiating structure, measured at the first internal port when disconnected from the first radiofrequency system, features a capacitive component for frequencies of the first and second frequency bands; and the input impedance of the second radiating structure, measured at the second internal port when disconnected from the second radiofrequency system, features a capacitive component for frequencies of the first and second frequency bands.

12. The wireless handheld or portable device according to claim 1, wherein the ground plane is formed by at least two conducting structures electrically connected.

13. The wireless handheld or portable device according to claim 1, wherein:

the first radiofrequency system provides impedance matching to the first radiating system within the first and second frequency bands at the at least one external port of the first radiating system; and the second radiofrequency system provides impedance matching to the second radiating system within the first and second frequency bands at the at least one external port of the second radiating system.

14. The wireless handheld or portable device according to claim 1, wherein:

the first radiating system comprises first and second external ports, and the first radiofrequency system comprises a third port;

the second port of the first radiofrequency system is connected to the first external port, and the third port of the first radiofrequency system is connected to the second external port;

the second radiating system comprises third and fourth external ports, and the second radiofrequency system comprises a third port;

the second port of the second radiofrequency system is connected to the third external port, and the third port of the second radiofrequency system is connected to the fourth external port;

the first radiofrequency system modifies impedance of the first radiating structure to provide impedance matching to the first radiating system within the first frequency band at the first external port, and within the second frequency band at the second external port; and the second radiofrequency system modifies impedance of the second radiating structure to provide impedance matching to the second radiating system within the first frequency band at the third external port, and within the second frequency band at the fourth external port.

15. A wireless handheld or portable device comprising:

a communication module comprising a MIMO system configured to provide multiband MIMO operation in a first and second frequency bands, the first frequency band having a central frequency lower than a central frequency of the second frequency band, the MIMO system comprising:

a ground plane comprising first and second conducting structures electrically connected;

a first radiating system configured to transmit and receive electromagnetic wave signals in the first and second frequency bands, the first radiating system comprising:

at least one external port; and a first radiating structure comprising: the ground plane, a first radiation booster that fits in an imaginary sphere having a diameter smaller than ¼ of a diameter of a radiansphere of a free-space operating wavelength corresponding to a lowest frequency of the first frequency band and configured to couple electromagnetic energy from/to the ground plane, and a first internal port defined between a connection point of the first radiation booster and a connection point of the first conducting structure;

a first radiofrequency system comprising: a first port connected to the first internal port; and a second port connected to the at least one external port of the first radiating system, wherein: the first radiating structure features at the first internal port, when disconnected from the first radiofrequency system, a first resonant frequency at a frequency higher than the highest frequency of the first frequency band; and the first radiofrequency system modifies impedance of the first radiating structure to provide impedance matching to the first radiating system within the first and second frequency bands;

a second radiating system configured to transmit and receive electromagnetic waves in the first and second frequency bands, the second radiating system comprising:

at least one external port; and a second radiating structure comprising: the ground plane, a second radiation booster that fits in an imaginary sphere having a diameter smaller than ¼ of a diameter of a radiansphere of a free-space operating wavelength corresponding to the lowest frequency of the first frequency band and configured to couple electromagnetic energy from/to the ground plane, and a second internal port defined between a connection point of the second radiation booster and a connection point of the second conducting structure;

a second radiofrequency system comprising: a first port connected to the second internal port; and a second port connected to the at least one external port of the second radiating system, wherein: the second radiating structure features at the second internal port, when disconnected from the second radiofrequency system, a first resonant frequency at a frequency higher than the highest frequency of the first frequency band; and the second radiofrequency system modifies impedance of the second radiating structure to provide impedance matching to the second radiating system within the first and second frequency bands; and a MIMO module connected to the first and second radiating systems and configured to process the electromagnetic wave signals from the first and second frequency bands.

16. The wireless handheld or portable device according to claim 15, wherein the first resonant frequency of each of the first and second radiating structures is at a frequency higher than a highest frequency of the second frequency band.

17. The wireless handheld or portable device according to claim 15, wherein each of the first and second radiation boosters has a maximum size less than 1/30 times a free-space operating wavelength corresponding to the lowest frequency of the first frequency band.

18. The wireless handheld or portable device according to claim 15, wherein the first and second frequency bands do not overlap in frequency.

19. The wireless handheld or portable device according to claim 15, wherein:

the first radiating structure comprises: a third radiation booster that fits in an imaginary sphere having a diameter smaller than 1/4 of a diameter of a radiansphere at a free-space operating wavelength corresponding to the lowest frequency of the first frequency band, and a third internal port defined between a connection point of the third radiation booster and a connection point of the first conducting structure;

the first radiofrequency system comprises a third port connected to the third internal port;

the first radiating structure features at the third internal port, when disconnected from the first radiofrequency system, a first resonant frequency at a frequency higher than the highest frequency of the first frequency band;

the second radiating structure comprises: a fourth radiation booster that fits in an imaginary sphere having a diameter smaller than 1/4 of a diameter of a radiansphere at a free-space operating wavelength corresponding to the lowest frequency of the first frequency band, and a fourth internal port defined between a connection point of the fourth radiation booster and a connection point of the second conducting structure;

the second radiofrequency system comprises a third port connected to the fourth internal port; and the second radiating structure features at the fourth internal port, when disconnected from the second radiofrequency system, a first resonant frequency at a frequency higher than the highest frequency of the first frequency band.

20. The wireless handheld or portable device according to claim 15, wherein:

the ground plane comprises a third conducting structure electrically connected to the first and second conducting structures;

the first radiating structure comprises: a third radiation booster that fits in an imaginary sphere having a diameter smaller than 1/4 of a diameter of a radiansphere at a free-space operating wavelength corresponding to the lowest frequency of the first frequency band, and a third internal port defined between a connection point of the third radiation booster and a connection point of the third conducting structure;

the first radiofrequency system comprises a third port connected to the third internal port;

the first radiating structure features at the third internal port, when disconnected from the first radiofrequency system, a first resonant frequency at a frequency higher than the highest frequency of the first frequency band;

the second radiating structure comprises: a fourth radiation booster that fits in an imaginary sphere having a diameter smaller than 1/4 of a diameter of a radiansphere at a free-space operating wavelength corresponding to the lowest frequency of the first frequency band, and a fourth internal port defined between a connection point of the fourth radiation booster and a connection point of the second conducting structure;

the second radiofrequency system comprises a third port connected to the fourth internal port; and the second radiating structure features at the fourth internal port, when disconnected from the second radiofrequency system, a first resonant frequency at a frequency higher than the highest frequency of the first frequency band.

* * * * *